US011592269B2

(12) United States Patent
Green et al.

(10) Patent No.: US 11,592,269 B2
(45) **Date of Patent: *Feb. 28, 2023**

(54) FLASH DIRECTED REACTIVE TARGET AND METHOD OF MANUFACTURE

(71) Applicant: I P Creations Limited, Swindon (GB)

(72) Inventors: Benjamin John Green, Swindon (GB); Daniel Hill Meeker, Fort Worth, TX (US)

(73) Assignee: I P Creations Limited, Swindon (GB)

( * ) Notice: Subject to any disclaimer, the term of this patent is extended or adjusted under 35 U.S.C. 154(b) by 549 days.

This patent is subject to a terminal disclaimer.

(21) Appl. No.: 16/723,170

(22) Filed: Dec. 20, 2019

(65) Prior Publication Data

US 2020/0158478 A1 May 21, 2020

Related U.S. Application Data

(63) Continuation-in-part of application No. 16/410,875, filed on May 13, 2019, which is a continuation-in-part (Continued)

(51) Int. Cl.
*F41J 5/26* (2006.01)
*C06B 21/00* (2006.01)

(Continued)

(52) U.S. Cl.
CPC ..... *F41J 5/26* (2013.01); *C06B 21/0091* (2013.01); *F41J 9/165* (2013.01); *F41J 9/16* (2013.01); *F42B 33/0207* (2013.01)

(58) Field of Classification Search
CPC . F41J 1/01; F41J 5/24–26; F41J 9/165; C06B 21/0091; C06B 23/02;

(Continued)

(56) References Cited

U.S. PATENT DOCUMENTS 2,368,310 A 1/1945 Lecky et al.
3,327,628 A 6/1967 Loprest (Continued)

FOREIGN PATENT DOCUMENTS

CA 2919267 A1 7/2017
CN 101450881 6/2009

(Continued)

OTHER PUBLICATIONS

'Beaver Dam Buster' Exploding Rifle Target—(4LB Target), Fire Quest, firequest.com, Order# EX244, Aug. 17, 2013.

(Continued)

*Primary Examiner* — Laura Davison
(74) *Attorney, Agent, or Firm* — Schultz & Associates, P.C.

(57) ABSTRACT

A concealed amalgamated neutralizer device covertly combines neutralizer material of inert materials such as calcium carbonate or silicates with common energetic material for the prevention of malicious use of the energetic material. The concealed amalgamated neutralizer device may vary in shape, size, and color and is therefore adaptable to varying methods of containment. The neutralizer material mimics the energetic material without detection. Upon disassembly of the concealed amalgamated neutralizer device, the neutralizer material is mixed with and neutralizes the energetic material rendering the energetic material useless. A container is provided which has a bottom section having an interior surface including a plurality of integrally formed recesses that are filled with the energetic material which allow manipulation of flash direction and intensity upon detonation.

26 Claims, 42 Drawing Sheets

Related U.S. Application Data of application No. 15/172,000, filed on Jun. 2, 2016, now Pat. No. 10,288,390, which is a continuation-in-part of application No. 14/857,061, filed on Sep. 17, 2015, now Pat. No. 9,714,199.

(60) Provisional application No. 62/825,539, filed on Mar. 28, 2019.

(51) Int. Cl.
*F41J 9/16* (2006.01)
*F42B 33/02* (2006.01)

(58) Field of Classification Search
CPC ..... C06B 23/005; C06B 29/04–10; C06B 45/12–16; F42B 1/024
See application file for complete search history.

(56) References Cited

U.S. PATENT DOCUMENTS

| | | | | |
|---|---|---|---|---|
| 3,421,441 | A | 1/1969 | Mardarello | |
| 3,667,387 | A | 6/1972 | Picard et al. | |
| 3,738,276 | A | 6/1973 | Picard et al. | |
| 3,774,541 | A | 11/1973 | Bratton | |
| 4,243,228 | A | 1/1981 | Marcella | |
| 4,270,435 | A | 6/1981 | Hurst | |
| 4,372,210 | A | 2/1983 | Shaffer et al. | |
| 4,404,911 | A | 9/1983 | Bell | |
| 4,424,087 | A * | 1/1984 | Holm | C06B 23/005 149/21 |
| 4,426,932 | A | 1/1984 | Bell | |
| 4,498,677 | A | 2/1985 | Dapkus | |
| 4,802,676 | A | 2/1989 | Descos | |
| 5,024,159 | A | 6/1991 | Walley | |
| 5,316,313 | A | 5/1994 | Moore | |
| 5,467,998 | A | 11/1995 | Hellings | |
| 5,574,203 | A | 11/1996 | Noel et al. | |
| 5,575,479 | A | 11/1996 | Ayres | |
| 5,665,276 | A | 11/1997 | Kirby et al. | |
| 5,788,243 | A | 8/1998 | Harshaw | |
| 6,405,626 | B1 | 6/2002 | Bureaux et al. | |
| 6,848,366 | B1 | 2/2005 | Tanner | |
| 7,299,735 | B2 | 11/2007 | Alford | |
| 7,690,287 | B2 | 4/2010 | Maegerlein et al. | |
| 7,927,437 | B2 | 4/2011 | Gangopadhyay et al. | |
| 8,273,197 | B2 | 9/2012 | Rostlund | |
| 8,308,879 | B2 | 11/2012 | Runemard et al. | |
| 8,505,427 | B2 | 8/2013 | Wilson et al. | |
| 8,585,841 | B2 | 11/2013 | Lubbe et al. | |
| 8,671,841 | B2 | 3/2014 | Raquin et al. | |
| 8,850,984 | B2 | 10/2014 | Smylie et al. | |
| 10,113,840 | B2 | 10/2018 | Farnsworth | |
| 10,183,898 | B2 | 1/2019 | Smith | |
| 2002/0117071 | A1 * | 8/2002 | Kaliszewski | C06B 33/04 102/335 |
| 2005/0109230 | A1 | 5/2005 | Falquette | |
| 2006/0124019 | A1 | 6/2006 | Coughlin et al. | |
| 2010/0207331 | A1 | 8/2010 | Boeh | |
| 2010/0275802 | A1 | 11/2010 | Green | |
| 2011/0124945 | A1 | 5/2011 | Smylie et al. | |
| 2011/0285088 | A1 | 11/2011 | Gregg | |
| 2014/0083402 | A1 | 3/2014 | Fridman et al. | |
| 2014/0170300 | A1 | 6/2014 | Green | |
| 2017/0023337 | A1 | 1/2017 | Krywonizka | |

FOREIGN PATENT DOCUMENTS

| | | | | |
|---|---|---|---|---|
| CN | 101838172 | | 9/2010 | |
| CN | 102838434 | | 12/2012 | |
| DE | 19901100 | A1 | 7/2000 | |
| FR | 2777648 | | 11/2001 | |
| GB | 657459 | A | 9/1951 | |
| GB | 2130894 | B | 7/1986 | |
| GB | 2227816 | | 8/1990 | |
| GB | 2454863 | A | 5/2009 | |
| GB | 2472571 | A | 2/2011 | |
| GB | 2540342 | A * | 1/2017 | F41J 5/24 |
| JP | 2005273971 | | 10/2005 | |
| WO | 0235175 | A1 | 5/2002 | |
| WO | 2018024302 | A1 | 2/2018 | |

OTHER PUBLICATIONS 1 lb Exploding Rifle Target, Sonic Boom, sonicboomtargets.com, Feb. 5, 2019.

Tannerite Exploding Rifle Targets, Bass Pro Shops, basspro.com, Feb. 5, 2019.

White Flyer® Targets, R&R Trap Sales Services, rrtraps.com, Aug. 17, 2018.

Smith Industries—Sure Shot Exploding Rifle Targets, Brownells ®, brownells.com, Apr. 25, 2017.

Star Targets Exploding Rifle Target Plastic Canister 2-1/2 lb, Midway USA, midwayusa.com, Product#: 228652, Star Targets #: ST-0932, UPC #: 793573754431, Jul. 27, 2015.

Patel, et al., "In-Situ Landmine Neutralization by Chemical versus Thermal Initiation Deminer Preferences," U. S. Army Communications-Electronics Research, Development, and Engineering Center, 2006, 7 pages. Fort Belvoir, VA. http://www.dtic.mil/dtic/tr/fulltext/u2/a458418.pdf.

U.S. Chemical Safety and Hazard Investigation Board, "Investigation Report: Donaldson Enterprises, Inc. Fireworks Disposal Explosion and Fire," Report No. 2011-06-I-HI, Jan. 2013, pp. 1-91. http://www.csb.gov/assets/1/19/DEI_Final_01172013.pdf.

* cited by examiner

METHOD USING SEPARATION BARRIER

METHOD USING IMPLANTED SPHERE

METHOD USING COVERED SPHERE

METHOD USING SUBSTRATE

METHOD FOR AMMUNITION

METHOD FOR ROMAN CANDLE

METHOD FOR ROLLING SOLIDIFIED MATERIAL

METHOD FOR ROLLING SLURRIES APPLIED TO PAPER

METHOD USING SHELL CASE

METHOD FOR PYROTECHNIC PIGEON

METHOD OF DEPOSITING SLURRY INTO A CONTAINER

FLASH DIRECTED REACTIVE TARGET AND METHOD OF MANUFACTURE

CROSS-REFERENCE TO RELATED APPLICATIONS

This application is a continuation-in-part of U.S. patent application Ser. No. 16/410,875 filed on May 13, 2019, which claims the benefit of U.S. Provisional Patent Application No. 62/825,539 filed on Mar. 28, 2019, which is a continuation-in-part of U.S. patent application Ser. No. 15/172,000 filed on Jun. 2, 2016 now U.S. Pat. No. 10,288,390 granted on May 14, 2019, which is a continuation-in-part of U.S. patent application Ser. No. 14/857,061 filed Sep. 17, 2015, now U.S. Pat. No. 9,714,199 granted on Jul. 25, 2017. Each of the patent applications identified above is incorporated herein by reference in its entirety to provide continuity of disclosure.

FIELD OF THE INVENTION

The present disclosure relates to neutralization of explosive materials contained in explosives and pyrotechnics. In particular, the disclosure relates to devices and methods for rendering pyrotechnics and ammunition inert or less effective. The present disclosure also relates to biodegradable reactive targets which contain one or more explosive materials.

BACKGROUND OF THE INVENTION

The current worldwide political climate has produced many terrorist and anti-establishment factions that are motivated to create explosive devices from commonly available consumer products. For example, roadside or improvised explosive devices known as IEDs have been encountered in Afghanistan and in Iraq by the U.S. military and in Boston by local police.

A common practice used in constructing an IED involves the acquisition and disassembly of easily acquired consumer grade explosive products such as fireworks or small arms ammunition. The products are disassembled, yielding explosive material, e.g., black powder or other incendiary material. The explosive material is then combined with projectiles such as nails or broken glass and encased in a rigid container such as an aluminum cooking pot. The results are easily concealed and a deadly combination that is both inexpensive and effective.

Consumer grade explosive products contain various explosive materials. For example, gunpowder is a very common chemical explosive and comes in two basic forms, modern, smokeless gunpowder and traditional, black powder gunpowder. Black powder is a mixture of sulfur, charcoal, and potassium nitrate (saltpeter). The sulfur and charcoal act as fuels, and the saltpeter is an oxidizer. The standard composition for gunpowder is about 75% potassium nitrate, about 15% charcoal, and about 10% sulfur (proportions by weight). The ratios can be altered somewhat depending on the purpose of the powder. For instance, power grades of gunpowder, unsuitable for use in firearms but adequate for blasting rock in quarrying operations, have proportions of about 70% nitrate, about 14% charcoal, and about 16% sulfur. Some blasting powder may be made with cheaper sodium nitrate substituted for potassium nitrate and proportions may be as low as about 40% nitrate, about 30% charcoal, and about 30% sulfur.

Most pyrotechnic compositions and explosive materials can be neutralized when mixed with an appropriate combination of inert materials, slowing the burn rate of the explosive material to a non-explosive level that effectively neutralizes the explosive material and renders the explosive material useless for an improvised explosive device.

The prior art addresses the neutralization of explosive devices. However, none of the prior art devices or methods is completely satisfactory in neutralizing explosive materials in consumer products.

For example, U.S. Pat. No. 7,690,287 to Maegerlein, et al. provides a neutralizing assembly for inhibiting operation of an explosive device. The neutralizing assembly will interrupt the function of the explosive device only when the explosive device is misused. The neutralizing assembly includes an interior chamber with a rupturable barrier containing disabling material. The rupturable barrier separates the disabling material from the explosive material. Upon misuse of the device, the rupturable barrier breaks and the disabling material is released from the interior chamber to disable the explosive material.

U.S. Pat. No. 3,738,276 to Picard, et al. discloses a halocarbon gel for stabilizing an explosive material during transport. In use, flexible bags are prepared which contain the explosive material mixed with a desensitizing substance. The bags are placed in a protective gel. The gel prevents the desensitizing substance from evaporating through the flexible bags. When the transport is complete, the bags are removed from the gel. Once the bags are removed from the gel, the desensitizing substance evaporates, thus "arming" the explosive material.

U. S. Patent Publication No. 2011/0124945 to Smylie, et al. discloses a cartridge that is adapted to achieve deactivation of an explosive composition. In Smylie, the explosive composition and the chemical deactivating agent are held in separate chambers of the cartridge separated by a wall. Upon activation, the wall is breached and the deactivating agent and the explosive composition are allowed to mix, thereby rendering the explosive composition inert.

Reactive targets that are used as indicators of accuracy in long range rifle competitions are one example of consumer products that can be misused to create explosive devices. Similarly, other competition shooting events often require reactive targets. For example, reactive clay targets are required for skeet and trap shooting.

It is known in the art to provide reactive targets which comprise a container filled with a pyrotechnic material, including an oxidizing agent, a reducing agent, a sensitizer and a binder. These pyrotechnic targets are known to be contained in a housing comprising a flat cylinder formed of a suitable metal, such as aluminum or steel. An example is shown in U.S. Publication No. 2010/0275802 to Green, et al.

Besides the possibility of prior art reactive targets being misused to create explosive devices, they have other dangerous side effects. For example, over time, shooting ranges and other locations where practice shooting occurs become polluted with thousands of used reactive targets. Such areas are difficult to impossible to clean and are unsightly to the casual observer. More importantly, metal containers and the binders used in them, such as pitches and tar not only are non-biodegradable, but are toxic. In great quantities, such toxic substances are subsumed into the soil and can harm wildlife, plant life and underground water supplies.

The prior art has not solved the problem of reactive targets provided in toxic packaging that create an unsightly and toxic residue when used.

It is, therefore, an object of this disclosure to provide a design for and method of manufacture of products which include an undetectable neutralizing agent that automatically and effectively neutralizes an explosive material upon disassembly, and further to package these materials in containers that when used will be non-toxic to the environment and will naturally degrade over time.

SUMMARY OF THE INVENTION

A concealed amalgamated neutralizer (CAN) is disclosed for the prevention of malicious conversion of consumer fireworks, ammunition, and other pyrotechnic products into dangerous explosive devices, such as an IED In a preferred embodiment, a method of manufacture is provided whereby neutralizer material is undetectably situated adjacent to explosive material. The neutralizer material is chosen from various combinations of inert materials such as calcium carbonate, silica, or other inert materials combined with complimentary inert bonding and pigmentation chemicals. The neutralizer material is chosen and modified to mimic the physical characteristics (grain size, density, color) of the explosive material so that when placed side by side with the explosive material, the two components are practically indistinguishable and inseparable.

In one embodiment, the neutralizer material may be a combination of pigmented inert granular constituents. In another embodiment, the neutralizer material may be a liquid or viscous slurry in combination with a source binder and capable of drying into a compact solid.

In another embodiment, a cylindrical design is provided, which positions the explosive material adjacent the neutralizer material along a common central axis. The physical position and/or ratio of the neutralizer material relative to the explosive material can vary to change the extent of the neutralization.

In one embodiment, a temporary build container is provided in the form of a "tube within a tube." A dry granular explosive material is introduced into the interstitial space between the tubes but excluded from the inner tube. A dry granular neutralizer material of similar color, density, size and texture as the explosive material is then introduced in the inner tube. The inner tube is then removed, allowing the explosive material to contact, but not mix with, the neutralizer material at a boundary interface. The resulting solid cylindrical shape is then packed and sealed, preserving the respective positions of the two components and the boundary interface.

In another embodiment, a spherically shaped device is provided. The neutralizer materials and explosive materials may each be hemispherical and placed "side-by-side." Temporary physical barriers may be used to separate the components, which are removed during manufacture to create a final product.

In another embodiment of the invention using a slurry of wet materials, a "layered" product is provided fixed to a substrate.

In another embodiment, a slurry of wet materials is deposited in a shallow cylindrical container advanced on a conveyor belt to form a layered final product.

In another embodiment, an interior surface of a bottom section of a container has recesses that function to receive and hold localized concentrations of energetic material as the energetic material is dispensed into the container during manufacture. The concentrations of energetic material in the recesses can be isolated from one another or joined together depending on the amount of energetic material that is dispensed into the container. In either of these two embodiments, the energetic material is covered with an overlying layer of neutralizer to prevent misuse of the energetic material. Upon impact by a projectile and detonation, the concentrations of energetic material impart localized increased velocity to reactants from the energetic material that are unexpectedly useful to generate observable and useful optical effects.

In each case, the neutralizer material is placed in direct physical contact with the explosive material. The neutralizer material is physically indiscernible from the explosive material, and so the boundary interface between the two is very difficult or impossible to distinguish. Upon disassembly of the product, the neutralizer material is physically mixed with the explosive material, resulting in a combined material that is inert and useless as an explosive.

The present invention provides a reactive target which incorporates a pyrotechnic material in a semi-rigid container that is both biodegradable and nontoxic.

BRIEF DESCRIPTION OF THE DRAWINGS

The disclosed embodiments will be described with reference to the accompanying drawings. The drawings are not all to scale.

DETAILED DESCRIPTION OF THE INVENTION

Figure 1A:
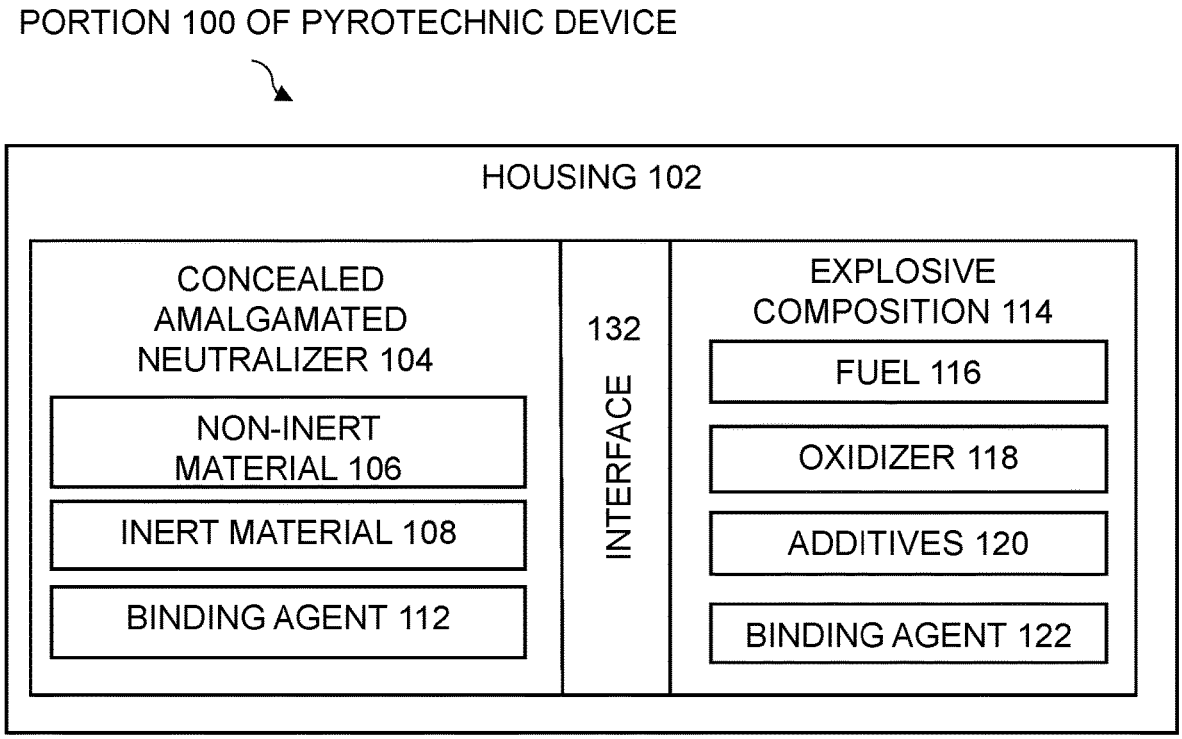
FIG. 1A is a schematic diagram of a portion of a pyrotechnic device in accordance with a preferred embodiment of this disclosure.

Referring to FIG. 1A, portion 100 of a pyrotechnic or explosive device is shown that includes concealed amalgamated neutralizer 104 to prevent the use of explosive composition 114 in other devices. Portion 100 comprises housing 102, which acts to enclose and/or support concealed amalgamated neutralizer 104 and explosive composition 114. Concealed amalgamated neutralizer 104 and explosive composition 114 are positioned with or adjacent to each other. Interface 132 is an indiscernible boundary interface between concealed amalgamated neutralizer 104 and explosive composition 114 and is where concealed amalgamated neutralizer 104 touches explosive composition 114. Example pyrotechnic devices that comprise portion 100 include ammunition (such as shotgun shell 1000 of FIG. 10), fireworks (such as Roman candle 1200 of FIG. 12), and other explosive devices (such as a training target comprising the devices of FIGS. 8A, 8B and 18 and percussion caps).

Concealed amalgamated neutralizer 104 is a composition having a color and grain size that is indiscernible from the color and grain size of explosive composition 114. When mixed sufficiently with explosive composition 114, explosive power of the resulting mixture is reduced as compared to the explosive power of explosive composition 114 so as to prevent the use of explosive composition 114 outside of housing 102. Concealed amalgamated neutralizer 104 comprises non-inert material 106, inert material 108, and binding agent 112. Concealed amalgamated neutralizer 104 may be formed from a slurry, such as neutralizer slurry 124 of FIG. 1B.

In alternative embodiments, concealed amalgamated neutralizer 104 is formed without being processed from a neutralizer slurry. As an example, concealed amalgamated neutralizer 104 may be formed from a dry powder.

Materials used as non-inert material 106 include aluminum and may optionally comprise or form a pigment. Non-inert material 106 may include materials similar to fuel 116 of explosive composition 114. Non-inert material 106 alters the fuel to oxidizer ratio of explosive composition 114 and/or provides different burn characteristics so as to reduce the explosiveness of explosive composition 114 when explosive composition 114 is combined with concealed amalgamated neutralizer 104 outside of housing 102.

Materials used in inert material 108 include magnesium silicate and chalk and may optionally comprise or form a pigment. Inert material 108 does not burn or explode and acts to reduce the explosiveness of explosive composition 114 when explosive composition 114 is combined with concealed amalgamated neutralizer 104 outside of housing 102.

Materials used as binding agent 112 of concealed amalgamated neutralizer 104 include cellulose and shellac and also include materials similar to materials used as binding agent 122 of explosive composition 114. Binding agent 112 acts to bind the components of concealed amalgamated neutralizer 104 together and prevent the components of concealed amalgamated neutralizer 104 from mixing with explosive composition 114 while concealed amalgamated neutralizer 104 and explosive composition 114 are contained within the pyrotechnic device comprising portion 100.

Figure 1B:
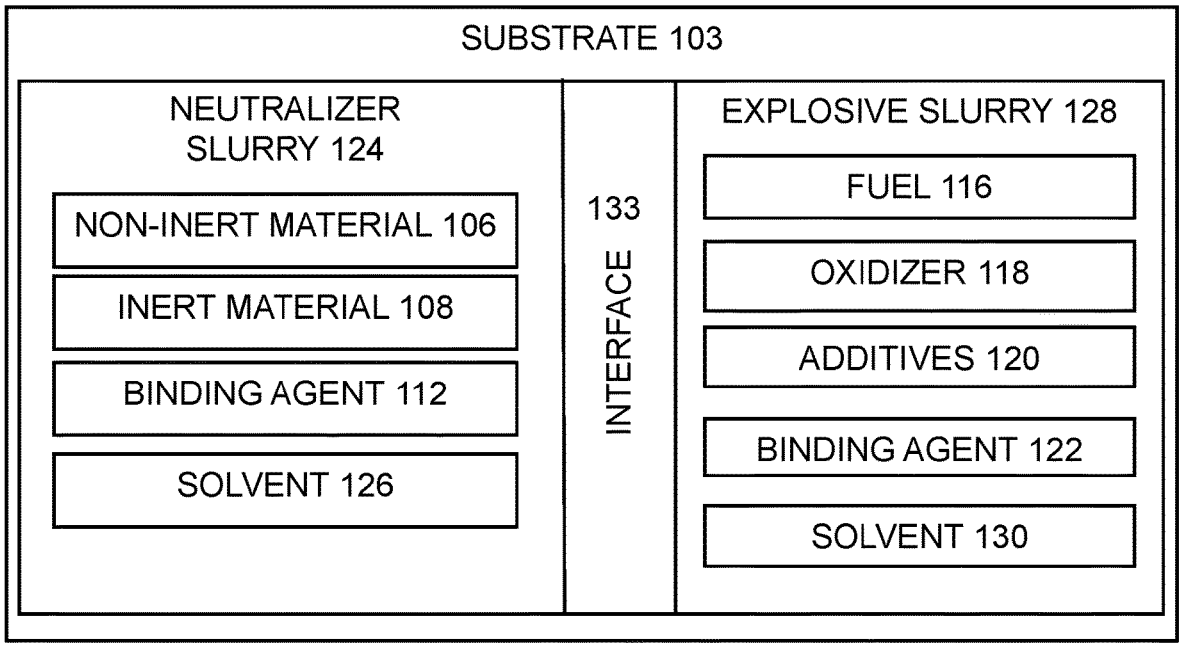
FIG. 1B is a schematic diagram of a portion of a pyrotechnic device in accordance with a preferred embodiment of this disclosure.

Referring to FIG. 1B, a substrate 103 may also be used to support various embodiments where a liquid binder is necessary. Neutralizer slurry 124 and explosive slurry 128 are formed on top of substrate 103. Interface 133 is an indiscernible boundary interface between neutralizer slurry 124 and explosive slurry 128. Neutralizer slurry 124 and explosive slurry 128 are positioned with or adjacent to each other and touch each other at interface 133.

Neutralizer slurry 124 is used to form concealed amalgamated neutralizer 104. Neutralizer slurry 124 includes non-inert material 106, inert material 108, and binding agent 112. Neutralizer slurry 124 also includes solvent 126. Once positioned with respect to substrate 103, neutralizer slurry 124 is allowed to solidify by withdrawal of solvent 126, e.g., via vaporization, to form concealed amalgamated neutralizer 104 as a solid or to give concealed amalgamated neutralizer 104 a more solid-like form.

Materials used as solvent 126 include methyl ethyl ketone (MEK), cellulose thinners, isopropanol, alcohol, water, hydrogen peroxide, liquefied petroleum gas (LPG), and liquid nitrogen. Solvent 126 dissolves the other components of neutralizer slurry 124 and allows neutralizer slurry 124 to be processed in a more liquid-like fashion as compared to concealed amalgamated neutralizer 104.

Explosive composition 114 is an explosive material, also known as a pyrotechnic composition, comprising one or more fuels 116, oxidizers 118, and additives 120, and binding agents 122. Fuels 116 and oxidizers 118 interact chemically to release energy, additives 120 add additional properties, and binding agents 122 bind explosive composition 114 together. Explosive composition 114 is formed from explosive slurry 128.

In alternative embodiments, explosive composition 114 is formed without being processed from explosive slurry 128. As an example, explosive composition 114 may be formed from a dry powder.

Materials used as fuel 116 include: metals, metal hydrides, metal carbides, metalloids, non-metallic inorganics, carbon based compounds, organic chemicals, and organic polymers and resins. Metal fuels include: aluminum, magnesium, magnalium, iron, steel, zirconium, titanium, ferrotitanium, ferrosilicon, manganese, zinc, copper, brass, tungsten, zirconium-nickel alloy. Metal hydride fuels include: titanium(II) hydride, zirconium(II) hydride, aluminum hydride, and decaborane. Metal carbides used as fuels include zirconium carbide. Metalloids used as fuels include: silicon, boron, and antimony. Non-metallic inorganic fuels include: sulfur, red phosphorus, white phosphorus, calcium silicide, antimony trisulfide, arsenic sulfide (realgar), phosphorus trisulfide, calcium phosphide, and potassium thiocyanate. Carbon based fuels include: carbon, charcoal, graphite, carbon black, asphaltum, and wood flour. Organic chemical fuels include: sodium benzoate, sodium salicylate, gallic acid, potassium picrate, terephthalic acid, hexamine, anthracene, naphthalene, lactose, dextrose, sucrose, sorbitol, dextrin, stearin, stearic acid, and hexachloroethane. Organic polymer and resin fuels include: fluoropolymers (such as Teflon and Viton), hydroxyl-terminated polybutadiene (HTPB), carboxyl-terminated polybutadiene (CTPB), polybutadiene acrylonitrile (PBAN), polysulfide, polyurethane, polyisobutylene, nitrocellulose, polyethylene, polyvinyl chloride, polyvinylidene chloride, shellac, and accroid resin (red gum).

Materials used as oxidizers 118 include: perchlorates, chlorates, nitrates, permanganates, chromates, oxides and peroxides, sulfates, organic chemicals, and others. Perchlorate oxidizers include: potassium perchlorate, ammonium perchlorate, and nitronium perchlorate. Chlorate oxidizers include: potassium chlorate, barium chlorate, and sodium chlorate. Nitrates include: potassium nitrate, sodium nitrate, calcium nitrate, ammonium nitrate, barium nitrate, strontium nitrate, and cesium nitrate. Permanganate oxidizers include: potassium permanganate and ammonium permanganate. Chromate oxidizers include: barium chromate, lead chromate, and potassium dichromate. Oxide and peroxide oxidizers include: barium peroxide, strontium peroxide, lead tetroxide, lead dioxide, bismuth trioxide, iron(II) oxide, iron(III) oxide, manganese(IV) oxide, chromium(III) oxide, and tin(IV) oxide. Sulfate oxidizers include: barium sulfate, calcium sulfate, potassium sulfate, sodium sulfate, and strontium sulfate. Organic oxidizers include: guanidine nitrate, hexanitroethane, cyclotrimethylene trinitramine, and cyclotetramethylene tetranitramine. Other oxidizers include: sulfur, Teflon, and boron.

Materials used as additives 120 include materials that act as: coolants, flame suppressants, opacifiers, colorants, chlorine donors, catalysts, stabilizers, anticaking agents, plasticizers, curing and crosslinking agents, and bonding agents. Coolants include: diatomaceous earth, alumina, silica, magnesium oxide, carbonates including strontium carbonate, and oximide. Flame suppressants include: potassium nitrate and potassium sulfate. Opacifiers include carbon black and graphite. Colorants include: salts of metals (including barium, strontium, calcium, sodium, and copper), copper metal, and copper acetoarsenite with potassium perchlorate. Chlorine donors include: polyvinyl chloride, polyvinylidene chloride, vinylidene chloride, chlorinated paraffins, chlorinated rubber, hexachloroethane, hexachlorobenzene, and other organochlorides and inorganic chlorides (e.g., ammonium chloride, mercurous chloride), as well as perchlorates and chlorates. Catalysts include: ammonium dichromate, iron(III) oxide, hydrated ferric oxide, manganese dioxide, potassium dichromate, copper chromite, lead salicylate, lead stearate, lead 2-ethylhexoate, copper salicylate, copper stearate, lithium fluoride, n-butyl ferrocene, di-n-butyl ferrocene. Stabilizers include: carbonates (e.g., sodium, calcium, or barium carbonate), alkaline materials, boric acid, organic nitrated amines (such as 2-nitrodiphenylamine), petroleum jelly, castor oil, linseed oil, ethyl centralite, and 2-nitrodiphenylamine. Anticaking agents include: fumed silica, graphite, and magnesium carbonate. Plasticizers: include dioctyl adipate, isodecyl pelargonate, and dioctyl phthalate as well as other energetic materials such as: nitroglycerine, butanetriol trinitrate, dinitrotoluene, trimethylolethane trinitrate, diethylene glycol dinitrate, triethylene glycol dinitrate, bis(2,2-dinitropropyl)formal, bis(2,2-dinitropropyl)acetal, 2,2,2-trinitroethyl 2-nitroxyethyl ether, and others. Curing and crosslinking agents include: paraquinone dioxime, toluene-2, 4-diisocyanate, tris(1-(2-methyl) aziridinyl) phosphine oxide, N,N,O-tri(1,2-epoxy propyl)-4-aminophenol, and isophorone diisocyanate. Bonding agents include tris(1-(2-methyl) azirinidyl) phosphine oxide and triethanolamine.

Materials used as binding agents 122 include: gums, resins and polymers, such as: acacia gum, red gum, guar gum, copal, cellulose, carboxymethyl cellulose, nitrocellulose, rice starch, cornstarch, shellac, dextrin, hydroxyl-terminated polybutadiene (HTPB), polybutadiene acrylonitrile (PBAN), polyethylene, and polyvinyl chloride (PVC).

Explosive slurry 128 is used to form explosive composition 114. Explosive slurry 128 includes fuel 116, oxidizer 118, additives 120, and binding agent 122. Explosive slurry 128 also includes solvent 130. Once positioned with respect to housing 102, explosive slurry 128 is allowed to solidify by withdrawal of solvent 130, e.g., via vaporization, to form explosive slurry 128 as a solid or to give explosive slurry 128 more solid-like form.

Materials used as solvent 130 include methyl ethyl ketone (MEK), cellulose thinners, isopropanol, alcohol, water, and hydrogen peroxide. Solvent 130 dissolves the other components of explosive slurry 128 and allows explosive slurry 128 to be processed in a more liquid-like fashion as compared to explosive composition 114.

Table 1 below shows typical components of dry granular explosive materials, dry neutralizer materials, coloring agents, and ratios required to neutralize the explosive materials in several preferred embodiments. The ratios indicated are by weight, but similar ratios may also be made by volume. The percentage composition of the explosive materials can vary by as much as plus or minus 15%. The percentage composition of the neutralizer materials can vary by as much as plus or minus 15%. The composition ratios can vary by as much as plus or minus 25%.

TABLE 1

| Dry Explosive Materials | Dry Neutralizer Materials | Coloring Agents | DEM:DIM (by weight) |
|---|---|---|---|
| 70% potassium chlorate<br>30% aluminum | 65% magnesium silicate<br>30% aluminum<br>5% accroid resin | Aluminum | 3:2 |
| 75% potassium nitrate<br>15% charcoal<br>10% sulfur | Silica | Carbon slurry | 3:1 |
| 70% potassium nitrate<br>14% charcoal<br>16% sulfur | Silica | Carbon slurry | 3:1 |
| 40% sodium nitrate<br>30% charcoal<br>30% sulfur | Chalk | Carbon black | 3:2 |
| 75% potassium nitrate<br>19% carbon<br>6% sulfur | Barium | Lamp black | 6:5 |

Table 2 below shows typical components of explosive materials, neutralizer materials, pigmentation, solvents, and ratios. The percentage composition of the explosive materials can vary by as much as plus or minus 15%. The percentage composition of the neutralizer materials can vary by as much as plus or minus 15%. The composition ratios can vary by as much as plus or minus 25%.

TABLE 2

| Explosive Materials | Neutralizer Materials | Pigmentation | Solvents | EM:IM:Sol (by weight) |
|---|---|---|---|---|
| 75% potassium nitrate<br>15% charcoal<br>10% sulfur | Silica | Carbon black | Alcohol | 3:1:1 |
| 70% potassium nitrate<br>14% charcoal<br>16% sulfur | Chalk | Lamp black | Water | 3:2:2 |
| 40% sodium nitrate<br>30% charcoal<br>30% sulfur | Barium | Aluminum pigment (ultramarine) | Isopropanol | 6:5:4 |
| 75% potassium nitrate<br>19% carbon<br>6% sulfur | Saw dust | Vine black | Liquid nitrogen | 11:9:9 |

Tables 3-5 below show typical components of neutralizers, solvents, pigments, and explosive compounds, any of which may be used in pyrotechnic devices in accordance with this disclosure. Table 3 below includes a list of neutralizers and solvents, any of which may be used in pyrotechnic devices.

TABLE 3

| Neutralizers | Solvents |
|---|---|
| Talcum | Methyl ethyl ketone (MEK) |
| Chaulk | Cellulose thinners |
| Barrium | Isopropanol |
| Manganese | Water |
| Aluminum | Alcohol |
| Silica | Hydrogen peroxide |
| Saw dust | Liquefied petroleum gas |
| Calcium carbonate | Liquid nitrogen |
| Barite | |
| Potters clay | |

Table 4 below shows a list of pigments, any of which may be used in pyrotechnic devices. A pigment that is used in portion 100 of pyrotechnic device may form part of non-inert material 106 or part of inert material 108, depending on the chemical composition of the pigment. When a pigment is used to tint concealed amalgamated neutralizer 104, a sufficient amount is used to coat and color the granules formed from non-inert material 106 and inert material 108 within concealed amalgamated neutralizer 104. The amount or proportion of pigment may vary depending on the grain size of the granules formed from non-inert material 106 and inert material 108 within concealed amalgamated neutralizer 104. The pigment may be introduced to concealed amalgamated neutralizer 104 in the form of a dye. Similarly, the granules of the inert materials may be washed with a pigment or dye for a time sufficient to change their color to approximate the color of the granules of the non-inert material. The grainsize of the pigmented inert material can be controlled by sifting with an appropriate wire mesh or other method as known in the art. The mesh size is chosen to approximate the size of the non-inert material.

TABLE 4

| Pigments |
|---|
| Aluminum pigments: ultramarine violet, ultramarine |
| Antimony pigments: antimony white |

TABLE 4-continued

| Pigments |
|---|
| Arsenic pigments: orpiment natural monoclinic arsenic sulfide ($AS_2S_3$) |
| Barium pigments: barium sulfate |
| Biological pigments: alizarin, alizarin crimson, gamboge, cochineal red, rose madder, indigo, Indian yellow, Tyrian purple |
| Cadmium pigments: cadmium yellow, cadmium red, cadmium green, cadmium orange, cadmium sulfoselenide (CdSe) |
| Carbon pigments: carbon black, ivory black (bone char), vine black, lamp black, India ink |
| Chromium pigments: chrome green, viridian, chrome yellow, chrome orange |
| Clay earth pigments (iron oxides): yellow ochre, raw sienna, burnt sienna, raw umber, burnt umber |
| Cobalt pigments: cobalt violet, cobalt blue, cerulean blue, aureolin (cobalt yellow) |
| Copper pigments: Azurite, Han purple, Han blue, Egyptian blue, Malachite, Paris green, Scheele's Green, Phthalocyanine Blue BN, Phthalocyanine Green G, verdigris, viridian |
| Iron pigments: Prussian blue, yellow ochre, iron black |
| Iron oxide pigments: sanguine, caput mortuum, oxide red, red ochre, Venetian red, burnt sienna |
| Lead pigments: lead white, cremnitz white, Naples yellow, red lead |
| Manganese pigments: manganese violet |
| Mercury pigments: vermilion |
| Organic pigments: quinacridone, magenta, phthalo green, phthalo blue, pigment red 170, diarylide yellow |
| Tin pigments: mosaic gold |
| Titanium pigments: titanium yellow, titanium beige, titanium white, titanium black |
| Ultramarine pigments: ultramarine, ultramarine green shade |
| Zinc pigments: zinc white, zinc ferrite |
| India ink |

Table 5 below shows typical explosive compounds, any of which may be used in pyrotechnic devices in accordance with this disclosure. Table 5 includes the following acronyms (among others): trinitrotoluene (TNT), ammonium nitrate (AN), ammonium nitrate fuel oil (ANFO), triethylenetetramine (TETA), nitromethane (NM), penthrite (PETN), research department explosive (RDX), erythritol tetranitrate (ETN), high-velocity military explosive (HMX), polyurethane (PU), polycaprolactone (PCP), trimethylolethane trinitrate (TMETN), hydroxyl-terminated polybutadiene (HTPB), alkyl acrylate copolymer (ACM), dioctyl adipate (DOA), ammonium perchlorate (AP), nitrocellulose (NC), and isopropyl nitrate (IPN).

TABLE 5

| Explosive compounds |
|---|
| Aluminum powder (30%) + Potassium chlorate (70%) |
| Amatol (50% TNT + 50% AN) |
| Amatol (80% TNT + 20% AN) |
| Ammonium nitrate (AN + <0.5% $H_2O$) |
| ANFO (94% AN + 6% fuel oil) |
| ANNMAL (66% AN + 25% NM + 5% Al + 3% C + 1% TETA) |
| Black powder (75% $KNO_3$ + 19% C + 6% S) |
| Blasting powder |
| Chopin's Composition (10% PETN + 15% RDX + 72% ETN) |
| Composition A-5 (98% RDX + 2% stearic acid) |
| Composition B (63% RDX + 36% TNT + 1% wax) |
| Composition C-3 (78% RDX) |
| Composition C-4 (91% RDX) |
| DADNE (1,1-diamino-2,2-dinitroethene, FOX-7) |
| DDF (4,4'-Dinitro-3,3'-diazenofuroxan) |
| Diethylene glycol dinitrate (DEGDN) |
| Dinitrobenzene (DNB) |
| Erythritol tetranitrate (ETN) |
| Ethylene glycol dinitrate (EGDN) |
| Flash powder |
| Gelatine (92% NG + 7% nitrocellulose) |
| Heptanitrocubane (HNC) |
| Hexamine dinitrate (HDN) |

TABLE 5-continued

| Explosive compounds |
|---|
| Hexanitrobenzene (HNB) |
| Hexanitrostilbene (HNS) |
| Hexogen (RDX) |
| HMTD (hexamine peroxide) |
| HNIW (CL-20) |
| Hydrazine mononitrate |
| Hydromite ® 600 (AN water emulsion) |
| MEDINA (Methylene dinitroamine) |
| Mixture: 24% nitrobenzene + 76% TNM |
| Mixture: 30% nitrobenzene + 70% nitrogen tetroxide |
| Nitrocellulose (13.5% N, NC) |
| Nitroglycerin (NG) |
| Nitroguanidine |
| Nitromethane (NM) |
| Nitrourea |
| Nobel's Dynamite (75% NG + 23% diatomite) |
| Nitrotriazolon (NTO) |
| Octanitrocubane (ONC) |
| Octogen (HMX grade B) |
| Octol (80% HMX + 19% TNT + 1% DNT) |
| PBXIH-135 EB (42% HMX, 33% Al, 25% PCP-TMETN's system) |
| PBXN-109 (64% RDX, 20% Al, 16% HTPB's system) |
| PBXW-11 (96% HMX, 1% ACM, 3% DOA) |
| PBXW-126 (22% NTO, 20% RDX, 20% AP, 26% Al, 12% PU's system) |
| Penthrite (PETN) |
| Pentolite (56% PETN + 44% TNT) |
| Picric acid (TNP) |
| Plastics Gel ® (45% PETN + 45% NG + 5% DEGDN + 4% NC) |
| RISAL P (50% IPN + 28% RDX + 15% Al + 4% Mg + 1% Zr + 2% NC) |
| Semtex 1A (76% PETN + 6% RDX) |
| Tanerit Simply ® (93% granulated AN + 6% red P + 1% C) |
| acetone peroxide (TATP) |
| Tetryl |
| Tetrytol (70% tetryl + 30% TNT) |
| trinitroazetidine (TNAZ) |
| Torpex (aka HBX, 41% RDX + 40% TNT + 18% Al + 1% wax) |
| Triaminotrinitrobenzene (TATB) |
| Trinitrobenzene (TNB) |
| Trinitrotoluene (TNT) |
| Tritonal (80% TNT + 20% aluminium) |

Figure 2A:
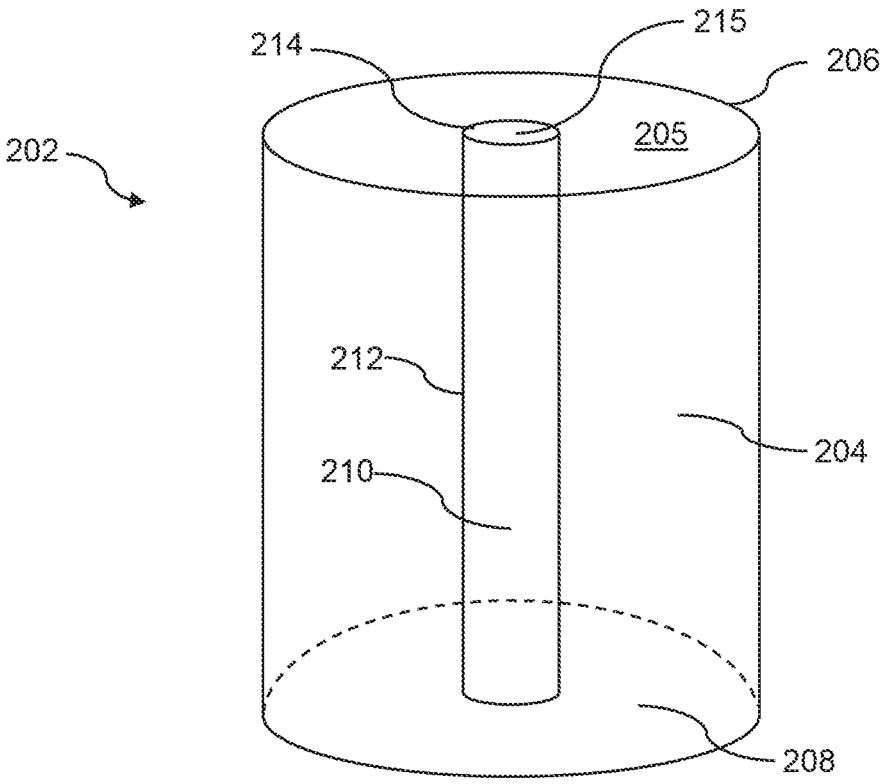
FIG. 2A is an isometric view of a tube within a tube build container.

Referring to FIG. 2A, build container 202 is shown. Build container 202 is a generally hollow cylinder having sidewall 204, open end 206, and closed end 208 defining interior space 205. In one embodiment, number 20 cardboard is used to form the ends and walls. Other structural materials such as mylar or vinyl will suffice. Build container 202 is used in a preferred method of assembling generally cylindrical shaped devices containing various combinations of dry compositions of explosive and neutralizer materials, as will be further described. Inner tube 210 is removably affixed within the interior of build container 202 by means common in the art, such as a suitably releasable adhesive. In the preferred embodiment, inner tube 210 is located co-axially with build container 202, however inner tube 210 may be positioned anywhere within interior 205. Although a single inner tube is depicted within build container 202, it will be understood that a plurality of inner tubes may be installed inside build container 202. Inner tube 210 has an exterior cylindrical shaped surface 212 and an open end 214 defining interior space 215. Neutralizer material is loaded into interior space 215, which is inside of interior space 205, and the explosive material is loaded into interior space 205 outside of interior space 215. Those skilled in the art will understand that shapes other than cylindrical may be used for inner tube 210 and/or build container 202 such as elliptical, rectangular, and triangular. It is further understood that the size of inner tube 210 relative to build container 202 can be changed depending on the ratio of neutralizer material to explosive material required to properly render the explosive material useless. Additionally, the overall volume of the assembled device may vary depending on intended use of the device.

It should be understood that the positions of the explosive and neutralizer materials could be reversed so that explosive material is loaded into interior space 215, which is inside of interior space 205, and the neutralizer material is loaded into interior space 205 outside of interior space 215. Furthermore, the relative dimensions of the build container and the inner tube organize functions of the ratio of explosive and neutralizer materials.

Figure 2B:
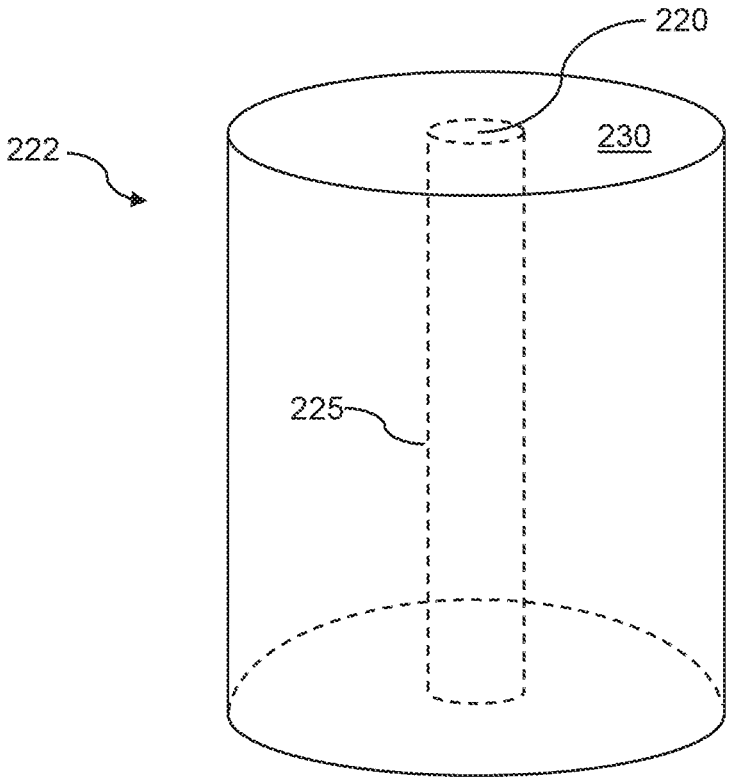
FIG. 2B is an isometric view of a preferred embodiment in cylindrical form.

FIG. 2B shows an assembled device 222 containing neutralizer material 220 and explosive material 230 separated by a boundary interface 225. Neutralizer material 220 is comprised of components that match explosive material 230 such that neutralizer material 220 is indiscernible from explosive material 230. Neutralizer material 220 is chosen to approximate the grain size and color of explosive material 230. Boundary interface 225 is where explosive material 230 contacts neutralizer material 220 within assembled device 222. Since neutralizer material 220 is indiscernible from explosive material 230, boundary interface 225 is not visible.

Figure 3A:
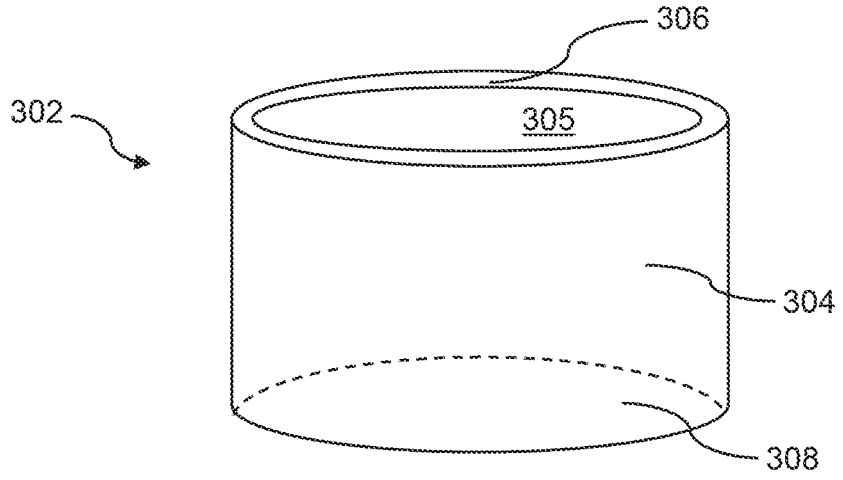
FIG. 3A is an isometric view of a cylindrical layered build container.

Referring to FIG. 3A, alternate build container 302 is shown. Build container 302 is a generally hollow cylinder having sidewall 304, open end 306, and closed end 308 defining interior space 305. Build container 302 is used for assembling generally disc shaped, layered devices.

Figure 3B:
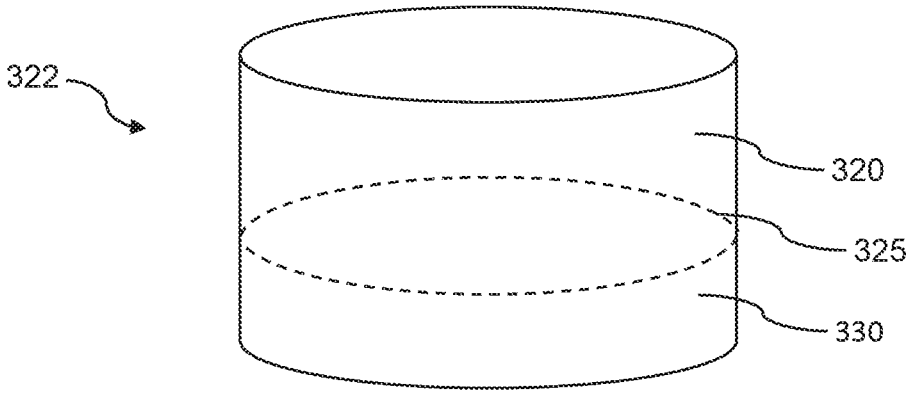
FIG. 3B is an isometric view of a preferred embodiment in layered form.

FIG. 3B shows an assembled device 322 made from build container 302 in which dry manufacture neutralizer material 320 is layered on top of explosive material 330. In an alternate embodiment, explosive material 330 is layered on top of neutralizer material 320. Explosive material 330 is separated from neutralizer material 320 by boundary interface 325.

Figure 4A:
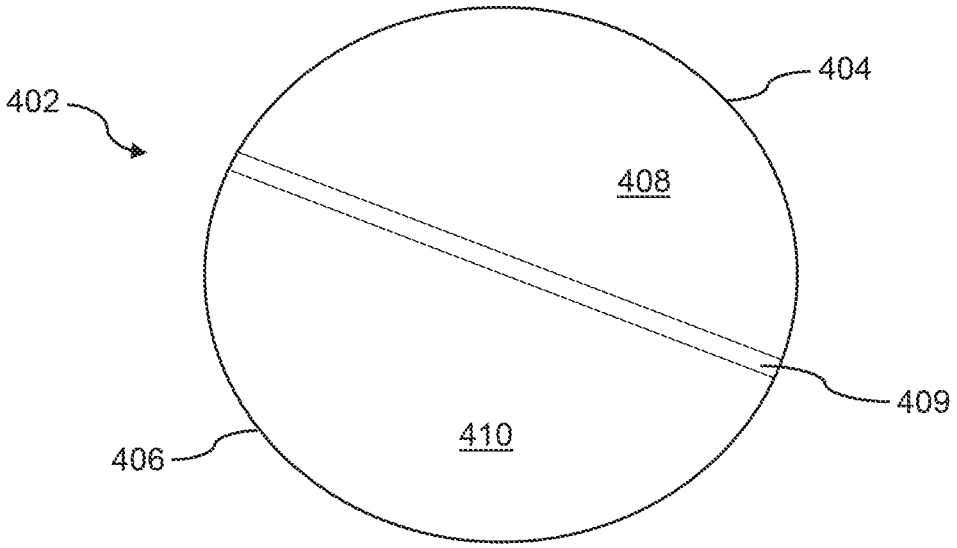
FIG. 4A is a section plan view of spherical side by side build container.

FIG. 4A shows an alternate build container 402. Build container 402 is comprised of two hollow, semi-spherical halves 404 and 406. Half 404 defines interior space 408 and half 406 defines interior space 410. A disk shaped separation barrier 409 may be affixed to either half 404 or 406 to contain the explosive material and neutralizer material during assembly.

Figure 4B:
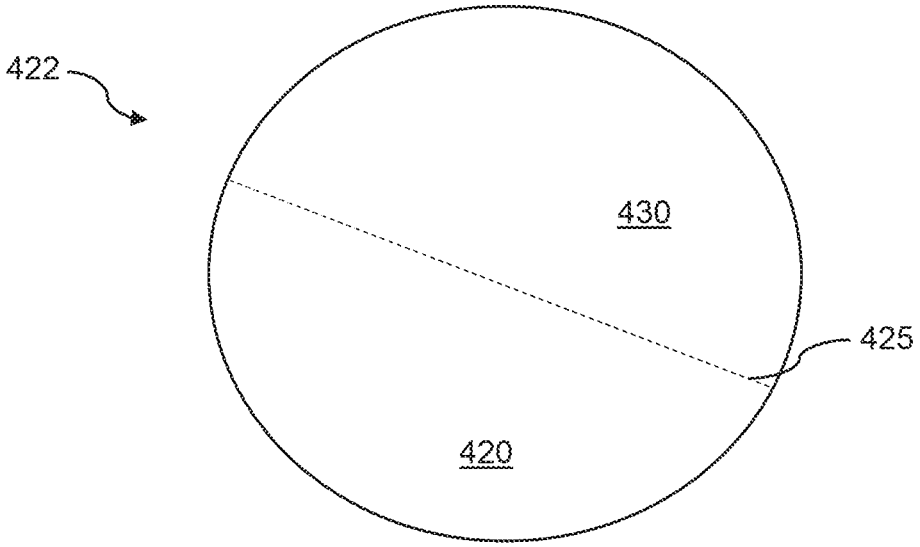
FIG. 4B is a section plan view of a preferred embodiment in spherical form.

FIG. 4B shows an assembled device 422 made from build container 402. Explosive material 430 is separated from neutralizer material 420 by boundary interface 425. Boundary interface 425 is imperceptible upon visual inspection.

Figure 4C:
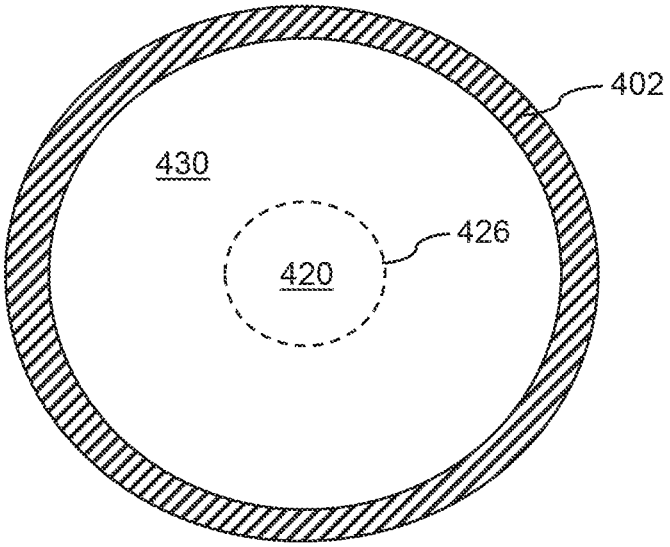
FIG. 4C is a section plan view of a spherical build container with a preferred embodiment in spherical form.

In an alternate spherical arrangement shown in FIG. 4C, build container 402 is used to create a spherical shaped device comprised of a spherical core surrounded by a larger sphere. Explosive material 430 is a hollow sphere shape including a spherical shaped core of neutralizer material 420. It should be understood by those skilled in the art that an arrangement of neutralizer material surrounding explosive material would be equally effective. Imperceptible boundary interface 426 is provided between explosive material 430 and neutralizer material 420.

For simplicity in FIGS. 1-4, detonators, primers, fuses, igniters, casings, plugs, etc. are not shown as each device may require different combinations of these elements typically found in various consumer fireworks, ammunition, and other pyrotechnic products. Some devices use other sources of ignition such as heat or impact.

Figure 5:
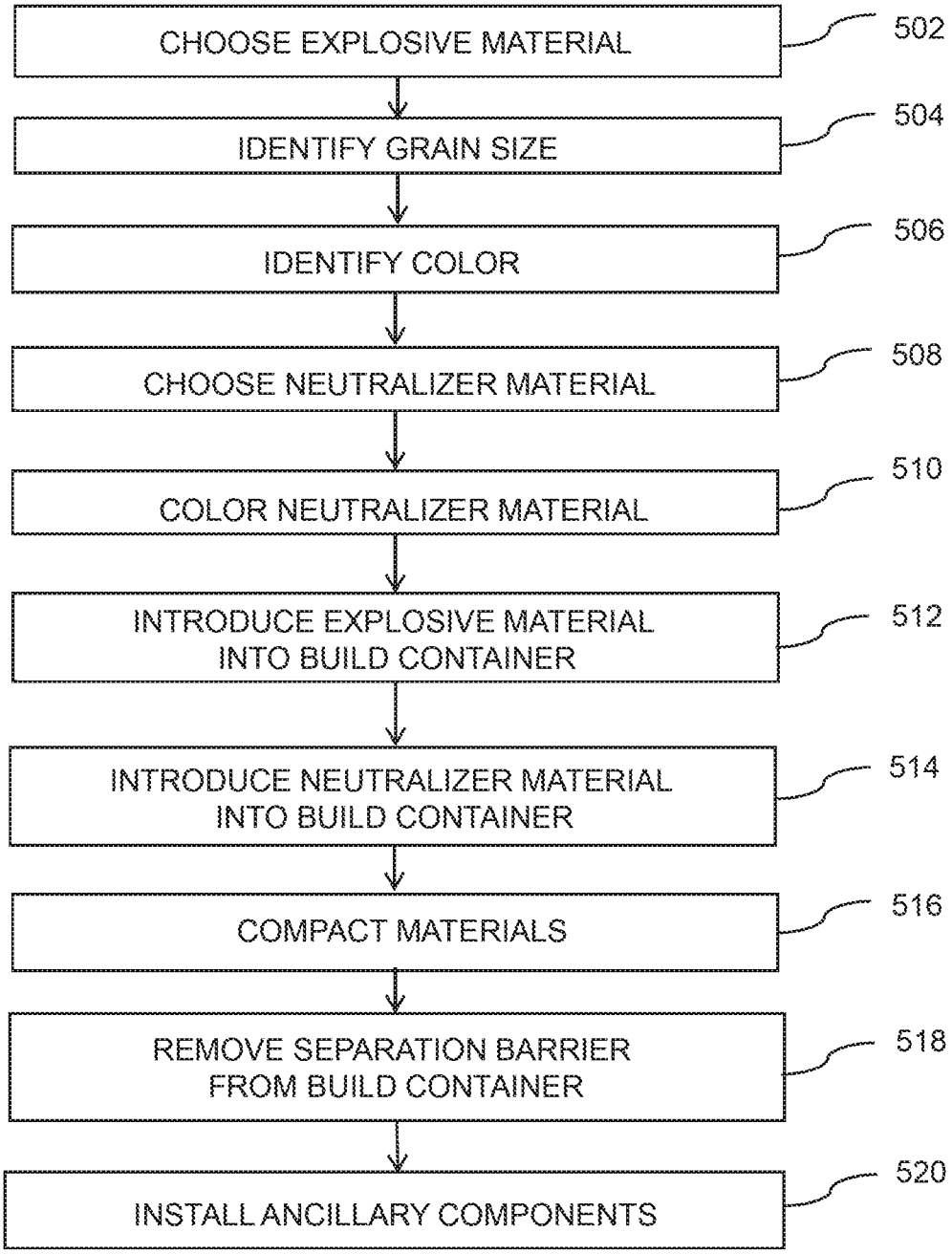
FIG. 5 is a flow chart of steps required with assembly of a preferred embodiment of this disclosure.

Referring to FIG. 5, the steps involved with constructing a device using generally dry materials are shown. At step 502, an explosive material is chosen. The proper explosive material will be chosen based on its intended use. At step 504 the grain size of the explosive material is identified. If the explosive material contains multiple components each having different grains sizes, each grain size will be identified. At step 506, the color of the explosive material is identified. At step 508, a matching neutralizer material with the identified grain size is chosen. The neutralizer material and the level of neutralization desired are chosen according to Table 1 for dry materials or Table 2 for slurries. At step 510, if the color of the neutralizer material does not match the explosive material, then the neutralizer material is colored using a pigment or dye to match the explosive material. In a different embodiment, a charcoal dye is employed to tint the neutralizer material. At step 512, the explosive material is introduced into a build container. At step 514, the neutralizer material is introduced into the build container, and if necessary, the build container is assembled. If necessary, at step 516, the materials introduced in the build container are compacted. At step 518, the separation barrier is removed from the build container. At step 520, any ancillary components required for the device, such as plugs, primers, fuses, detonators, etc., are installed and the assembled device is wrapped in appropriate casing.

Figure 6:
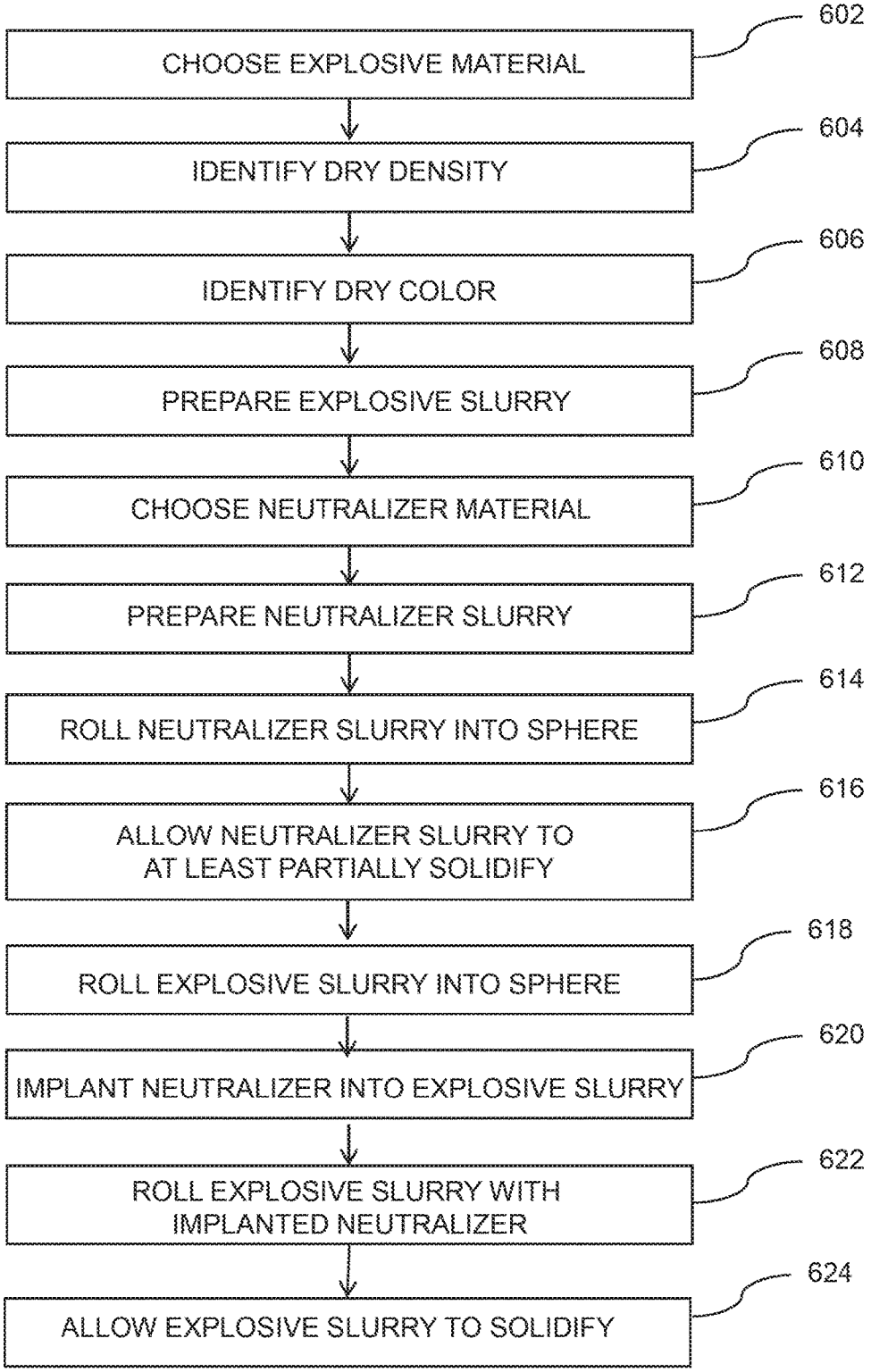
FIG. 6 is a flow chart of steps to build a spherical pyrotechnic device in accordance with a preferred embodiment of this disclosure.

Referring to FIG. 6, one or more steps involved with constructing a spherical pyrotechnic device using generally inert materials are shown. At step 602, an explosive material is chosen. The proper explosive material will be chosen based on its intended use. At step 604, the dry density of the explosive material is identified. At step 606, the color of the dried explosive material is identified. At step 608, a slurry is prepared from the explosive material and the appropriate solvent or liquid. At step 610, the neutralizer material with the identified dry density is chosen. At step 612, a neutralizer slurry is prepared using the neutralizer material and proper pigmentation and solvent.

At step 614, the neutralizer slurry is rolled into a sphere. In a preferred embodiment, the neutralizer slurry is rolled into a sphere through the use of a scoop. In one preferred embodiment, a scoop is used which is part number ZEROLL 1020 available from Centinal Restaurant Products of Indianapolis, Ind.

At step 616, the neutralizer slurry is optionally allowed to at least partially solidify so that the sphere of the neutralizer slurry will maintain its geometry during subsequent processing. At step 618, the explosive slurry is rolled into a sphere such that the volume of the sphere of the neutralizer slurry and the volume of the sphere of the explosive slurry forms a selected ratio, e.g., 2:3 or about 40% to about 60%.

At step 620, the sphere of neutralizer slurry is implanted into the sphere of the explosive slurry. The sphere of neutralizer slurry is implanted into substantially the center of the sphere of the explosive slurry to create a substantially uniform spherical explosive profile. In other embodiments, the shape and position of the neutralizer slurry within the sphere of explosive slurry is selected to create a non-uniform explosive profile that is not spherical.

At step 622, the volume of explosive slurry into which the sphere of neutralizer slurry was implanted is rolled again to reform a spherical shape. At step 624, the explosive slurry is allowed to solidify and, if it is not already solidified, the neutralizer slurry within the sphere of explosive slurry is also optionally allowed to solidify and dry. The sphere comprising the solidified explosive slurry and the neutralizer slurry may then be used to form a pyrotechnic device.

Figure 7:
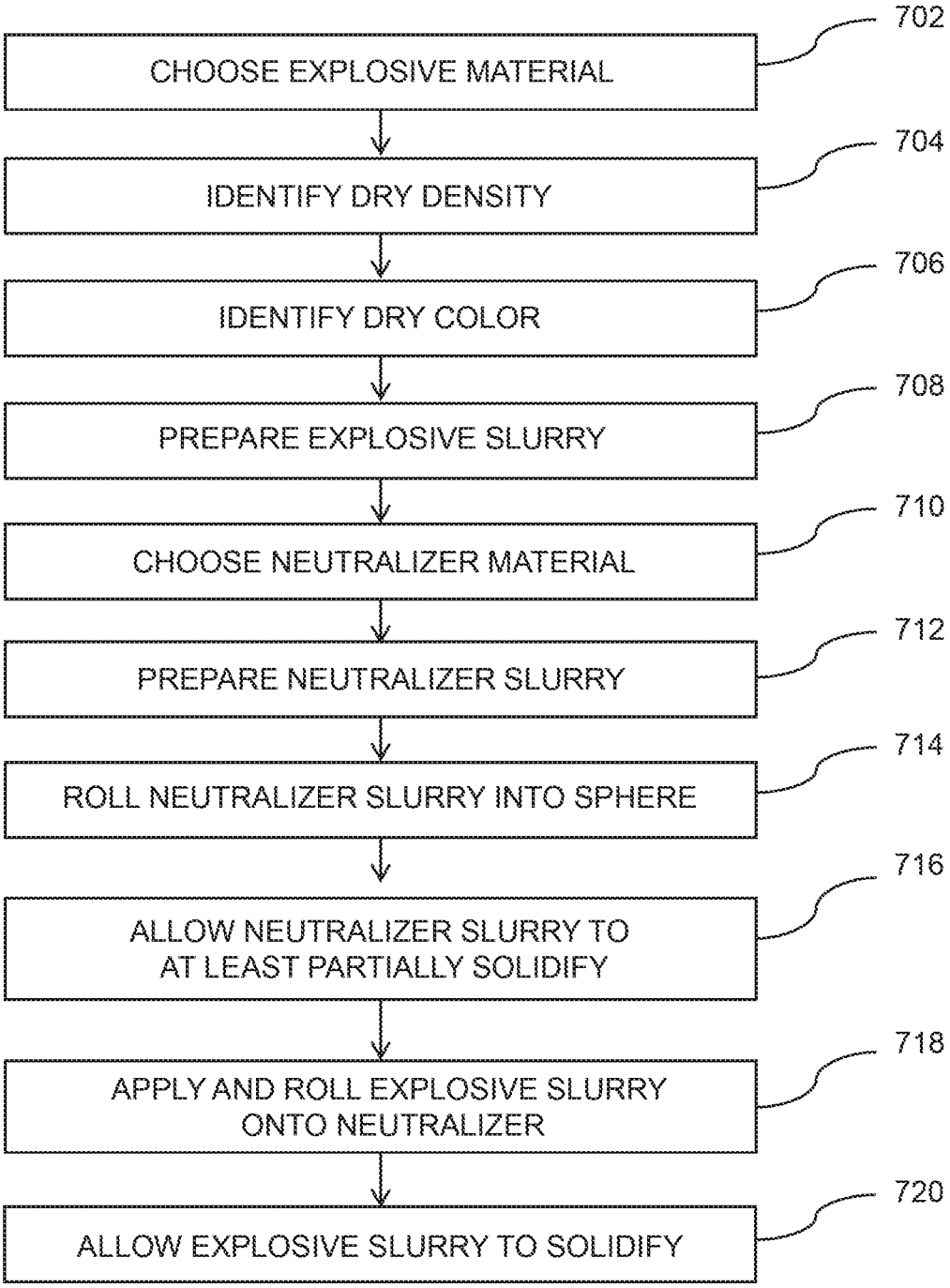
FIG. 7 is a flow chart of steps to build a spherical pyrotechnic device in accordance with a preferred embodiment of this disclosure.

Referring to FIG. 7, one or more steps involved with constructing a preferred device is shown. At step 702, an explosive material is chosen. The proper explosive material will be chosen based on its intended use. At step 704, the dry density of the explosive material is identified. At step 706, the color of the dried explosive material is identified. At step 708, a slurry is prepared from the explosive material and the appropriate solvent or liquid. At step 710, the neutralizer material with the identified dry density is chosen. At step 712, a neutralizer slurry is prepared using the neutralizer material and proper pigmentation and solvent. At step 714, the neutralizer slurry is rolled into a sphere. At step 716, the neutralizer slurry is optionally allowed to at least partially solidify so that the sphere of the neutralizer slurry will maintain its geometry during subsequent processing. At step 718, explosive slurry is applied and rolled onto the sphere of partially solidified neutralizer slurry. At step 720, the explosive slurry is allowed to solidify and, if it is not already solidified, the neutralizer slurry within the sphere of explosive slurry is also optionally allowed to solidify and dry. The sphere comprising the solidified explosive slurry and the neutralizer slurry may then be used to form a pyrotechnical device.

Figure 8A:
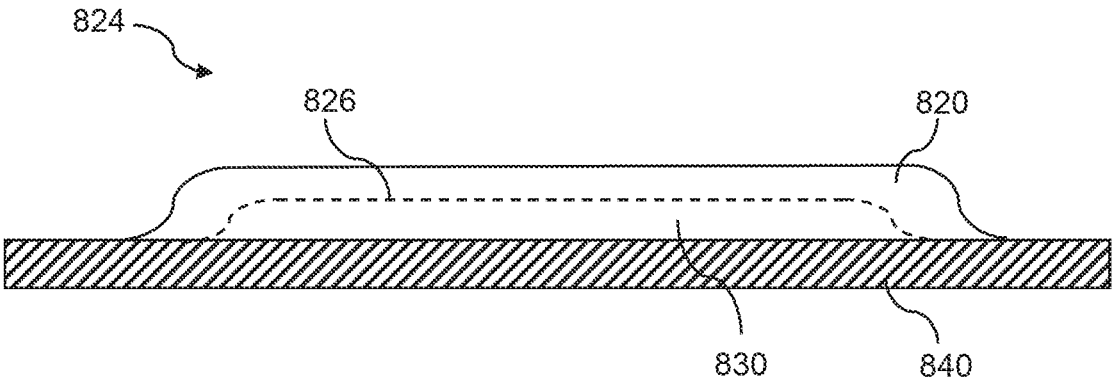
FIG. 8A is a section plan view of an alternate embodiment resulting from liquid materials.

FIG. 8A shows an alternate embodiment of device 824 constructed on substrate 840. Substrate 840 is preferably paper, but may also take the form of other planar surfaces or objects. Explosive material 830 is adhered to substrate 840. Neutralizer material 820 is adhered to both explosive material 830 and substrate 840 thereby encapsulating the explosive material and forming boundary interface 826. Device 824 is manufactured from slurry compositions of explosive materials and neutralizer materials as will be further described.

The thickness of explosive material 830 on substrate 840 is substantially uniform along the surface of substrate 840, except at the outer edges. The thickness of neutralizer material 820 on explosive material 830 and on substrate 840 is also substantially uniform, except at the outer edges. In alternative embodiments, the thicknesses may vary. For example, when device 824 embodies a target training dummy, a thickness of explosive material 830 at substantially the center of the target training dummy may be increased and a thickness of neutralizer material 820 may be reduced to retain a similar overall thickness. In this manner, a different pyrotechnic and visual effect is achieved so that a hit substantially in the center of the target training dummy is distinguishable from a hit that is not substantially in the center of the target training dummy.

Figure 8B:
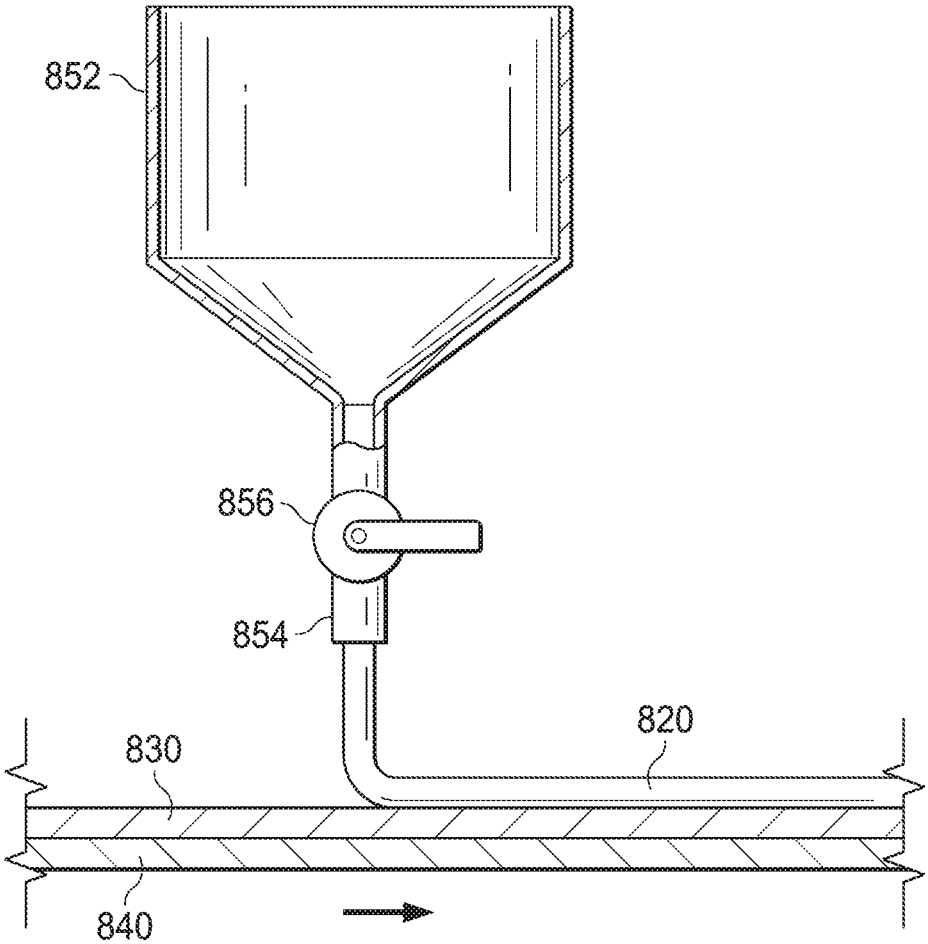
FIG. 8B is a section plan view of an alternate embodiment for deploying liquid materials.

FIG. 8B shows an alternate embodiment of device 824 as a layer of neutralizer material 820 is being applied to explosive material 830. Neutralizer material 820 is prepared in tank or hopper 852 and then applied to explosive material 830 on substrate 840. Tank or hopper 852 includes an outlet 854 and a valve 856 at the underside of tank or hopper 852, and outlet 854 is controlled by a valve 856. The valve 856 can be adjusted to control the volume of the neutralizer slurry dispensed. One of the tank or hopper 852 or the substrate 840 is moved in a direction so that a controlled amount of neutralizer material 820 is applied to explosive material 830. In a preferred embodiment, the thickness of neutralizer material 820 is substantially the same as the thickness of explosive material 830. In alternative embodiments, the thicknesses of neutralizer material 820 and explosive material 830 may vary.

Figure 9:
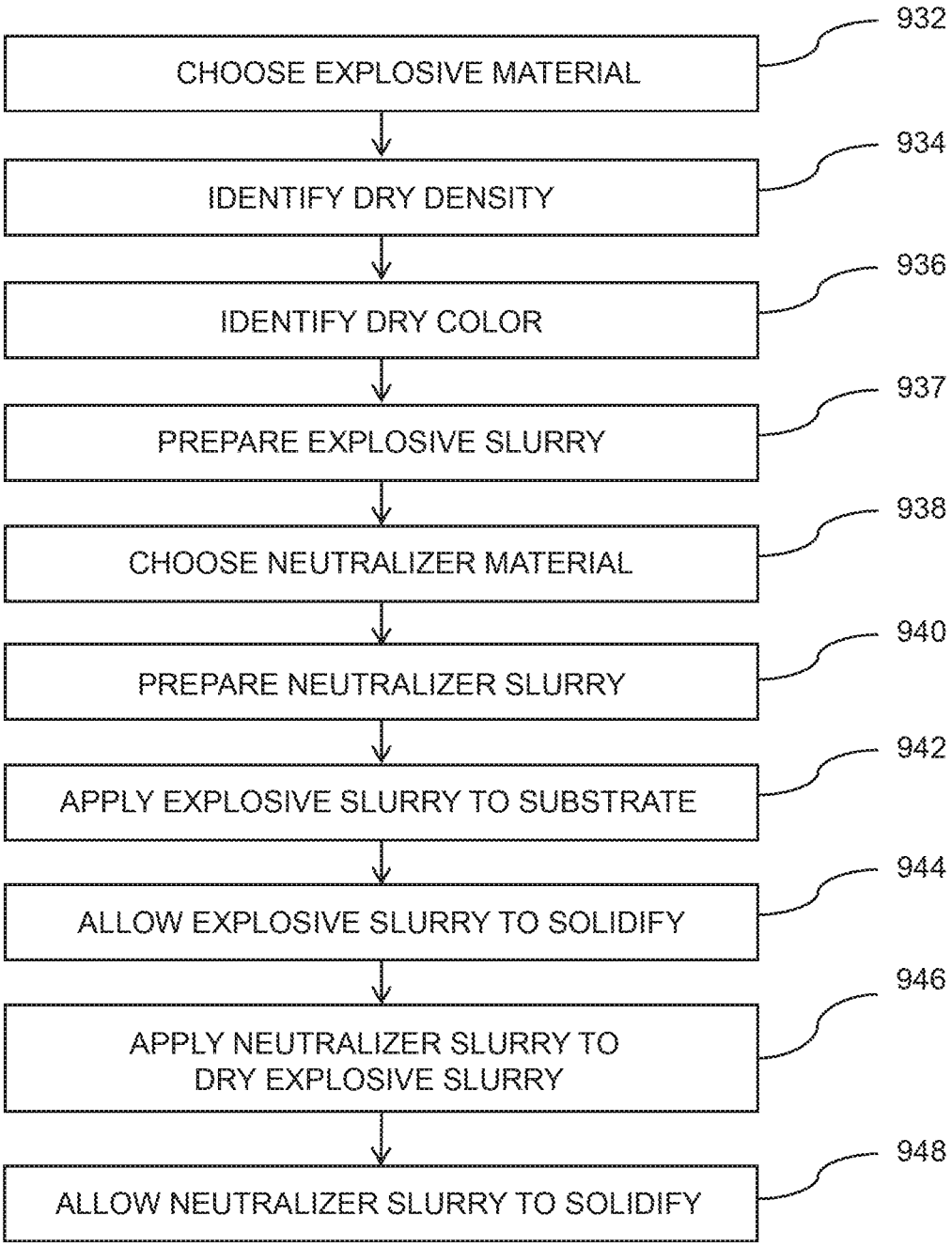
FIG. 9 is a flow chart of steps required for assembly of a preferred embodiment.

Referring to FIG. 9, the steps involved with constructing a preferred device is shown. At step 932, an explosive material is chosen. The proper explosive material will be chosen based on its intended use. At step 934, the dry density of the explosive material is identified. At step 936, the color of the dried explosive material is identified. At step 937, a slurry is prepared from the explosive material and the appropriate solvent or liquid. At step 938, the neutralizer material with the identified dry density and dry color is chosen. The neutralizer material is selected from Table 3.

At step 940, a neutralizer slurry is prepared using the neutralizer material, proper pigmentation and solvent. In a preferred embodiment, the neutralizer slurry is an embodiment of neutralizer slurry 124 of FIGS. 1B and 1*s* prepared by placing all of the ingredients or components of neutralizer slurry into a tank or hopper in which the ingredients or components are mixed.

At step 942, the explosive slurry is applied to the substrate. At step 944, the explosive slurry is allowed to solidify and dry.

At step 946, the neutralizer slurry is applied to the dried explosive slurry and the substrate. In a preferred embodiment, the underside of a tank or hopper, such as tank or hopper 852 of FIG. 8B, in which the neutralizer slurry was prepared includes an outlet, such as outlet 854, controlled by a valve, such as valve 856. The valve can be adjusted to control the volume of the neutralizer slurry dispensed. The valve is placed over the article on which neutralizer slurry 820 is to be applied. For example, the article may comprise substrate 840 and explosive material 830 of FIGS. 8A and 8B. After placement of the valve, the valve is actuated to dispense a selected amount of the neutralizer slurry onto the article to achieve a desired ratio between the amount of neutralizer slurry and the amount of explosive slurry on the article.

At step 948, the neutralizer slurry is allowed to solidify and dry.

Figure 10:
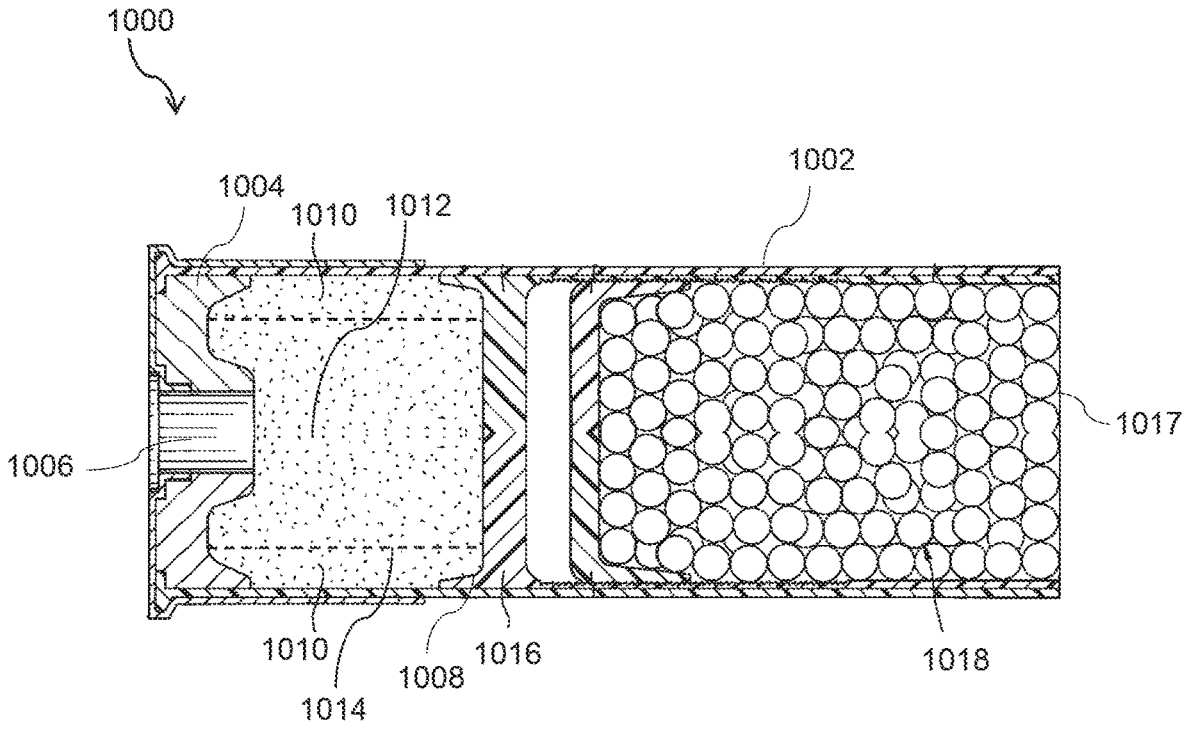
FIG. 10 is a section plan view of an article of manufacture including a preferred embodiment of this disclosure.

In one preferred embodiment, an article of manufacture, in this case a shotgun shell, is produced according to this disclosure. Referring to FIG. 10, an article of manufacture, shotgun shell 1000, is shown. Shotgun shell 1000 includes casing 1002 enclosed on one end by base 1004. Primer 1006 extends through base 1004 and is positioned adjacent generally cylindrically shaped concealed amalgamated device 1008. Concealed amalgamated device 1008 is comprised of neutralizer material 1010 separated from explosive material 1012 by boundary interface 1014. Adjacent the explosive material and neutralizer material is wad 1016. Shot 1018 is shown adjacent wad 1016. Crimped closure 1017 is shown opposite base 1004.

Figure 11:
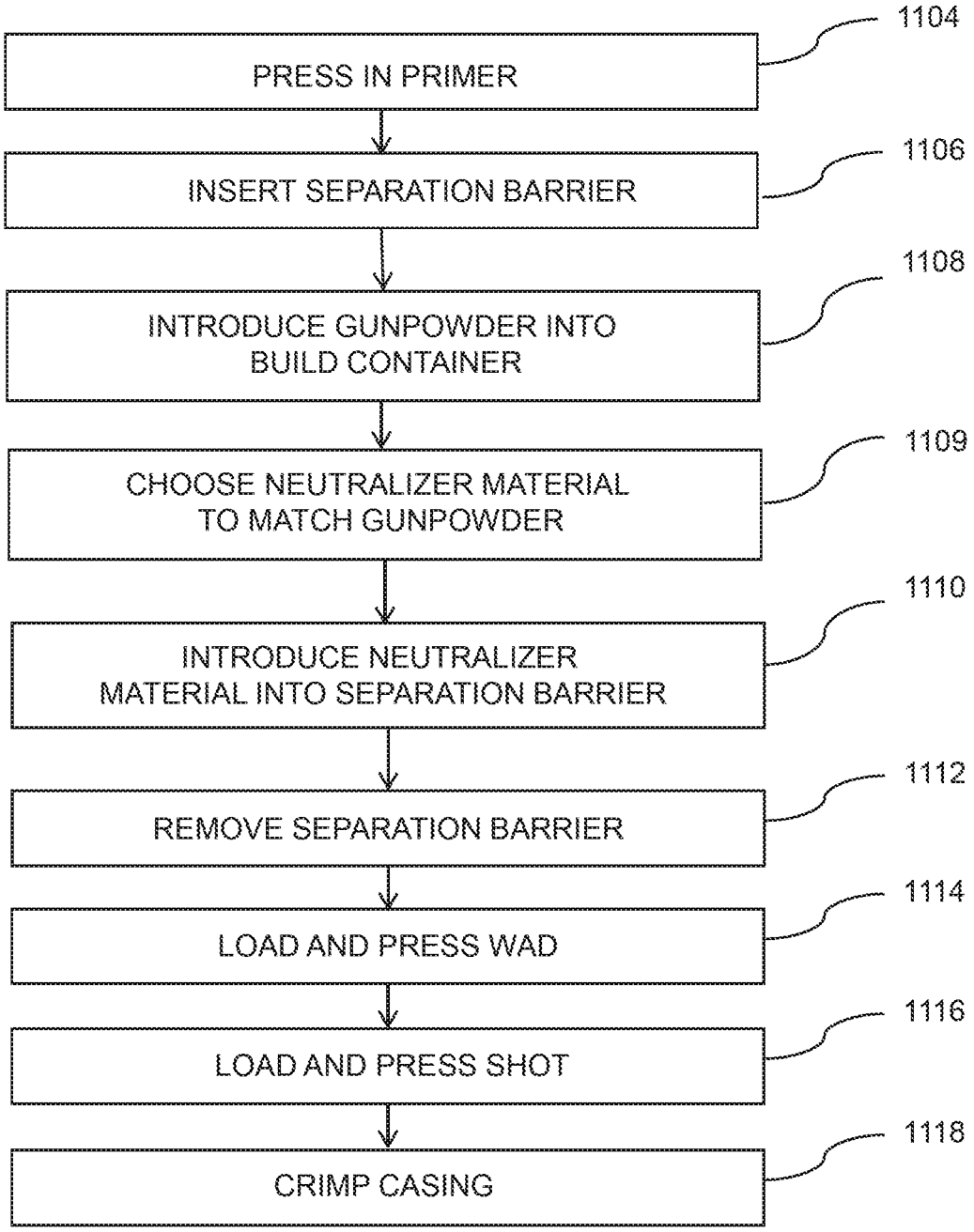
FIG. 11 is a flow chart of steps for assembly of an article of manufacture including a preferred embodiment of this disclosure.

Referring to FIG. 11, a flowchart showing the steps involved in loading a shotgun shell casing incorporating a preferred embodiment of the device. At step 1104, the primer is pressed into the base. A separation barrier in the form of a cylindrical Mylar tube is placed in the casing adjacent the base at step 1106. In a preferred embodiment, the tube is located coaxially with the primer. At step 1108, gunpowder is loaded into the casing within the interior of the separation barrier. At step 1109, the neutralizer material is chosen to match the color and grain size of the gunpowder. Choice of the neutralizer material includes the optional selection of a pigment or dye used to match the color of the neutralizer material to the color of the gunpowder. At step 1110, the neutralizer material is loaded into the casing surrounding the separation barrier. At step 1112, the separation barrier is removed. At step 1114, a wad is loaded and pressed within the casing. At step 1116, shot is loaded and pressed into the casing. At step 1118, the casing is crimped closed.

In use, should the shotgun shell be disassembled, the neutralizer material is automatically and undetectably mixed with the explosive material. Since the neutralizer material cannot be easily separated from the explosive material, the mixture effectively cannot be used to form an improvised explosive device.

Figure 12:
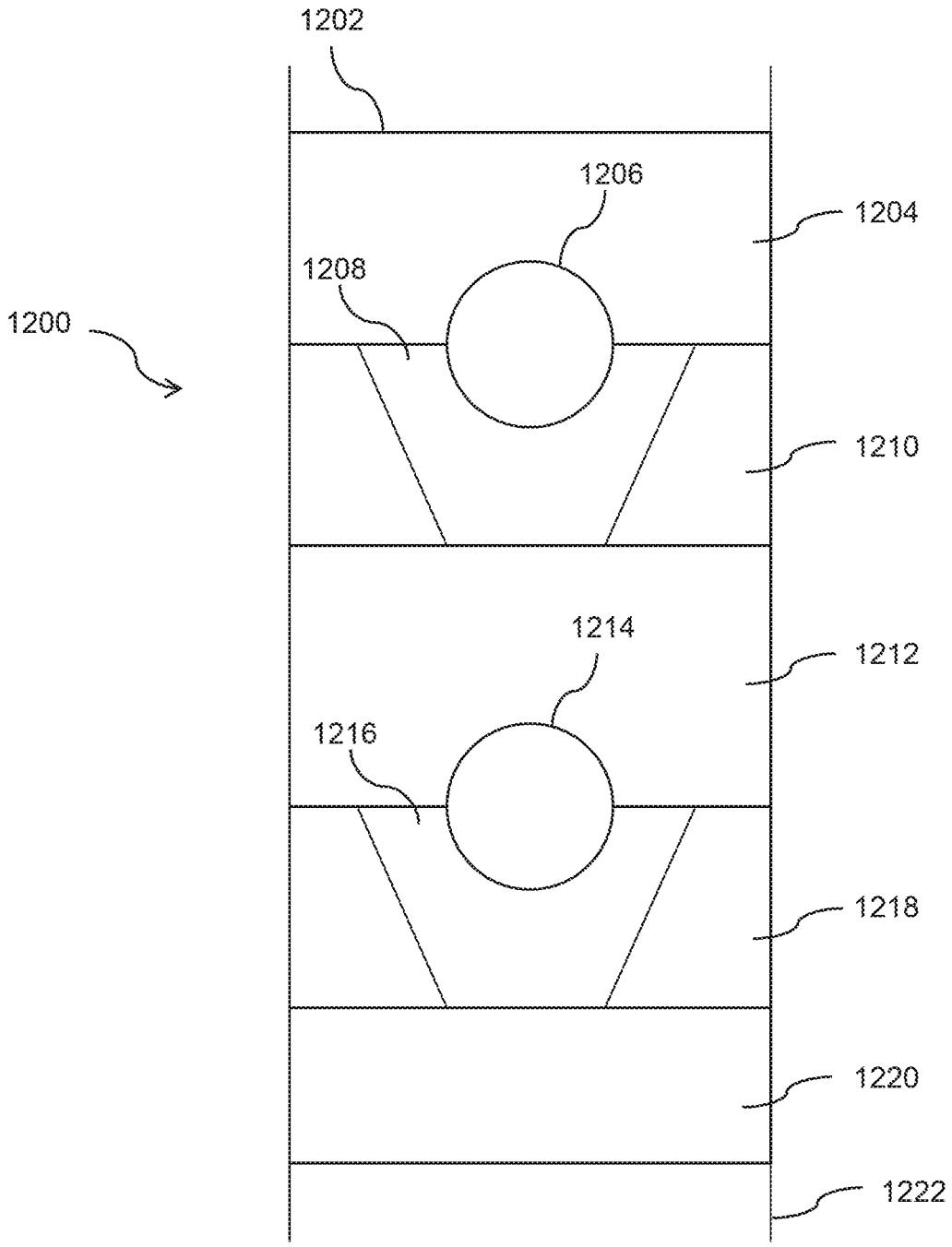
FIG. 12 is a section plan view of a Roman candle in accordance with a preferred embodiment of this disclosure.

In one preferred embodiment, an article of manufacture, in this case a pyrotechnic device commonly referred to as a Roman candle, is produced according to this disclosure. Referring to FIG. 12, an article of manufacture, Roman candle 1200, is shown. Roman candle 1200 includes one or more: fuse 1202, delay charges 1204 and 1212, stars 1206 and 1214, lift charges 1208 and 1216, neutralizer rings 1210 and 1218, clay plug 1220, and paper wrapping 1222.

Fuse 1202 is connected to a first delay charge 1204. Fuse 1202 is a burning fuse that, when lit, burns for a selected amount of time based on the length of fuse 1202 and where fuse 1202 is lit along the length of fuse 1202. Fuse 1202 passes fire to and ignites delay charge 1204.

Delay charge 1204 is connected to fuse 1202 and packed on top of a first star 1206, lifting charge 1208, and shaped neutralizer ring 1210. Delay charge 1204 comprises a pyrotechnic composition that burns at a slow constant rate that is not significantly affected by temperature or pressure and is used to control timing of the pyrotechnic device, i.e., Roman candle 1200. After being ignited by fuse 1202, first delay charge 1204 burns for a selected amount of time based on the composition, height, volume, and density of delay charge 1204, and then ignites one or more of star 1206 and lift charge 1208. Delay charge 1204 delays the time between the burning of fuse 1202 and ignition of star 1206 and lift charge 1208.

Star 1206 is positioned between delay charge 1204 and lift charge 1208. Star 1206 comprises a pyrotechnic composition selected to provide a visual effect, including burning a certain color or creating a spark effect once first star 1206 is ignited. Star 1206 is coated with black powder to aid the ignition of star 1206 and aid the ignition of lift charge 1208.

First lift charge 1208 is positioned between first delay charge 1204 and second delay charge 1212 and is in contact with first star 1206 and first shaped neutralizer ring 1210. First lift charge 1208 comprises an explosive material, such as granulated black powder or any compound selected from Table 5, and is used to shoot first star 1206 out of Roman candle 1200 and to ignite second delay charge 1212. Ignition of first lift charge 1208 causes first star 1206 to shoot out of Roman candle 1200 with a velocity based on one or more of the composition, size, shape, and position of first lift charge 1208 within Roman candle 1200. As depicted in FIG. 12, first lift charge 1208 is shaped substantially as an inverted frustum of a right angle cone with a diameter of the base contacting first delay charge 1204 being larger than a diameter of the base contacting second delay charge 1212. The shape of lift charge 1208 in conjunction with the shape of neutralizer ring 1210 operate to control the blast profile of the explosion created when lift charge 1208 is ignited. The shape of an inverted frustum provides for the explosion created by the ignition of first lift charge 1208 to be directed out through the top of Roman candle 1200 while still allowing for sufficient contact area with second delay charge 1212 to pass fire onto and ignite second delay charge 1212 after first lift charge 1208 is ignited.

Neutralizer ring 1210 surrounds the conically slanted side of lift charge 1208 and is positioned between delay charge 1204 and delay charge 1212. Neutralizer ring 1210 is a ring of material comprising an inert material that, as described above, is indiscernible from the explosive material of lift charge 1208 and that, if mixed with the explosive material of lift charge 1208, results in a composition having a substantially reduced explosiveness. Material of shaped neutralizer ring 1210 has a grain size and color matching that of the grain size and color of material of lift charge 1208 so that the interface between shaped neutralizer ring 1210 and lift charge 1208 is indiscernible.

Delay charge 1212, star 1214, lift charge 1216, and neutralizer ring 1218 operate in a similar fashion as delay charge 1204, star 1206, lift charge 1208, and neutralizer ring 1210, but may have the same or different compositions, sizes, shapes, positions, and geometries and provide for the same or different specific effects.

Clay plug 1220 is a bottom layer of Roman candle 1200 beneath the combination of second lift charge 1216 and neutralizer ring 1218. Clay plug 1220 prevents fire from second lift charge 1216 from escaping through the bottom of Roman candle 1200 and prevents lift charge 1216 from being ignited from below.

Paper wrapping 1222 surrounds the sides of Roman candle 1200 forming a cylindrical shape. Paper wrapping 1222 protects Roman candle 1200 when not in use and acts as a muzzle to direct stars 1206 and 1214 when they are shot out of the top of Roman candle by lift charges 1208 and 1216, respectively.

Figure 13:
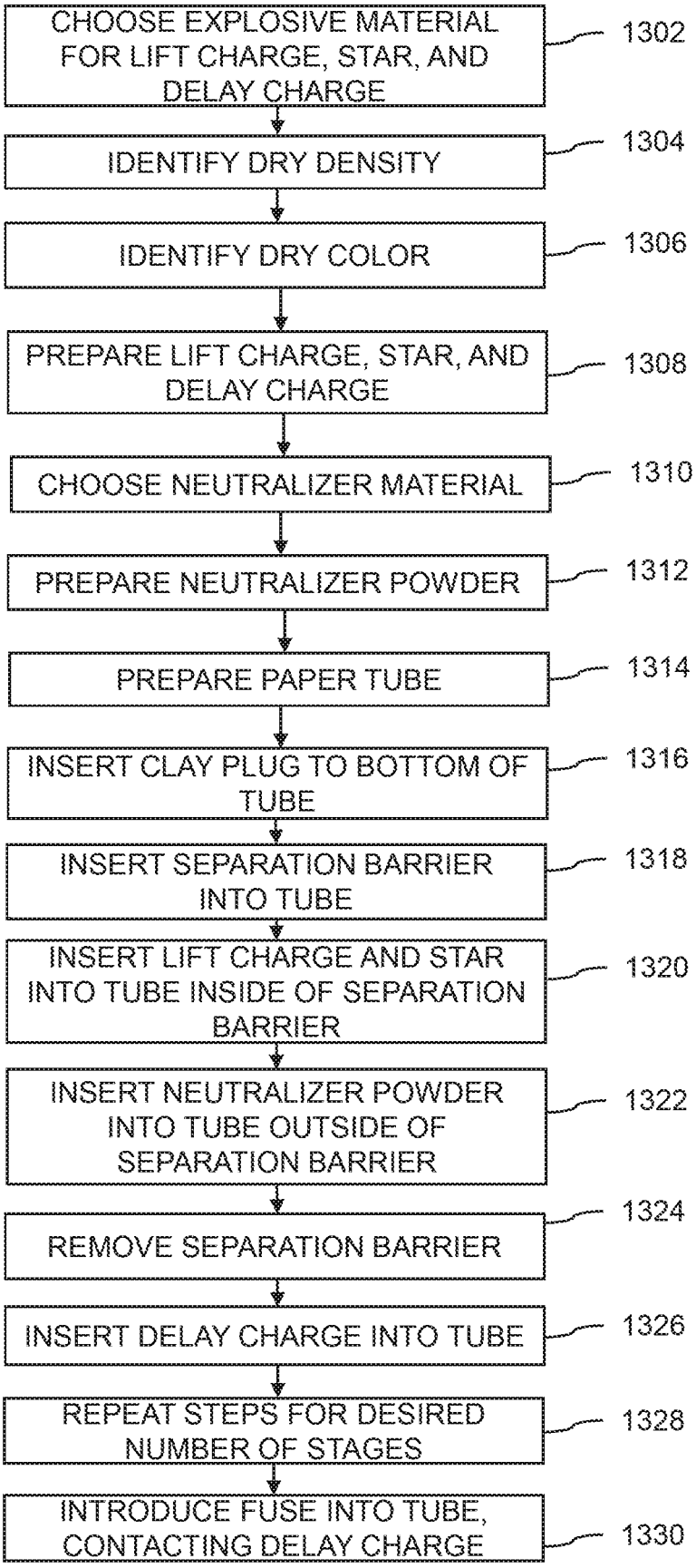
FIG. 13 is a flow chart of steps to build a Roman candle in accordance with a preferred embodiment of this disclosure.

Referring to FIG. 13, one or more steps involved with constructing a pyrotechnic device commonly referred to as a Roman candle is shown. At step 1302, an explosive material is chosen. The proper explosive material will be chosen based on its intended use and may be selected from the explosive compounds from Table 5. At step 1304, the dry density of the explosive material is identified. At step 1306, the color of the dried explosive material is identified. At step 1308, the lift charge, star and delay charge are prepared using explosive material. At step 1310, the neutralizer material with the identified dry density is selected from the neutralizers listed in Table 3. At step 1312, a neutralizer powder is prepared using the neutralizer material and proper pigmentation and solvent selected from Tables 3-4.

At step 1314, a paper tube is prepared to receive the clay plug, one or more lift charges, one or more stars, one or more delay charges and neutralizer powder. The paper tube may be placed vertically so that the materials may be introduced from the top of the tube. At step 1316, a clay plug is inserted into the bottom of tube that directs the explosions from the lift charge out through the top of the tube. At step 1318, a separation barrier is inserted into the tube. The separation barrier may include a slant to be slightly conical in shape so that the lift charge is formed as a frustum. At step 1320, the lift charge is inserted into the tube inside the separation barrier, after which one or more stars are placed on top of the lift charge. At step 1322, neutralizer powder is inserted into the tube outside of the separation barrier. The neutralizer powder has the same grain size and color as the lift charge. At step 1324, the separation barrier is removed and the interface between the lift charge and the neutralizer is indiscernible due to the selected properties of the neutralizer powder. At step 1326, a delay charge is inserted into the tube and packed down so that the lift charge, stars, neutralizer powder, and delay charge will not mix during subsequent handling and processing. At step 1328, steps 1318-1326 are repeated for a desired number of stages for the pyrotechnic device. At step 1330, a fuse is introduced into the tube that contacts the top-most delay charge.

Figure 14:
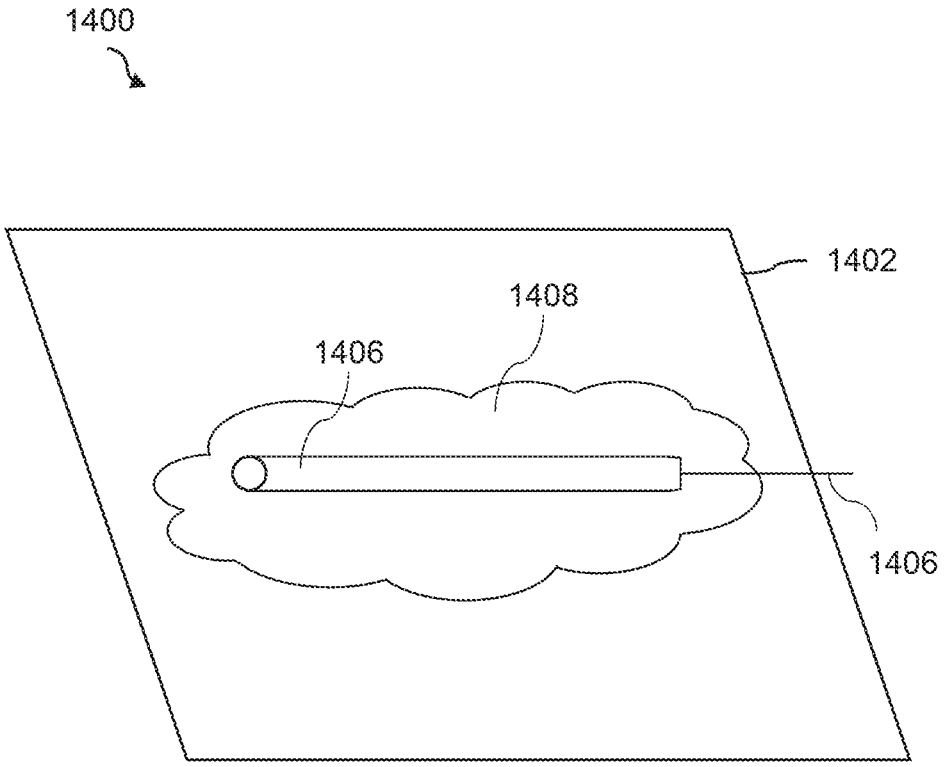
FIG. 14 is an isometric view of a pyrotechnic assembly in accordance with a preferred embodiment of this disclosure.

In one preferred embodiment, an article of manufacture, in this case a pyrotechnic assembly, is produced according to this disclosure. Referring then to FIG. 14, an article of manufacture, pyrotechnic assembly 1400, is shown. Pyrotechnic assembly 1400 includes: paper 1402, slurry 1404, fuse 1406, and solidified material 1408.

Paper 1402 forms an outer shell for a pyrotechnic device created from assembling pyrotechnic assembly 1400. Prior to rolling paper 1402 to form a cylinder, slurry 1404 is placed on paper 1402, solidified material 1408 is placed onto slurry 1404, and fuse 1406 is positioned. After positioning slurry 1404, solidified material 1408, and fuse 1406 onto paper 1402, paper 1402 is rolled to form a cylindrical pyrotechnic device.

Slurry 1404 is positioned on paper 1402 between paper 1402 and solidified material 1408 prior to rolling paper 1402. After rolling, slurry 1404 forms a substantially continuous layer around solidified material 1408. One of slurry 1404 and solidified material 1408 comprises neutralizer material (e.g., concealed amalgamated neutralizer 104 of FIG. 1A) and the other of slurry 1404 and solidified material 1408 comprises explosive material (e.g., explosive composition 114 of FIG. 1A). After solidifying, the boundary between the material of slurry 1404 and the material of solidified material 1408 will be indiscernible upon visual inspection. The volume of slurry 1404 is sufficient so that when the material of slurry 1404 is randomly mixed with the material of solidified material 1408, the explosiveness of the combined mixed material is substantially reduced.

Fuse 1406 is positioned to pass flame to explosive material comprised by one of slurry 1404 and solidified material 1408. Fuse 1406 contacts both slurry 1404 and solidified material 1408 so that fuse 1406 contacts both the inert material of one of slurry 1404 and solidified material 1408 and the explosive material of the other of slurry 1404 and solidified material 1408. By contacting both slurry 1404 and solidified material 1408, the position of fuse 1406 does not provide an indication of whether solidified material 1408 or slurry 1404 comprises explosive material in the final assembled device.

In an alternative embodiment where solidified material 1408 comprises the explosive material, fuse 1406 may be positioned within and incorporated into solidified material 1408 prior to the solidification of solidified material 1408. With fuse 1406 incorporated into solidified material 1408, placement of solidified material 1408 also positions fuse 1406 with respect to paper 1402 of assembly 1400.

Solidified material 1408 is positioned on slurry 1404 prior to rolling paper 1402 and contacts fuse 1406. After rolling pyrotechnic assembly 1400 into a pyrotechnic device, solidified material 1408 is located in substantially the center of the pyrotechnic device. In alternative embodiments, solidified material 1408 may be positioned away from the center of the pyrotechnic device and create a different explosion profile as compared to when the solidified material 1408 is placed in the center of the pyrotechnic device.

Figure 15:
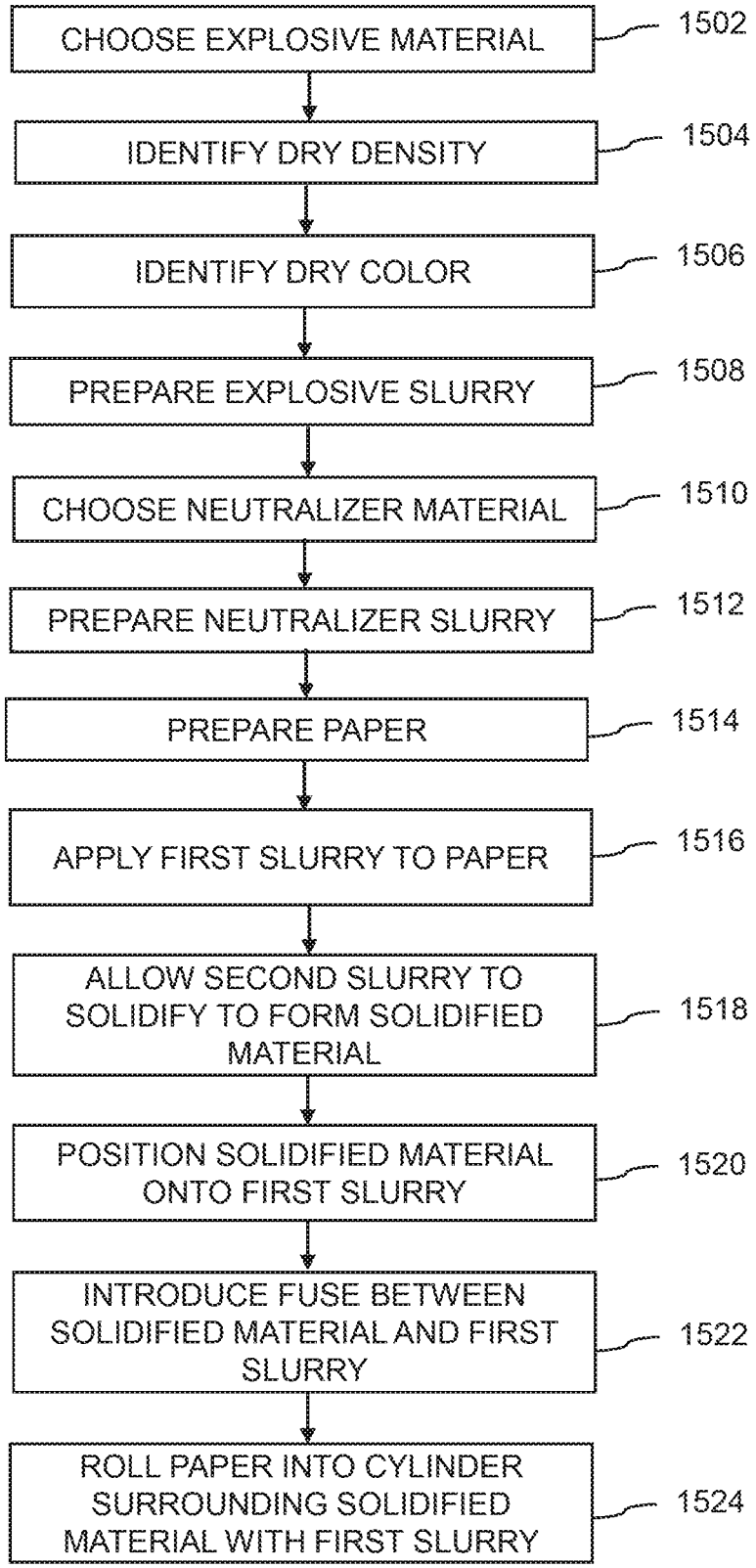
FIG. 15 is a flow chart of steps to build a pyrotechnic assembly in accordance with a preferred embodiment of this disclosure.

Referring to FIG. 15, one or more steps involved with constructing a pyrotechnic device by rolling single portions of explosive material and neutralizer material into a cylinder is shown. At step 1502, an explosive material is chosen from Table 5. The proper explosive material will be chosen based on its intended use. At step 1504, the dry density of the explosive material is identified. At step 1506, the color of the dried explosive material is identified. At step 1508, an explosive slurry is using the explosive material and the appropriate solvent or liquid. At step 1510, the neutralizer material with the identified dry density is chosen. At step 1512, a neutralizer slurry is prepared using the neutralizer material and proper pigmentation and solvent or liquid.

At step 1514, paper is prepared for creating the pyrotechnic device. The paper is formed as a square or rectangular sheet with appropriate dimensions of thickness, length, and width to form the exterior of the pyrotechnic device. At step 1516, a first slurry is applied to the paper. The first slurry is one or the other of the explosive slurry and the neutralizer slurry. At step 1518 and prior to introducing the second slurry to the first slurry, the second slurry is allowed to at least partially solidify to form a solidified material or paste that is thicker than the first slurry to aid further processing steps. The second slurry is different from the first slurry and is the other of the explosive slurry or the neutralizer slurry. At step 1520, the solidified material made from the second slurry is positioned onto the first slurry.

Figure 16:
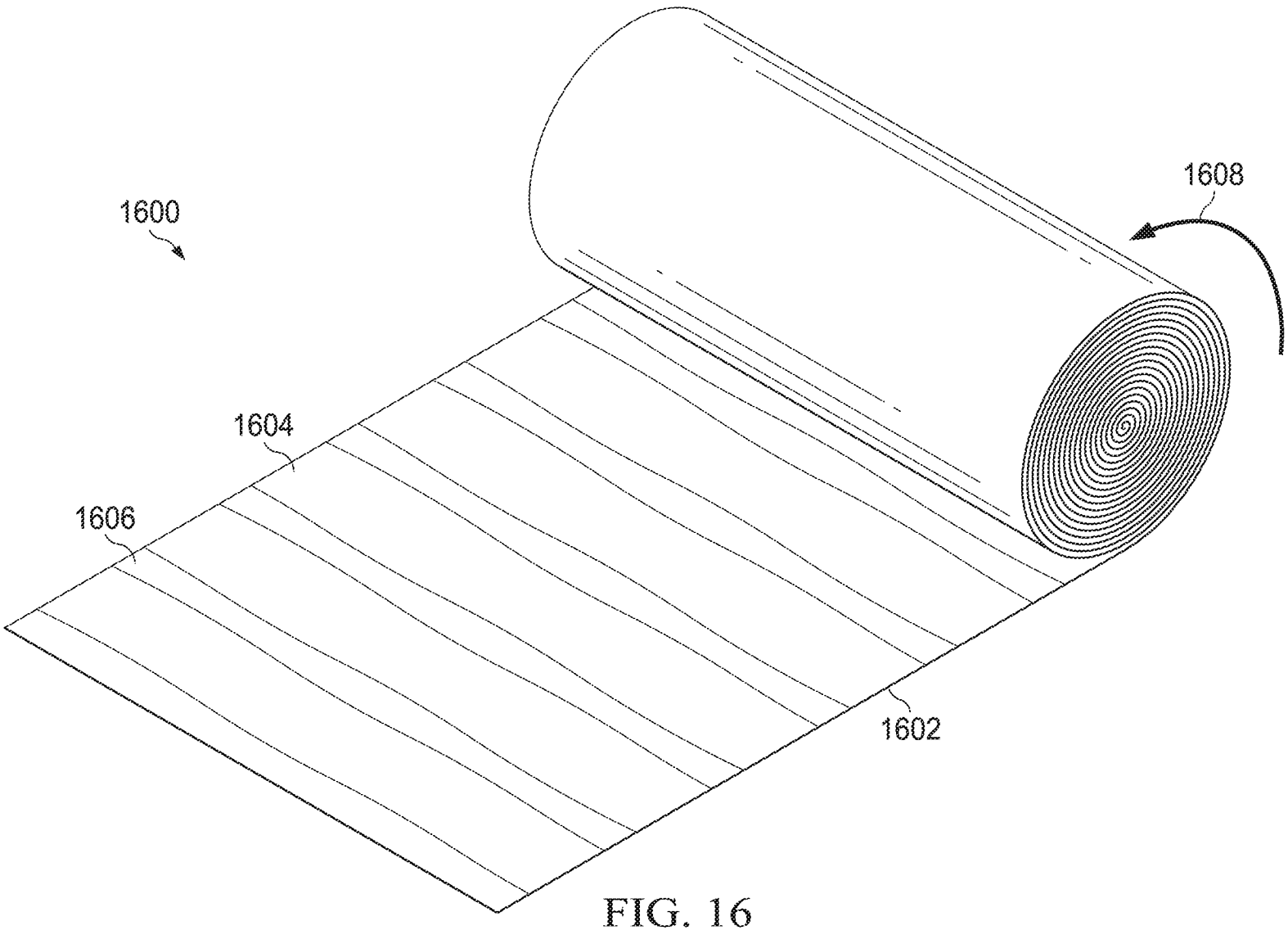
FIG. 16 is an isometric view of a pyrotechnic assembly in accordance with a preferred embodiment of this disclosure.

At step 1522, a fuse is introduced between the solidified material and the first slurry so as to contact the explosive material in one or the other of the first slurry and the second slurry. In alternative embodiments, the fuse is introduced into the second slurry prior to solidification of the second slurry. At step 1524, the paper is rolled into a cylindrical shape. The process or rolling the paper surrounds the entirety of the solidified material with the first slurry and positions the solidified material substantially in the center of the cylinder created by rolling the paper. Positioning the solidified material in the center of the cylinder gives the pyrotechnic device a substantially uniform blast profile along the circumference of the cylinder. In alternative embodiments, the solidified material is positioned off center so that the pyrotechnic device will not contain a substantially uniform blast profile along the circumference of the cylinder In one preferred embodiment, an article of manufacture, in this case a pyrotechnic assembly, is produced according to this disclosure. Referring to FIG. 16, an article of manufacture, assembly 1600, is shown that forms an embodiment of portion 100 of a pyrotechnic device of FIG. 1A. Assembly 1600 includes: paper 1602, explosive compound 1604, and neutralizer compound 1606.

Paper 1602 is a substrate onto which explosive compound 1604 and neutralizer compound 1606 are applied. After application of explosive compound 1604 and neutralizer compound 1606 onto paper 1602, paper 1602 is rolled from one end in direction 1608 to form a cylinder. A fuse for igniting explosive compound 1604 may be introduced to assembly 1600 before or after rolling paper 1602 into a cylinder. After assembly into pyrotechnic device, paper 1602 protects the pyrotechnic device from unwanted ignition.

Explosive compound 1604 is any explosive material and is applied to paper 1602 as a paste or slurry to stick between multiple layers of paper 1602 after paper 1602 is rolled. The width of each portion of explosive compound 1604 applied to paper 1602 is substantially uniform. In alternative embodiments, the width of each portion of explosive compound 1604 applied to paper 1602 may vary along the length of paper 1602. The overall ratio of the volume of explosive compound 1604 to the volume of neutralizer compound 1606 is such that, if explosive compound 1604 and neutralizer compound 1606 are removed from a pyrotechnic device created from assembly 1600 and mixed, then the resulting mixture would have a substantially reduced explosive effectiveness.

Neutralizer compound 1606 is any neutralizer material and is also applied to paper 1602 as a paste or slurry to stick between multiple layers of paper 1602 after paper 1602 is rolled. The width of each portion of neutralizer compound 1606 applied to paper 1602 is substantially uniform and is less than the width of the portions of explosive compound 1604. When dried, neutralizer compound 1606 has a grain size that substantially matches the grain size of explosive compound 1604. Neutralizer compound 1606 includes pigmentation so that the color of neutralizer compound 1606 substantially matches the color of explosive compound 1604. The boundary interface between the portions of explosive compound 1604 and neutralizer compound 1606 are indiscernible upon final assembly due to the matching grain size and color between explosive compound 1604 and neutralizer compound 1606.

In alternative embodiments, the width of each portion of explosive compound 1604 applied to paper 1602 may vary along the length of paper 1602.

Figure 17:
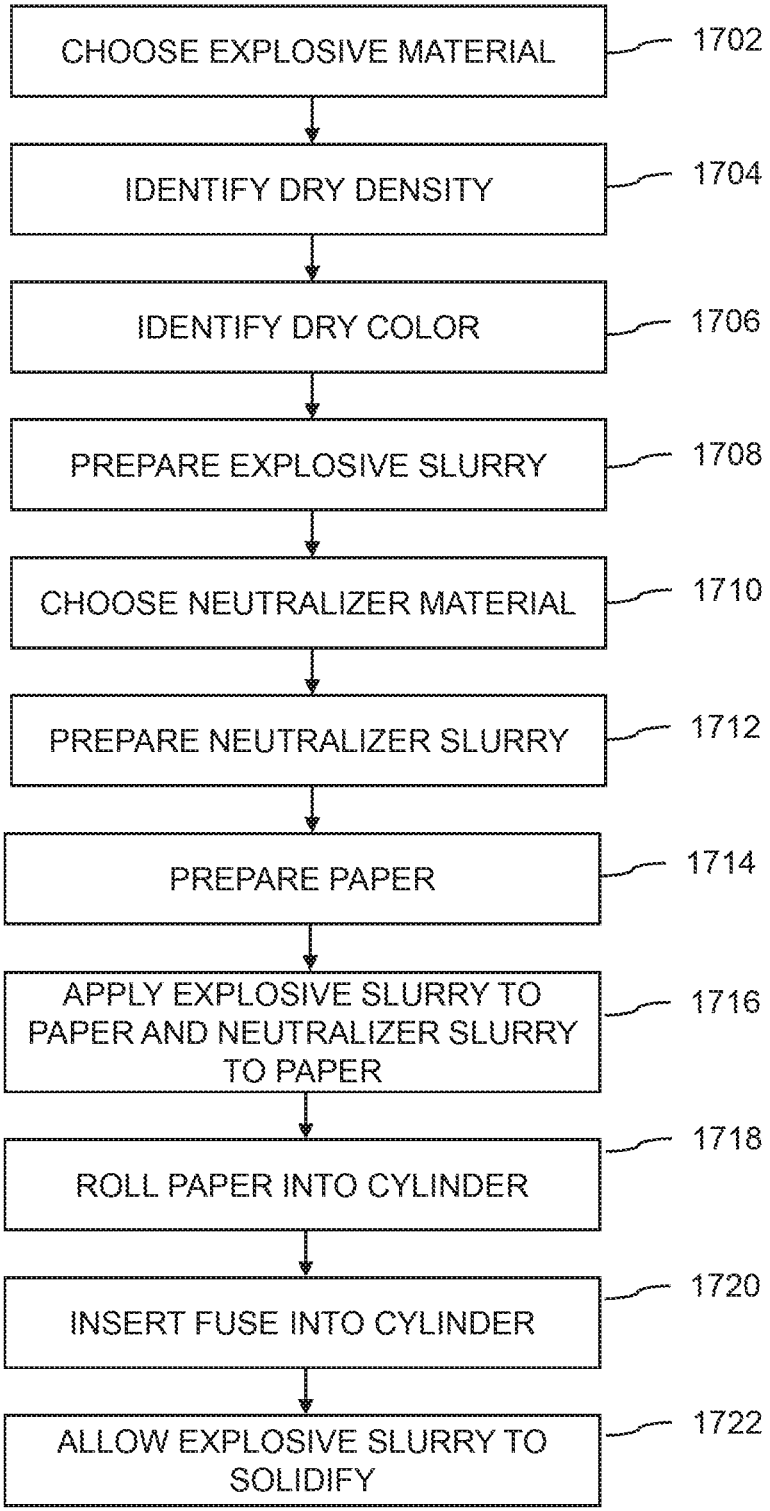
FIG. 17 is a flow chart of steps to roll a pyrotechnic device in accordance with a preferred embodiment of this disclosure.

Referring to FIG. 17, one or more steps involved with constructing a pyrotechnic device by rolling multiple portions of explosive material and neutralizer material is shown. At step 1702, an explosive material is chosen from Table 5. The proper explosive material will be chosen based on its intended use. At step 1704, the dry density of the explosive material is identified. At step 1706, the color of the dried explosive material is identified. At step 1708, a slurry is prepared from the explosive material and the appropriate solvent or liquid. At step 1710, the neutralizer material with the identified dry density is chosen. At step 1712, a neutralizer slurry is prepared using the neutralizer material and proper pigmentation and solvent.

At step 1714, paper is prepared as a substrate to receive the explosive slurry and neutralizer slurry. The paper is sliced into a selected length and width suitable for rolling. At step 1716, explosive slurry and neutralizer slurry are applied to the paper in alternating portions, as shown in FIG. 16. The width of the portions may be uniform or vary based on the location of the portion with respect to the leading edge of the paper that gets rolled first and the trailing edge of the paper that gets rolled last. For example, portions closer to the trailing edge may have a longer width as compared to portions closer to the leading edge At step 1718, the paper with the applied explosive slurry and neutralizer slurry is rolled into a cylindrical shape so that each portion of explosive compound contacts two portions of neutralizer compound and two layers of paper. Similarly, each portion of neutralizer compound contacts two portions of explosive compound and two layers of paper.

At step 1720, a fuse is inserted into the cylinder created by rolling the paper. The fuse is inserted so as to contact at least one portion of explosive slurry. At step 1722, at least the explosive slurry is allowed to solidify and optionally the neutralizer is also allowed to solidify.

At step 1720, the explosive slurry is allowed to solidify as well as the neutralizer slurry. The cylindrically shaped roll comprising the solidified explosive slurry and the neutralizer slurry may then be used to form a pyrotechnical device. With the color, grain size, and dry density being substantially similar, the interfaces between portions of explosive material and neutralizer material in the rolled cylinder are indiscernible upon visual inspection and the explosive material is indistinguishable from the neutralizer material. Removal of the explosive material would also remove the neutralizer material so that attempted use of the explosive material in an improvised explosive device would mix the explosive material with the neutralizer material and reduce the effectiveness of the explosive material in the improvised explosive device.

Figure 18:
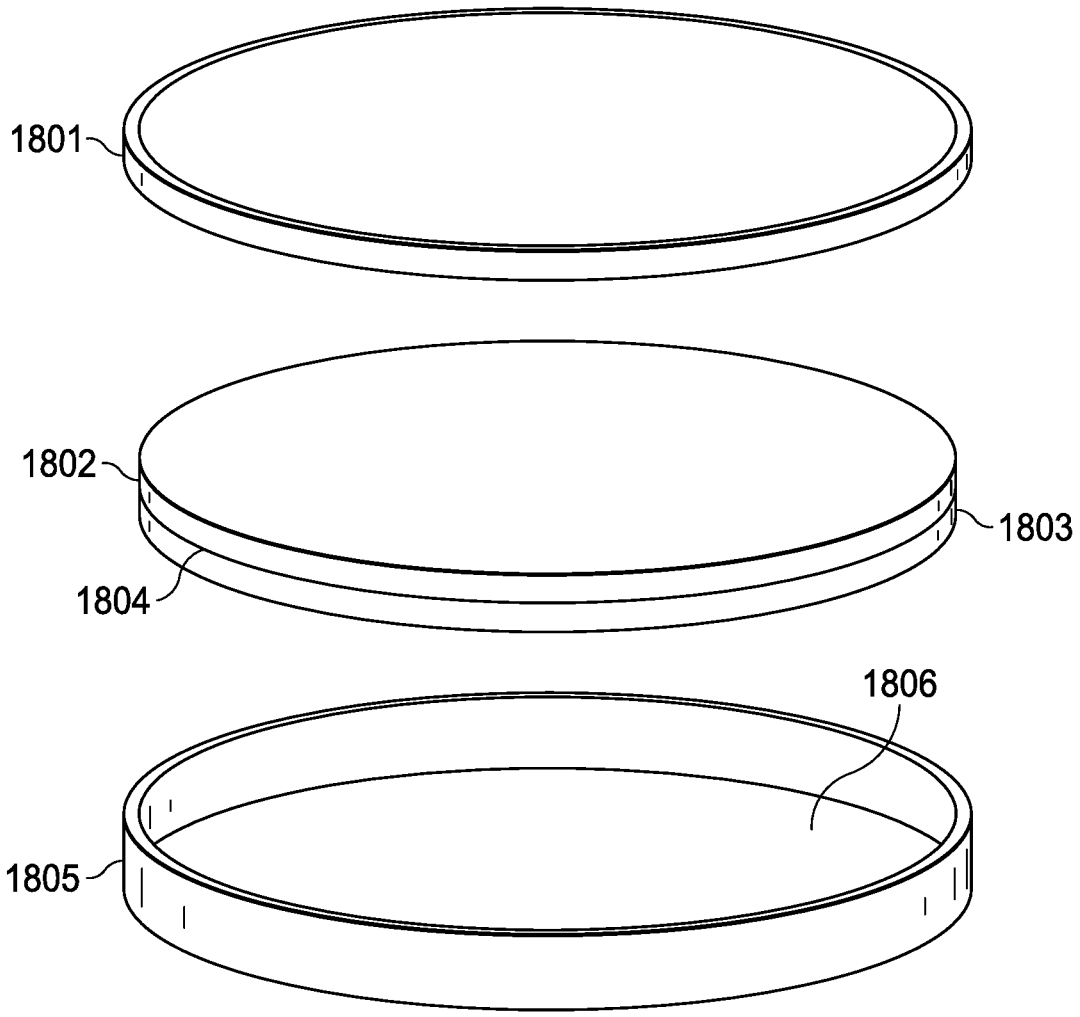
FIG. 18 is a detail view of a pyrotechnic device in accordance with a preferred embodiment of this disclosure.

In one preferred embodiment, an article of manufacture, in this case pyrotechnic device 1800 forms, for example, an instant hit recognition flare or pyrotechnic target, and is produced according to this disclosure. Referring to FIG. 18, an article of manufacture, pyrotechnic device 1800, is shown that forms an embodiment of portion 100 of a pyrotechnic device of FIG. 1A. Pyrotechnic device 1800 includes: cardboard lid 1801, concealed amalgamated neutralizer 1802, pyrotechnic composition 1803, imperceptible boundary layer 1804, and shell case 1805.

Cardboard lid 1801 and shell case 1805 form an embodiment of housing 102 of FIG. 1A. Cardboard lid 1801 is fitted to the top of shell case 1805 and presses against concealed amalgamated neutralizer 1802 to compact and maintain the shape and position of concealed amalgamated neutralizer 1802 and pyrotechnic composition 1803 within pyrotechnic device 1800.

Concealed amalgamated neutralizer 1802 is layered on top of pyrotechnic composition 1803 and is held in place by cardboard lid 1801 and shell casing 1805. Pyrotechnic composition 1803 is an embodiment of explosive composition 114, is layered on top of shell case floor 1806, and is held in place by shell casing 1805. When concealed amalgamated neutralizer 1802 is mixed with pyrotechnic composition 1803 outside of pyrotechnic device 1800, such as in an improvised explosive device, the explosive power of the resulting mixture is reduced as compared to the explosive power of pyrotechnic composition 1803.

Imperceptible boundary layer 1804 is present at the interface or junction between concealed amalgamated neutralizer 1802 and pyrotechnic composition 1803. Concealed amalgamated neutralizer 1802 is selected, processed, and manufactured to comprise a grain shape, grain size, color, and density that substantially matches the grain shape, grain size, color, and density of pyrotechnic composition 1803 so that imperceptible boundary layer 1804 cannot be perceived upon visual inspection.

Shell case 1805 comprises shell case floor 1806 and contains concealed amalgamated neutralizer 1802 and pyrotechnic composition 1803. Shell case 1805 presses against concealed amalgamated neutralizer 1802 and pyrotechnic composition 1803 to compact and maintain the shape and position of concealed amalgamated neutralizer 1802 and pyrotechnic composition 1803 within pyrotechnic device 1800.

Figure 19:
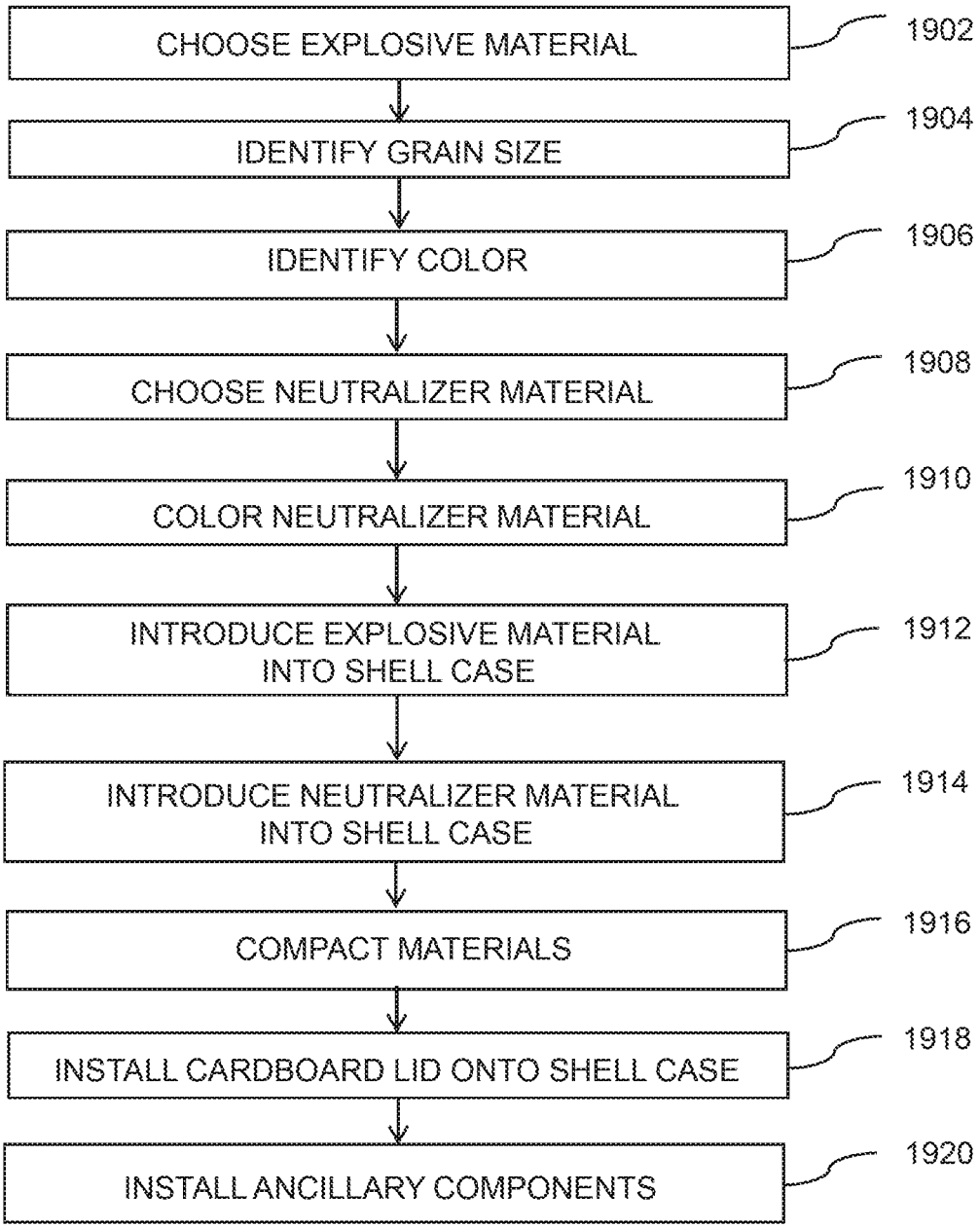
FIG. 19 is a flow chart of steps to build a device using a shell case in accordance with a preferred embodiment of this disclosure.

Referring to FIG. 19, the steps involved with constructing a pyrotechnic device with concealed amalgamated neutralizer as used in an instant hit recognition flare or pyrotechnic target using a shell case is shown. At step 1902, an explosive material, also known as a pyrotechnic composition, is chosen. The proper explosive material will be chosen based on its intended use. At step 1904 the grain size of the explosive material is identified. If the explosive material contains multiple components each having different grains sizes, each grain size will be identified. At step 1906, the color of the explosive material is identified. At step 1908, a matching neutralizer material, also known as a concealed amalgamated neutralizer or a concealed amalgamated neutralizer component, with the identified grain size is chosen. The neutralizer material and the level of neutralization desired is chosen according to Table 1 for dry materials or Table 2 for slurries. At step 1910, if the color of the neutralizer material does not match the explosive material, then the neutralizer material is colored to match the explosive material using one or more pigments or dyes. In a different embodiment, a charcoal dye is employed to tint the neutralizer material. At step 1912, the explosive material is introduced into a shell case. At step 1914, the neutralizer material is introduced into the shell case, and if necessary, the shell case is assembled. If necessary, at step 1916, the materials introduced in the build container are compacted. At step 1918, a cardboard lid is installed onto and fitted to the shell case. In alternative embodiments, the materials are compacted after installation of the cardboard lid instead of or in addition to being compacted prior to installation of the cardboard lid. At step 1920, any ancillary components required for the device, such as plugs, primers, fuses, detonators, etc., are installed.

Figure 20:
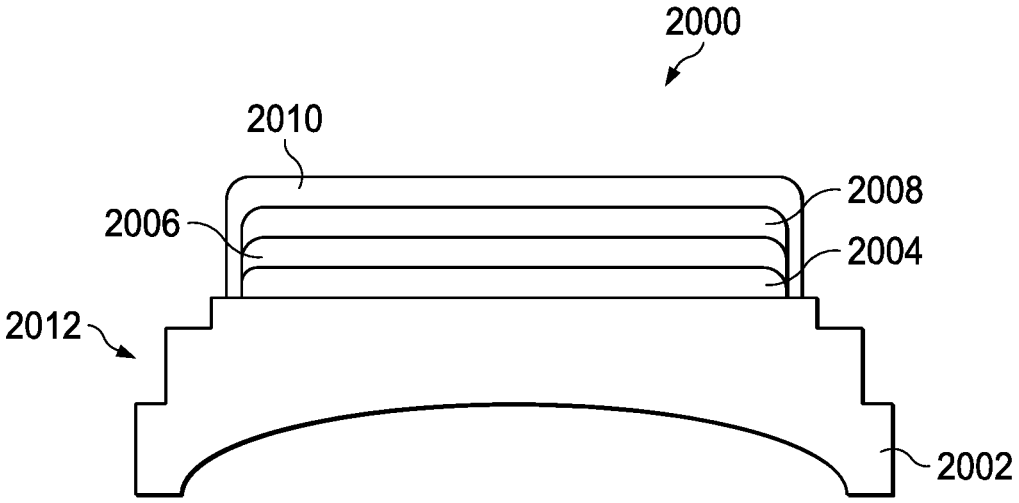
FIG. 20 is a cross section view of a pyrotechnic pigeon in accordance with a preferred embodiment of this disclosure.

In one preferred embodiment, an article of manufacture, in this case a pyrotechnic pigeon, is produced according to this disclosure. Referring to FIG. 20, an article of manufacture, pyrotechnic pigeon 2000, is shown that includes an embodiment of portion 100 of a pyrotechnic device of FIG. 1A. Pyrotechnic pigeon 2000 is a target configured for target shooting. Pyrotechnic pigeon 2000 includes substrate layer 2002, first plastic layer 2004, first material layer 2006, second material layer 2008, and second plastic layer 2010. The sizes and thicknesses of the layers are not shown to scale. In certain embodiments, pyrotechnic pigeon 2000 comprises a standard clay pigeon to which first plastic layer 2004, first material layer 2006, second material layer 2008, and second plastic layer 2010 are applied.

Substrate layer 2002 includes a step-shaped edge 2012 at the circumference of pyrotechnic pigeon 2000. Step-shaped edge 2012 allows for pyrotechnic pigeon 2000 to be guided and rotated as it is launched from a clay pigeon launcher. Substrate layer 2002 acts as a substrate upon which is formed first plastic layer 2004, first material layer 2006, second material layer 2008, and second plastic layer 2010. Substrate layer 2002 contacts one or more layers of plastic material. Substrate layer 2002 comprises any clay, plastic, metal, concrete, limestone, pitch, or other material that is suitable for making a targets for clay pigeon shooting, also known as clay target shooting.

First plastic layer 2004 is positioned between substrate layer 2002 and first material layer 2006. First plastic layer 2004 protects first material layer 2006 from substrate layer 2002. First plastic layer 2004 adheres the combination of first plastic layer 2004, first material layer 2006, second material layer 2008, and second plastic layer 2010 to substrate layer 2002.

First material layer 2006 is positioned between first plastic layer 2004 and second material layer 2008. Second material layer 2008 is positioned between first material layer 2006 and second plastic layer 2010.

When first material layer 2006 is the explosive material, second material layer 2008 is the neutralizer material. When first material layer 2006 is the neutralizer material, second material layer 2008 is the explosive material. The neutralizer material is selected and processed to have the same color, density, dry weight, and grain size as the explosive material so that the junction between first material layer 2006 and second material layer 2008 is formed as an indiscernible boundary layer. The ratio of explosive material to neutralizer material is such that, if explosive material and neutralizer material were removed from pyrotechnic pigeon 2000 and mixed, then the resulting mixture would have substantially reduced usefulness as a propellant or explosive, such as in an improvised explosive device.

Second plastic layer 2010 is placed onto second material layer 2008 and substrate layer 2002. Second plastic layer 2010 surrounds the outer edges of each of first plastic layer 2004, first material layer 2006, and second material layer 2008. Second plastic layer 2010 protects and supports first material layer 2006 and second material layer 2008. Combined, first plastic layer 2004 and second plastic layer 2010 operate to seal, protect, and encapsulate first material layer 2006 and second material layer 2008 from external moisture and humidity.

First plastic layer 2004 and second plastic layer 2010 may be homogeneous or heterogeneous and comprise any form of plastic, including: acrylic, acrylonitrile butadiene styrene (ABS), diallyl-phthalate (DAP), epoxy resin, high impact polystyrene (HIPS), high-density polyethylene (HDPE), low-density polyethylene (LDPE), medium-density polyethylene (MDPE), melamine resin, phenol formaldehyde resin (PF), polyactic acid (PLA), polyamide (PA) (nylon), polybenzimidazole (PBI), polycarbonate (PC), polycyanurate, polyester (PE), polyether sulfone (PES), polyetherether ketone (PEEK), polyetherimide (PEI), polyethylene (PE), polyethylene terephthalate (PET), polyimide (PI), polymethyl methacrylate (PMMA), polyphenylene oxide (PPO), polyphenylene sulfide (PPS), polypropylene (PP), polystyrene (PS), polytetrafluoroethylene (PTFE), polyurethane (PU), polyvinyl chloride (PVC), polyvinylidene chloride (PVDC), urea-formaldehyde, and vulcanized rubber. In one preferred embodiment, first plastic layer 2004 comprises an acrylic resin and is enhanced for adhesive properties to ensure the combination of first plastic layer 2004, first material layer 2006, second material layer 2008, and second plastic layer 2010 adheres to substrate layer 2002. Second plastic layer 2010 is enhanced for brittleness to protect the placement and positioning of the combination of first plastic layer 2004, first material layer 2006, second material layer 2008, and second plastic layer 2010 on top of substrate layer 2002 during transport and handling.

Figure 21A:
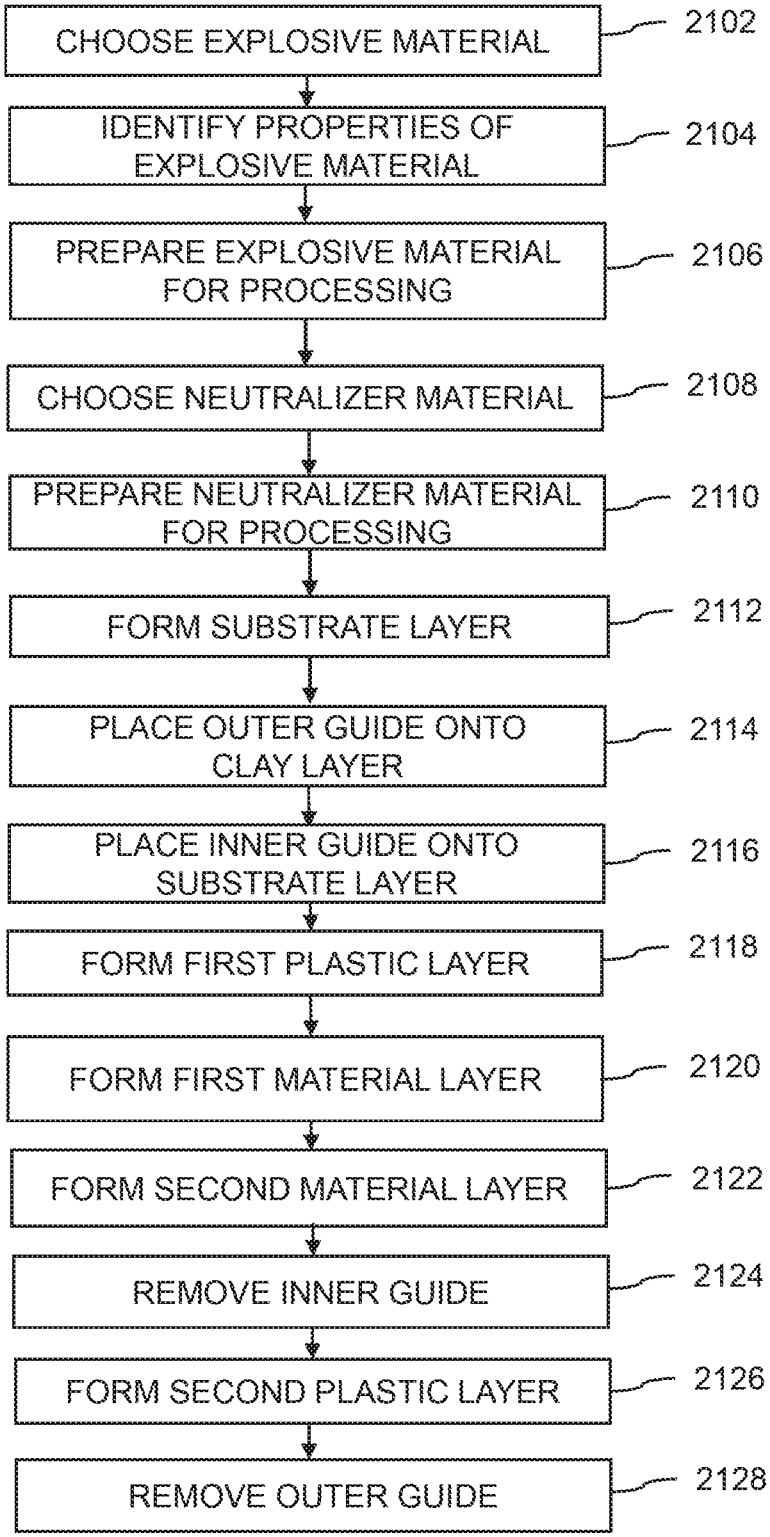
FIG. 21A is a flow chart of steps to build a pyrotechnic pigeon in accordance with a preferred embodiment of this disclosure.
Figure 21B:
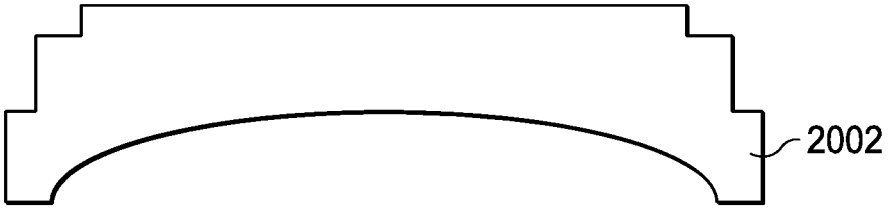
FIGS. 21B to 21I are cross section views of a pyrotechnic pigeon as it is being built in accordance with a preferred embodiment of this disclosure.
Figure 21C:
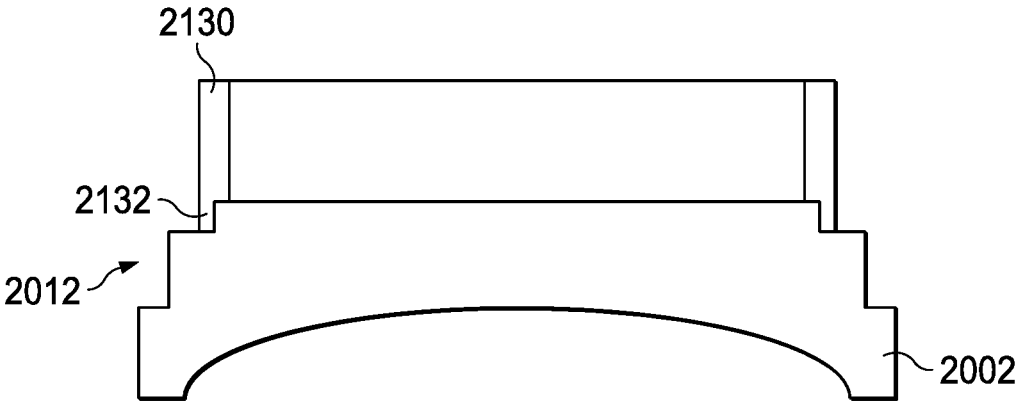
Figure 21D:
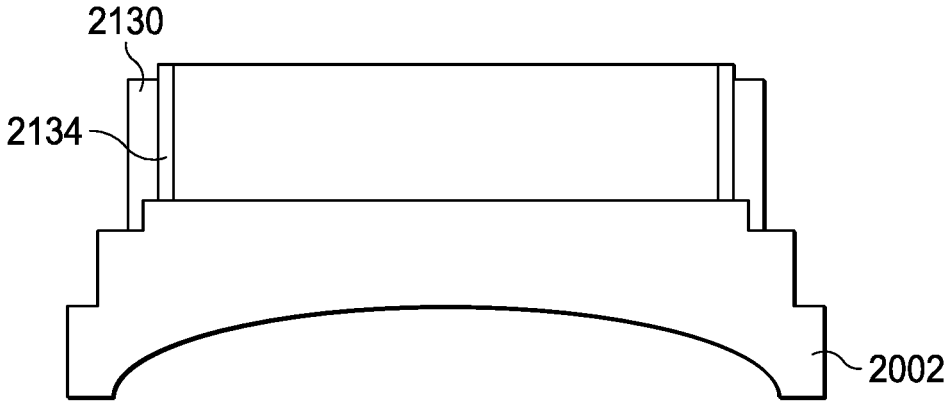
Figure 21E:
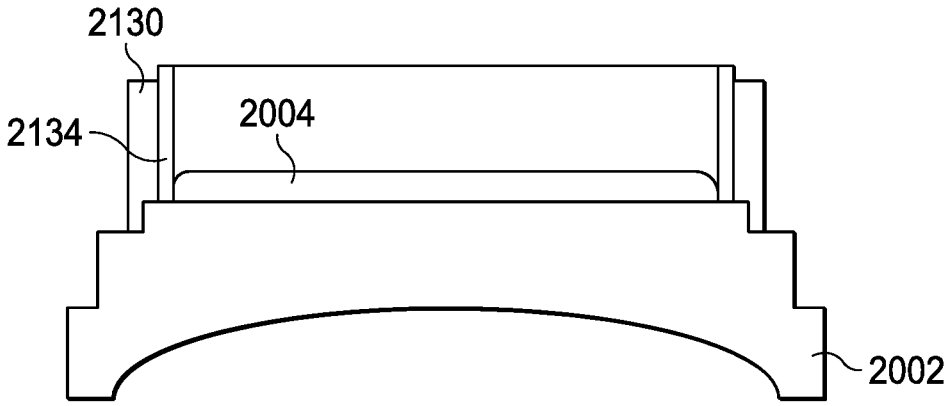
Figure 21F:
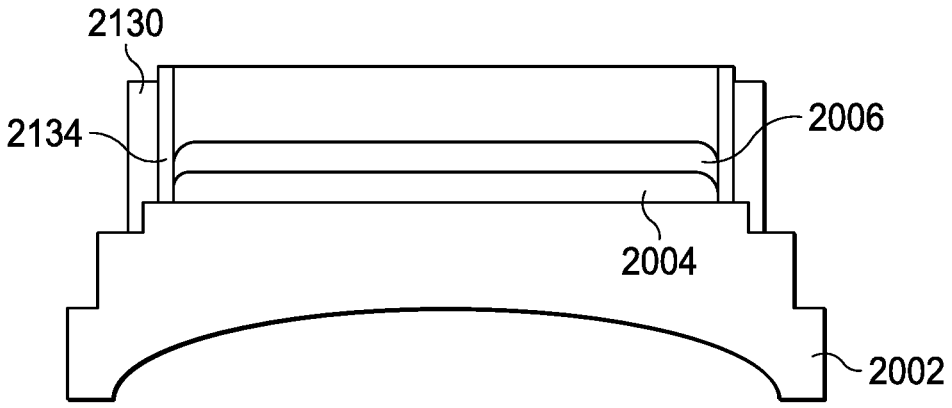
Figure 21G:
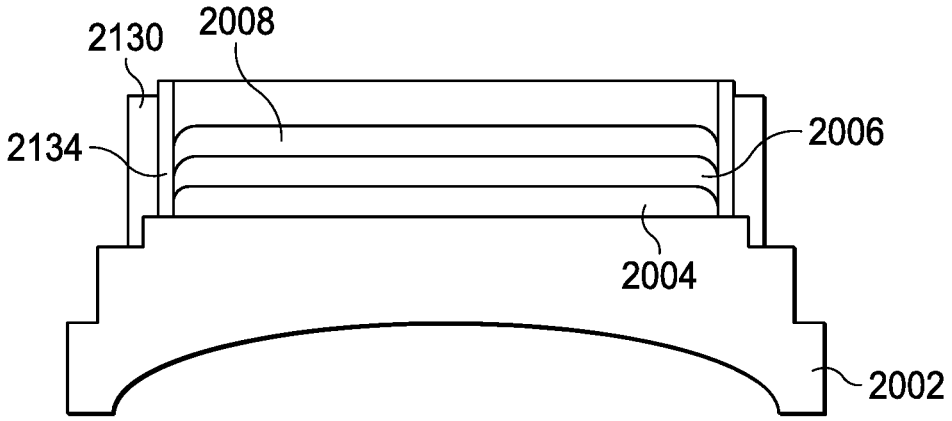

Referring to FIGS. 21A to 21I, FIG. 21A is a flow chart depicting steps used to create a pyrotechnic pigeon, such as pyrotechnic pigeon 2000 of FIG. 20, and FIGS. 21B to 21I are cross section views of a pyrotechnic pigeon as it is being built with the steps of FIG. 21A.

At step 2102, an explosive material is chosen to be used for the pyrotechnic pigeon. The proper explosive material will be chosen based on its intended use and may be selected from the explosive compounds from Table 5. In one preferred embodiment, explosive material includes black powder and one or more pyrotechnic stars that become visible when the pyrotechnic pigeon is hit. In another preferred embodiment, explosive material includes flash powder to create a visible flash and audible noise when the pyrotechnic pigeon is hit.

At step 2104, the properties of the explosive material are identified, which include the color, weight, density, and grain size of the explosive material in its final dry form in the pyrotechnic pigeon.

At step 2106, the explosive material is prepared for processing. In one preferred embodiment, the explosive material is formed as an explosive slurry that can be particlized or sprayed onto a surface.

At step 2108, a neutralizer material is chosen to be used for the pyrotechnic pigeon. The neutralizer material chosen has similar properties as the explosive material or can be processed to have properties that are substantially similar to the properties of the explosive material.

At step 2110, the neutralizer material is prepared for processing. If the neutralizer material chosen does not have an appropriate color, then a pigment is added to the neutralizer material that give the neutralizer material a color that is substantially the same as or is indiscernible from the color of the explosive material. In one preferred embodiment, the neutralizer material is formed as a neutralizer slurry that can be particlized or sprayed onto a surface.

At step 2112, substrate layer 2002 (shown in FIG. 21B) is formed. In one preferred embodiment, substrate layer 2002 is formed by compacting a mixture of pitch and pulverized limestone in a mold to form the shape of the substrate layer 2002. In another preferred embodiment, substrate layer 2002 is a pre-manufactured clay pigeon.

At step 2114, outer guide 2130 (shown in FIG. 21C) is placed onto substrate layer 2002. In one preferred embodiment, outer guide 2130 is cylindrically shaped and includes step-shaped edge 2132 that matches a portion of step-shaped edge 2012 of substrate layer 2002. Matching step-shaped edge 2132 of outer guide 2130 to the portion of step-shaped edge 2012 of substrate layer 2002 centers and seals outer guide 2130 to substrate layer 2002 so that material applied within outer guide 2130 is appropriately placed onto substrate layer 2002 without leaking onto or reaching step-shaped edge 2012 of substrate layer 2002. In certain embodiments, shapes other than or in addition to a step are used to match or key outer guide 2130 to substrate layer 2002.

At step 2116, inner guide 2134 (shown in FIG. 21D) is placed onto substrate layer 2002 within outer guide 2130. Inner guide 2134 is cylindrically shaped with an outer circumference that is similar to the inner circumference of outer guide 2130 so that inner guide 2134 fits within outer guide 2130 and is centered with respect to outer guide 2130 and to substrate layer 2002. A bottom edge of inner guide 2134 contacts a top surface of substrate layer 2002 to prevent material applied within inner guide 2134 from reaching outer guide 2130 on the top surface of substrate layer 2002.

At step 2118, first plastic layer 2004 (shown in FIG. 21E) is formed. In one preferred embodiment, first plastic layer 2004 is sprayed onto substrate layer 2002 within inner guide 2134. Inner guide 2134 prevents the application of first plastic layer 2004 from reaching the inner edge of outer guide 2130.

At step 2120, first material layer 2006 (shown in FIG. 21F) is formed. In one preferred embodiment, first material layer 2006 is an explosive material that is sprayed onto first plastic layer 2004 within inner guide 2134. Inner guide 2134 prevents the application of first material layer 2006 from reaching the inner edge of outer guide 2130.

At step 2122, second material layer 2008 (shown in FIG. 21G) is formed. In one preferred embodiment, second material layer 2008 is a neutralizer material that is sprayed onto first material layer 2006 within inner guide 2134. Inner guide 2134 prevents the application of second material layer 2008 from reaching the inner edge of outer guide 2130.

Figure 21H:
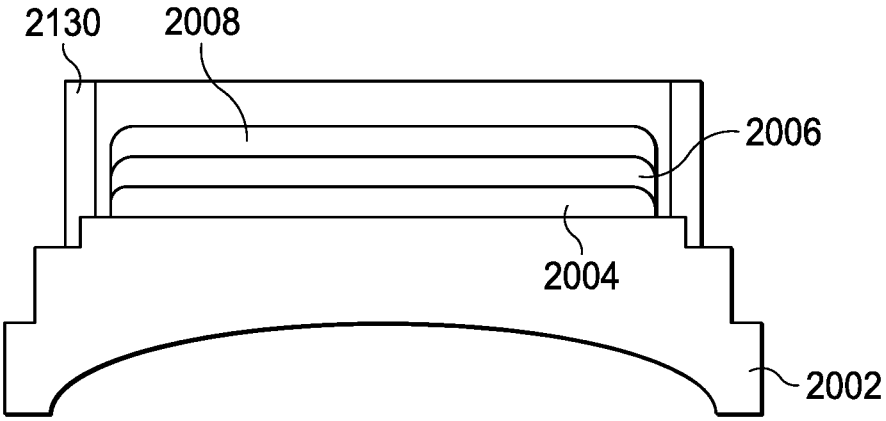
Figure 21I:
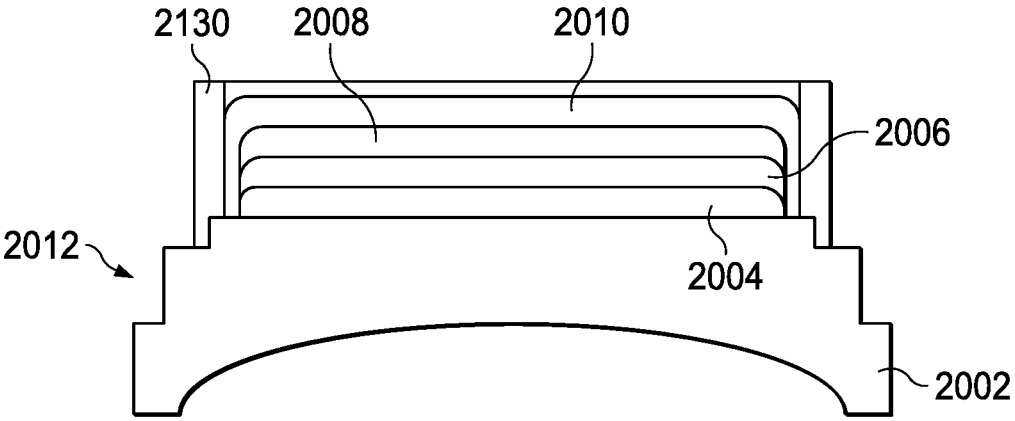

At step 2124, inner guide 2134 is removed (shown in FIG. 21H). Removing inner guide 2134 exposes outer edges of first plastic layer 2004, first material layer 2006, and second material layer 2008. Removing inner guide 2134 also exposes the portion of the top surface of substrate layer 2002 that was covered by the bottom surface of inner guide 2134.

At step 2126, second plastic layer 2010 (shown in FIG. 21I) is formed. In one preferred embodiment, second plastic layer 2010 is sprayed so that the application of second plastic layer covers second material layer 2008, reaches the edges of first material layer 2006 and first plastic layer 2004 within outer guide 2130, and reaches the top surface of substrate layer 2002 that was covered by the bottom surface of inner guide 2134. Outer guide 2130 prevents the application of second plastic layer 2010 from reaching step-shaped edge 2012 of substrate layer 2002.

At step 2128, outer guide 2130 is removed from the fully formed pyrotechnic pigeon, such as pyrotechnic pigeon 2000 (shown in FIG. 20). Removing outer guide 2130 exposes the outer edge of second plastic layer 2010 and the portion of the top surface of substrate layer 2002 that was covered by the bottom surface of outer guide 2130.

Figure 22:
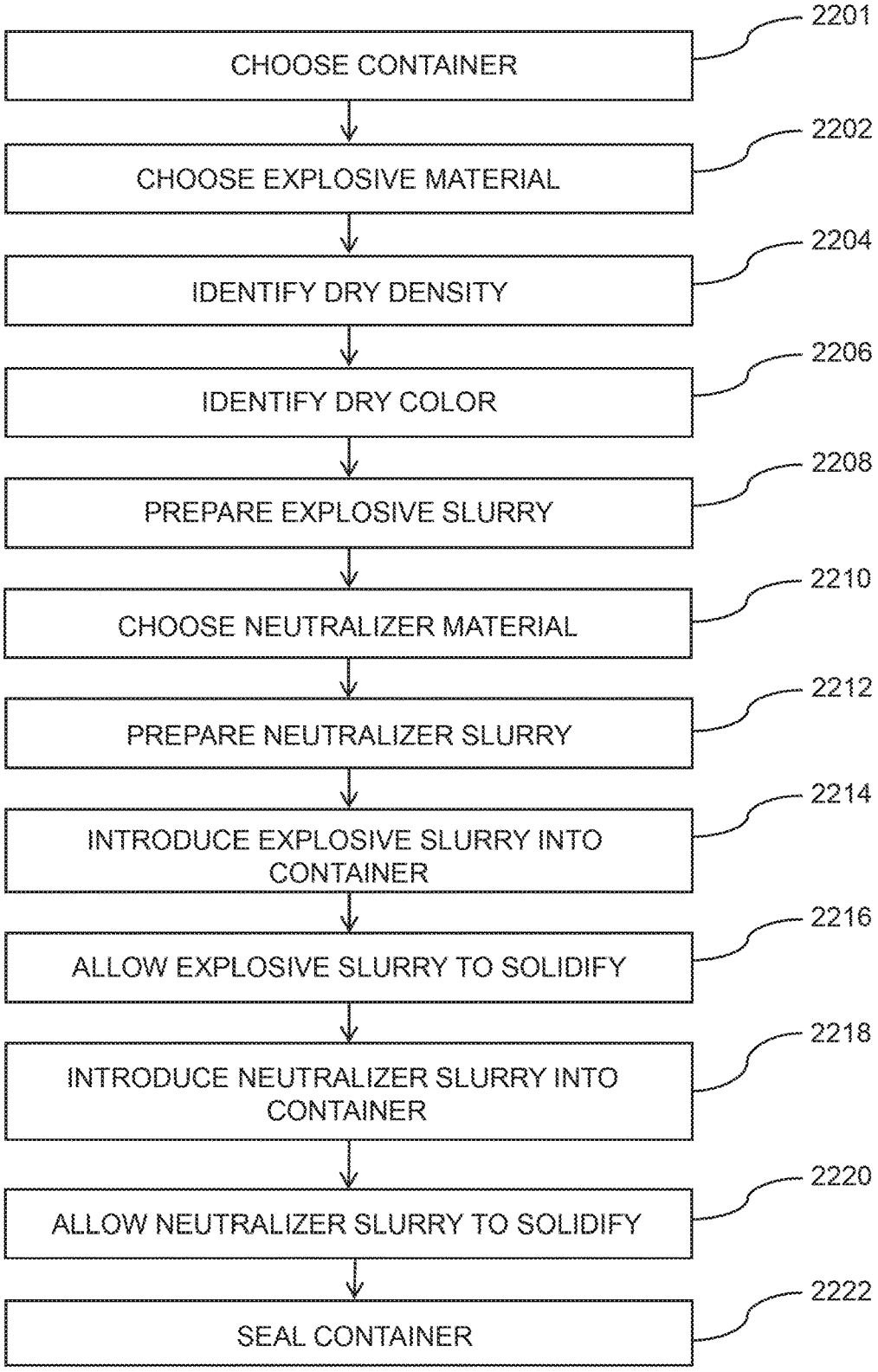
FIG. 22 is a flow chart of the steps for assembly of a preferred embodiment.

Referring to FIG. 22, the steps involved with constructing a preferred embodiment of a pyrotechnic device is shown. At step 2201, an appropriate container is chosen. In one embodiment, the container is formed of a 2-part biodegradable cartridge, sealed with the explosive material inside. At step 2202, an explosive material is chosen. The proper explosive material will be based on its intended use, but may be any previously disclosed or others. At step 2204, the dry density of the explosive material is identified. At step 2206, the color of the dried explosive material is identified. At step 2208, a slurry is prepared from the explosive material and the appropriate solvent or liquid. At step 2210, the neutralizing material with the identified dried density and dried color is chosen. Any of the previously disclosed neutralizing materials or others may be used. At step 2212, the neutralizer slurry is prepared using the appropriate solvent or liquid. At step 2214, the explosive slurry is introduced into the container, as will be further described. At step 2216, a time delay is observed in order to allow the explosive slurry to solidify. At step 2218, the neutralizer slurry is applied to the dry explosive slurry in the container. At step 2220, the neutralizer slurry is allowed to solidify or dry. At step 2222, the container is sealed as will be further described.

Figure 23:
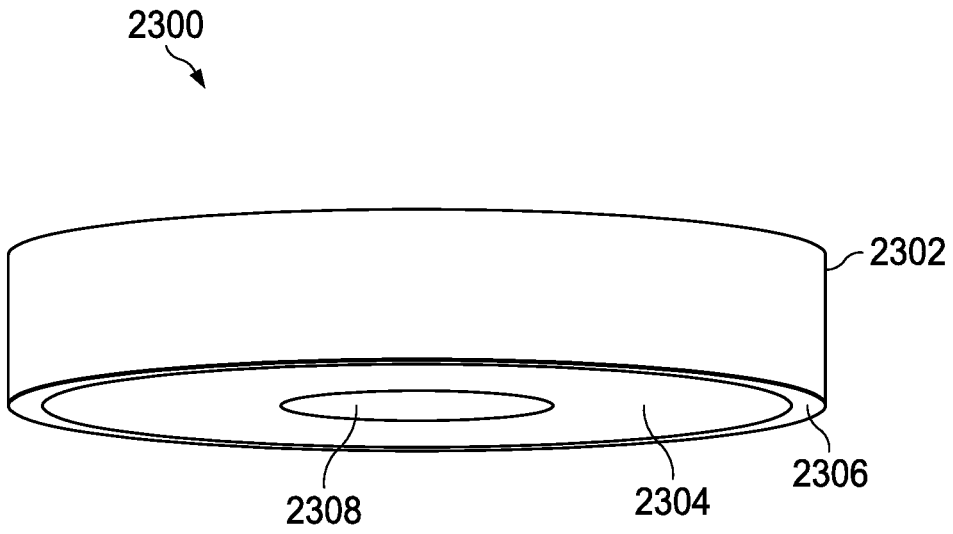
FIG. 23 is a perspective view of a container of a preferred embodiment.
Figure 24:
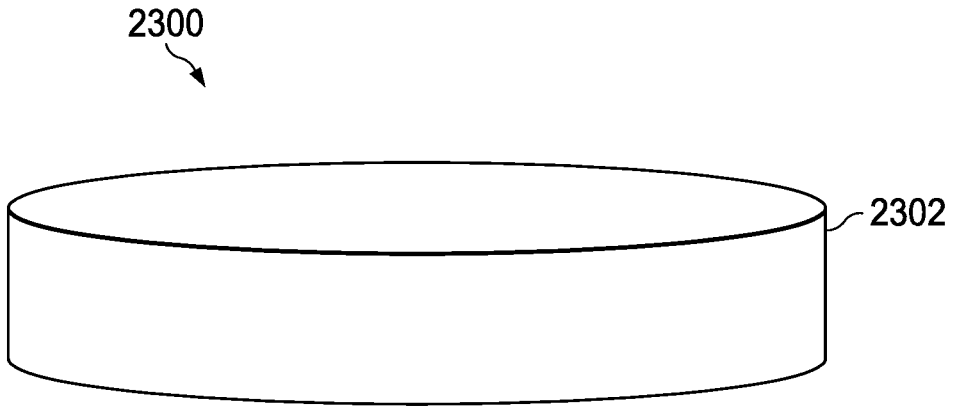
FIG. 24 is a perspective view of a container of a preferred embodiment.

Referring to FIGS. 23 and 24, a preferred embodiment of container 2300 for the explosive material and the neutralizer comprises a generally cylindrical, flat container which is further comprised of top section 2302 and bottom section 2304. The bottom section includes seal 2306 adjacent the top section and the bottom section for sealing the container. Flat adhesive sticker 2308 is applied generally to the center of the bottom section, for affixing the container to a vertical practice surface or a conventional clay target. In a preferred embodiment, the adhesive is a flexible double-sided tape. In a preferred embodiment, the assembled container is about 7 mm in height and about 50 mm in diameter. Manufacturing tolerances for these dimensions can be ±20%.

Figure 25:
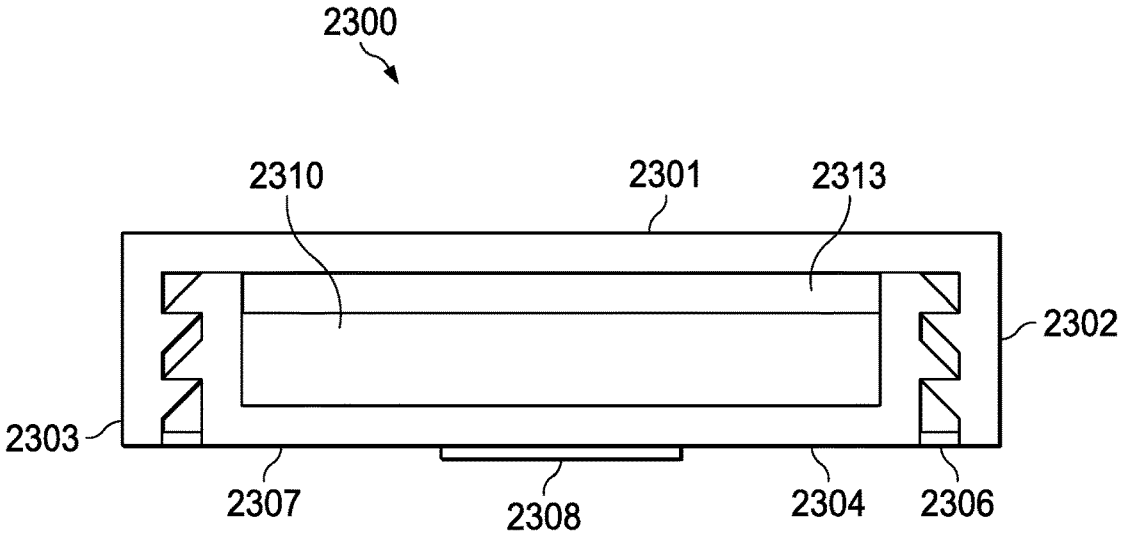
FIG. 25 is a cutaway elevation view of a preferred embodiment of a biodegradable target.
Figure 26:
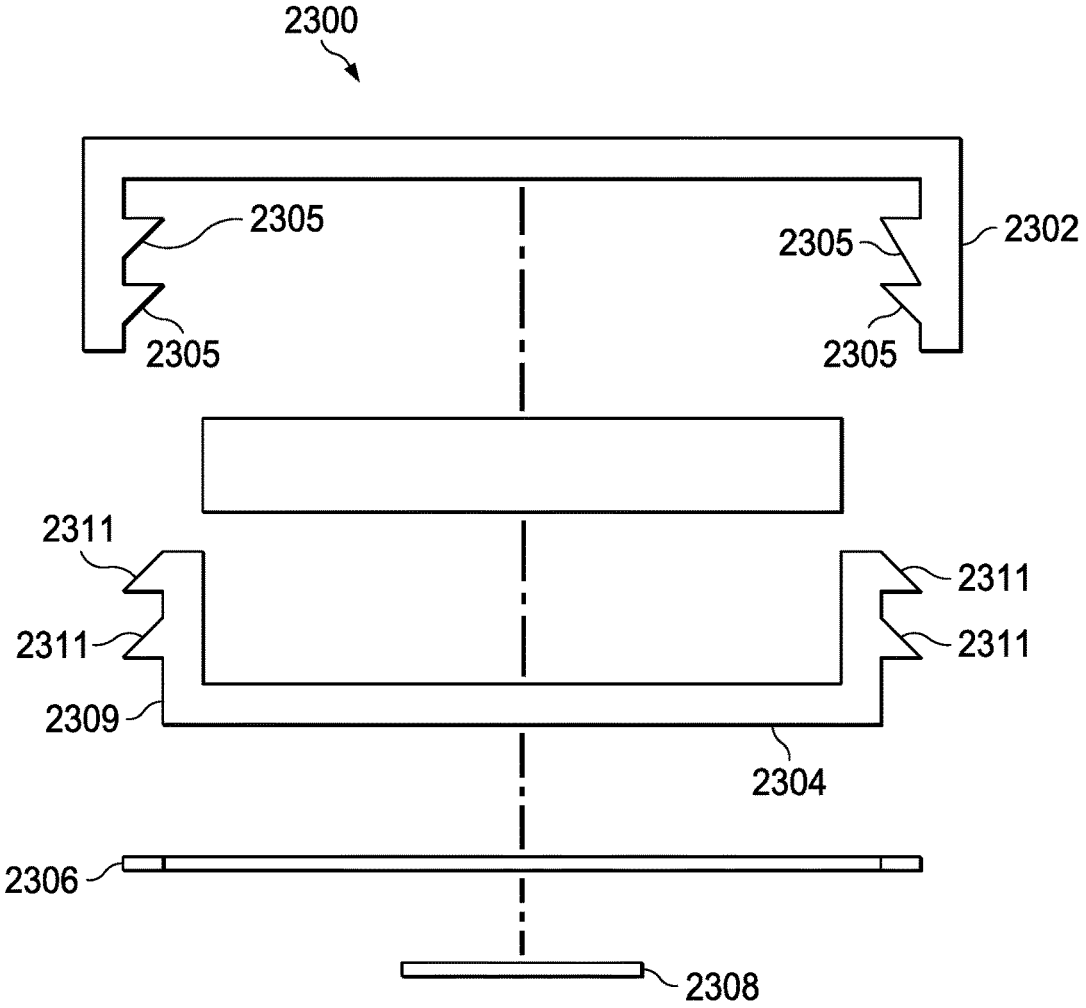
FIG. 26 is an exploded cutaway view of a preferred embodiment of a biodegradable target.

Referring to FIGS. 25 and 26, a cross-sectional view of a preferred embodiment is shown.

From FIG. 25, it can be seen that the top section comprises flat top surface 2301 integrally formed with cylindrical sidewall 2303. Pair of annular inner locking rings 2305 are integrally formed on the interior of the cylindrical sidewall. A greater or lesser number of locking rings can be employed in other embodiments. In a preferred embodiment, the inner locking rings each have an upward facing triangular cross section. Likewise, the bottom section includes generally flat bottom surface 2307 integrally formed with cylindrical sidewall 2309. Pair of annular outer locking rings 2311 are provided on the exterior of cylindrical sidewall 2309. A greater or lesser number of locking rings can be employed. In a preferred embodiment, the outer locking rings each include a downward facing triangular cross section. When assembled, the outer locking rings move past the inner locking rings through an interference fit, and lock the top and bottom into place together as shown in FIG. 25.

As shown in FIG. 25, energetic material 2310 is contained in cavity 2313 formed when the top and bottom are assembled. In a preferred embodiment, during manufacture, the energetic material is deposited in the bottom section in liquid form, as will be further described. In another preferred embodiment, the energetic material includes a neutralizer material deposited on top of the energetic material. Upon drying, the liquid energetic material is bonded inside the cavity. In another preferred embodiment, the energetic material is held in place by a layer of shellac deposited on top of the energetic material during manufacture.

In a preferred embodiment, the energetic material includes an aluminum/titanium flash powder comprising of approximately 70% by weight potassium perchlorate powder, 14% aluminum powder, 8% coarse granules of titanium and 8% flake aluminum flitters.

In another preferred embodiment, the energetic material includes, by weight, 32% charcoal, 48% potassium chlorate, 4% accroid resin, and 16% thiourea. In yet another embodiment, the energetic material comprises, by weight, potassium perchlorate 66%, aluminum powder 28% and accroid resin 6%. Other energetic material as previously described may also be used.

In a preferred embodiment, the neutralizer may be any of these previously described.

In a preferred embodiment, seal 2306 is deposited between the top section and the bottom section to prevent moisture from entering the container and to permanently affix the top section to the bottom section. A preferred adhesive is a biodegradable flexible double-sided tape. Another preferred embodiment, a preferred adhesive is a biodegradable non-toxic glue.

Of particular importance to the invention is the composition of the top section and the bottom section.

In one embodiment, the top section and the bottom section are formed of flexible, semi-rigid biodegradable plastic material. The biodegradable material is metabolized into an organic bio-mass after use. Examples of suitable biodegradable materials are polyhydroxybutyrate (PHB), polyhydroxylalkanoates (PHA), polyacitides, polylactic acid (PLA), and polyvinyl alcohol (PVOH). Other suitable biodegradable materials that may be employed include polyglycolic acid (PGA), polycaprolactone (PCL), polyhydroxyvalerate (PHBV), and polyvinyl acetate (PVAc).

In a preferred embodiment, the top section and the bottom section are formed of a blended plastic, such as a corn starch plastic. Starch/plastic blends that may be used include polyethylene/starch, polyvinyl alcohol (PVA)/starch, PCL/starch, PLA/starch, polybutylene succinate (PBS)/starch, aliphatic-aromatic compounds/starch, and modified polyethylene terephthalate (PET)/starch. In a preferred embodiment, the starch is a thermoplastic starch (TPS), and the plastic is a polymeric molecule of the form of:

$$R_2—[R_1]_n—R_3$$

where $R_2$ and $R_3$ include one or more of the group of:

, $H^+$,$OH^-$, and another $R_1$ where $R_1$ includes one or more of the group of:

$CH_3—O—R_4$ and $O—C_{-Ar}{=}O^-$ where A is an aromatic ring, and where $R_4$ includes one or more of the group of:

$H^+$,$C{=}O^-$, and $CH—R_5—CH_2$ where $R_5$ includes one or more of the group of:

$CH_3^-$ (methyl group) and $CH_2CH_3^-$ (ethyl group)

The following formulas for biodegradable starch base plastics are preferred:

TABLE 6

| | Formula 1 | Formula 2 |
|---|---|---|
| Specific gravity (g/cm3) | 1.096 | 1.05 |
| Shrinkage (in/in) | 0.011 | 0.014 |
| Melt index (g/10 min) | 31.1 | 17.5 |
| Tensile strength (psi) | 4,174 | 3,228 |
| Tensile modulus (psi) | 375,826 | 281,295 |
| Elongation (%) | 2.17 | 4.07 |
| Notched Izod/impact strength (lb/in) | 0.44 | 0.4 |
| Flex strength (psi) | 7,893 | 6,908 |
| Flex modulus (psi) | 330,592 | 255,982 |
| Processing temperature | Rear: 350° F. to 360° F. Middle: 350° F. to 360° F. | Rear: 350° F. to 360° F. Middle: 350° F. to 360° F. |

TABLE 6-continued

| | Formula 1 | Formula 2 |
|---|---|---|
| | Front: 360° F. to 375° F. Nozzle: 360° F. to 375° F. Mold: 60° F. to 170° F. | Front: 360° F. to 375° F. Nozzle: 360° F. to 375° F. Mold: 60° F. to 170° F. |
| Moisture threshold (%) | 0.5 | 0.5 |

The specific gravity of the final formula can be between 1.096 and 1.05 g/cm$^3$. The manufacturing tolerances for each of the characteristics shown in Table 6 is about ±15%

In a preferred embodiment, the biodegradable starch-based plastic is Terratek® SC available from Green Dot Bioplastics.

Another preferred embodiment, the top and bottom sections can both be comprised of a wood composite material, a wood or biological fiber material, or a compressed bird seed and a suitable binder.

In another preferred embodiment, the top and bottom sections can be formed from paper fiber or wood pulp formed with a suitable biodegradable adhesive starch based binder.

In use, the container is affixed to a vertical surface with use of the adhesive. The container is then impacted with an inert object, such as a projectile. The energetics are ignited by the inert projectile and detonate. The resulting detonation destroys the container, which then (typically) falls to the ground. In normal environmental conditions, the biodegradable material dissipates rapidly. In a preferred embodiment, each biodegradable container dissipates to bio-mass in approximately six (6) months to three (3) years from exposure to sunlight and rainfall.

Figure 27A:
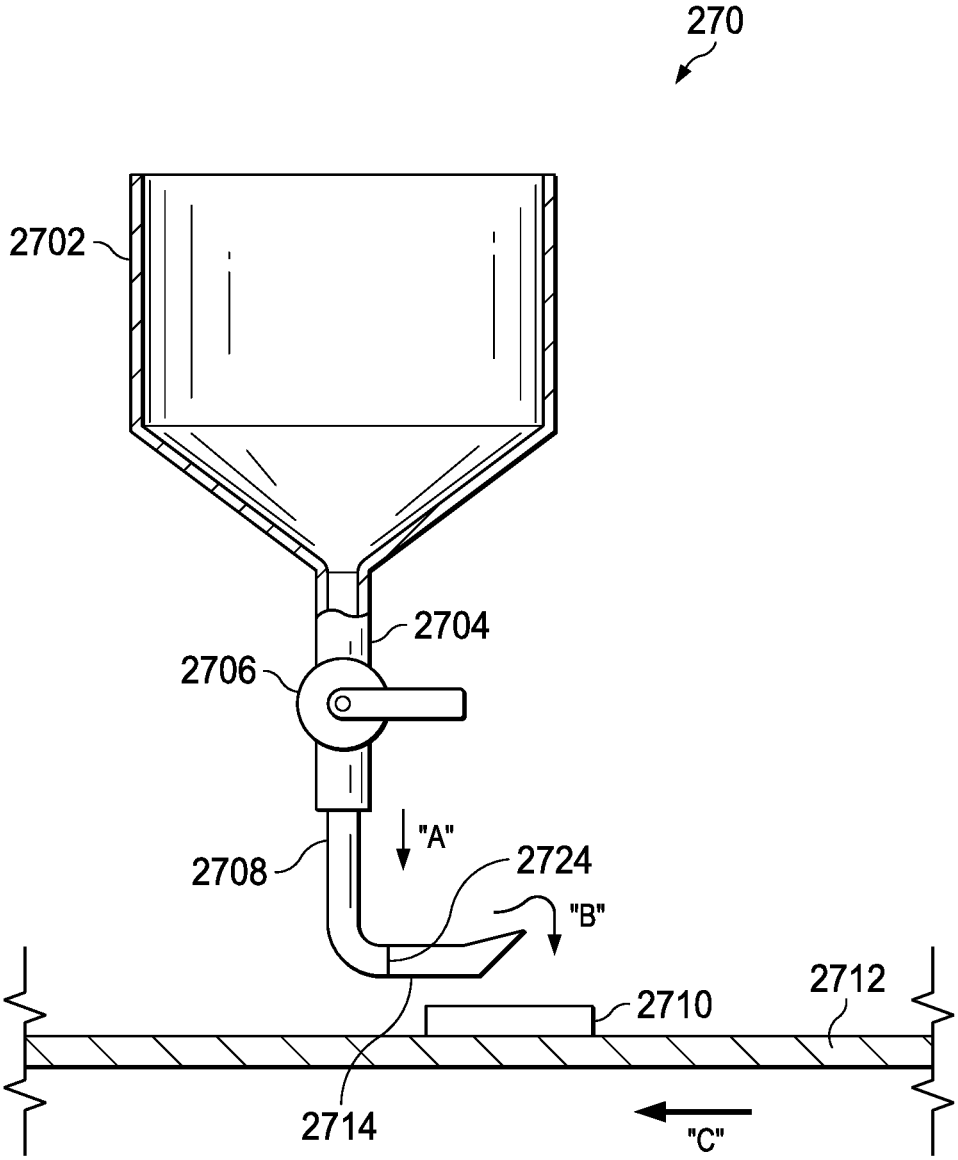
FIG. 27A is an alternate embodiment of an apparatus to be used in deploying liquid materials.

Referring then to FIG. 27A, an apparatus for deposition of a liquid based energetic material and a liquid based neutralizing material will be described as apparatus 270. Apparatus 270 includes tank 2702. Tank 2702 includes outlet 2704 ductedly connected to valve 2706. Valve 2706 controls the flow of material from tank 2702 to deposition tube 2708. The valve can be manually operated, but preferably it is controlled by an electric solenoid in order to precisely meter out the required amount of slurry. Deposition tube 2708 includes outlet 2724. In a preferred embodiment, outlet 2724 is a ¼ inch PBA tube which is bent to connect deposition tube 2708 to cascade spoon 2714, as will be further described. Below cascade spoon 2714 is conveyer belt 2712. In this embodiment, conveyor belt 2712 is configured to move from right to left as shown with the arrow "C". In use, cascade spoon 2714 is positioned directly above container 2710. Container 2710 is, likewise, positioned on conveyor belt 2712. In one embodiment, conveyor belt 2712 is intermittently stopped when container 2710 is in position underneath cascade spoon 2714. In another embodiment, the container is held in place by a robotic arm across the conveyor belt (not shown). In another embodiment, the conveyor belt is substantially slowed during deposition of the slurry, but is not stopped. Container 2710, in a preferred embodiment can be container 2300.

Figure 27B:
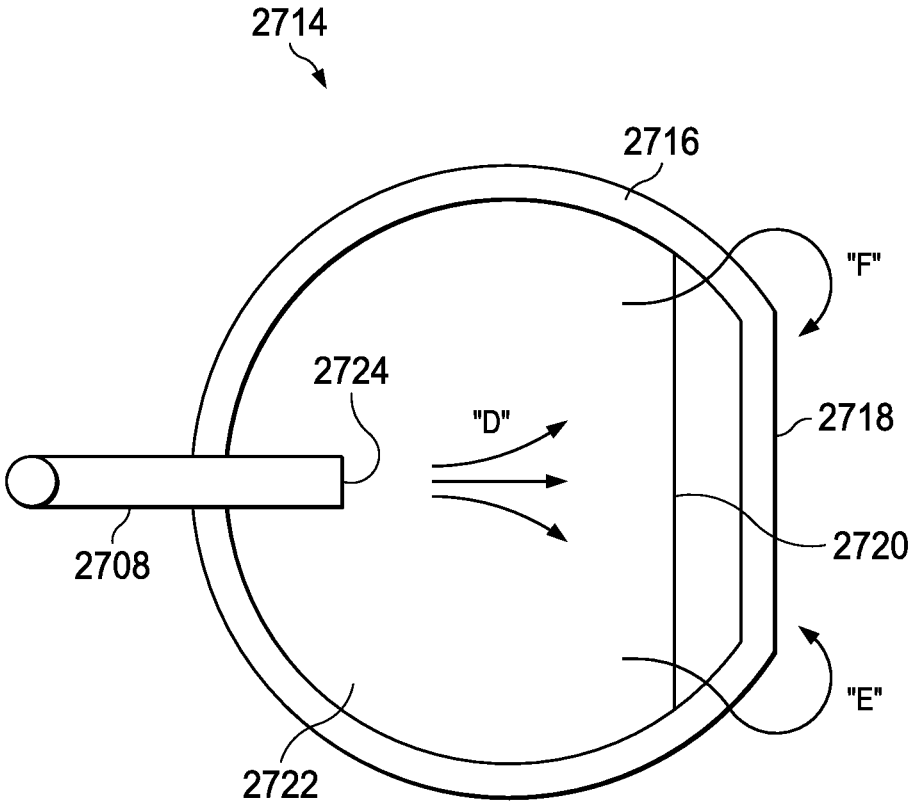
FIG. 27B is an alternate embodiment of an apparatus to be used in deploying liquid materials.

Referring then to FIG. 27B, the structure of cascade spoon 2714 will be described. Cascade spoon 2714 includes a generally flat cylindrical disk including base 2722 and edge wall 2716. Vertical lip 2718 is formed in edge wall 2716. Likewise bend line 2720 formed in base 2722 to accommodate the upward slope in vertical lip 2718. In a preferred embodiment, vertical lip 2718 is formed out of edge wall 2716.

In use, liquid material disposed in tank 2702 flows through outlet 2704, where upon valve 2706 is opened. The liquid material flows then through deposition tube 2708 and out of outlet 2724 into base 2722, as shown by direction arrow "A" of FIG. 27A. The liquid material then flows into base 2722 as shown by arrow "D" and then out of base 2722, over edge wall 2716 and bypassing vertical lip 2718 as shown in direction arrows "E" and "F". Finally, the liquid material runs into container 2710 from left to right, as shown in arrow "B" of FIG. 27A.

The deposition of liquid material as shown in FIGS. 27A and 27B has a surprising result of creating a smooth surface on the slurry, upon drying in container 2710. The smooth surface of the dried material is important to create a uniform reaction when the energetic material is energized with the projectile.

In different manufacturing arrangements a single deposition apparatus 270 can be employed to deposit both the energetic material and the neutralizer material. It is cleaned between uses. Alternatively, two identical sets of apparatus 270 can be used above the same or different conveyor belts to speed production of the finished devices.

An interior surface of a bottom section of a preferred embodiment of a biodegradable target can have recesses that function to receive and hold localized concentrations of energetic material. The concentrations of energetic material in the recesses can be isolated from one another or integrally formed, depending on the amount of energetic material that is dispensed into the container. In either of these two embodiments, the energetic material is covered with an overlying layer of neutralizer to prevent misuse of the energetic material. Upon impact, ignition and detonation, the concentrations of energetic material impart localized increased velocity to reactants from the energetic material. These localized increases in velocity are unexpectedly useful to generate observable optical effects, especially at medium to long shooting ranges.

When an impact from a projectile causes mass detonation of the energetic material, a deflagration wave propagates outward from the recesses and from the surrounding planar surface of the bottom section of the container. There is a relative increase in the amount of energetic material in the volumes defined by the recesses. The increased amount of energetic material, when detonated, causes a change in the profile of the resulting deflagration wave, which would otherwise be planar. The modified deflagration wave profile demonstrates higher velocity in the vicinity of each recess. The higher velocities serve to focus the wave into useful shapes. In one embodiment, a bell-shaped distribution results in a more focused flash of light downrange. Hence, the detonation of the target can be seen at greater distances.

The recesses and their corresponding concentrations can be located and arranged in defined patterns. In general, the recesses can take the form of wells, dimples, grooves, rings, pans or any other shape(s) that function to hold a localized concentration of energetic material to provide the result of a localized increase in velocity of the deflagration wave.

Figure 28B:
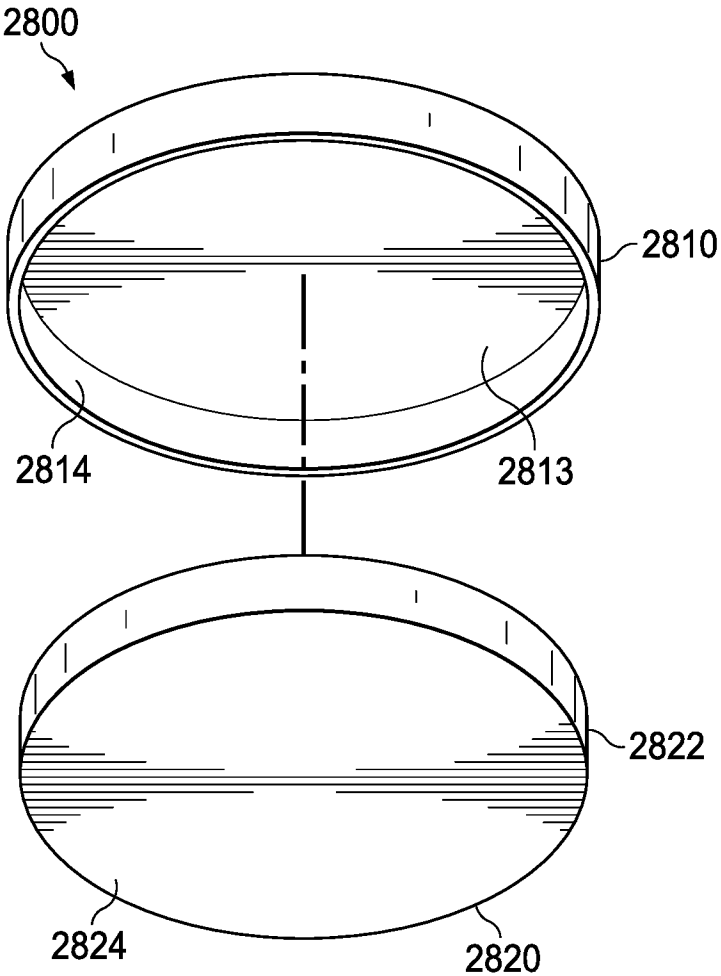
FIGS. 28A and 28B are exploded isometric views of a container of a preferred embodiment.
Figure 28A:
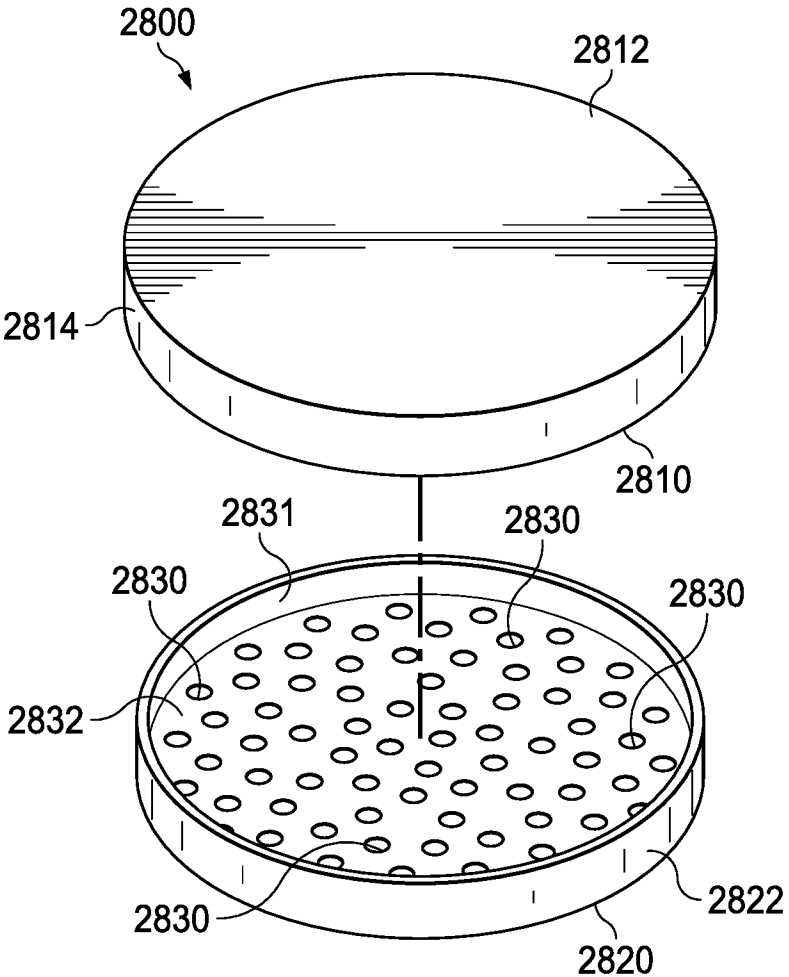

Referring to FIGS. 28A and 28B, an exploded view of a preferred embodiment of target container 2800 will be described. Target container 2800 includes target top section 2810 and bottom section 2820. Top section 2810 is a generally hollow cylinder with closed top 2812, cylindrical sidewall 2814, and open bottom 2813. Bottom section 2820 comprises a generally hollow cylinder with an open top 2831, cylindrical sidewall 2822, and closed bottom 2824. Bottom section 2820 comprises plurality of recesses 2830 and surrounding planar surface 2832. In this embodiment, the recesses are cylindrical and are randomly distributed across the planar surface of the bottom section. The top and bottom sections are joined together during manufacture and contain an energetic material and concealed amalgamated neutralizer, as will be further described.

Figure 29A:
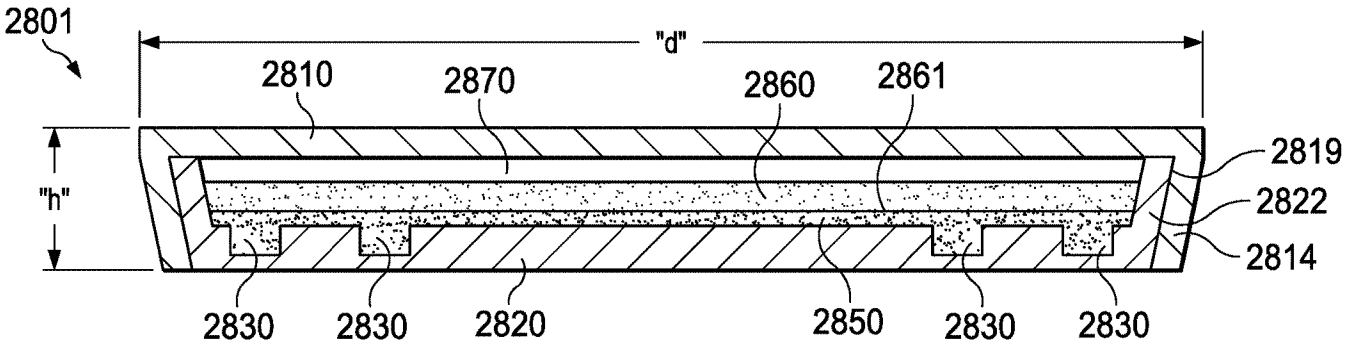
FIG. 29A is a cutaway view of a preferred embodiment of a target.

Referring to FIG. 29A, a cutaway view of a preferred embodiment of target 2801, including target container 2800 is shown. Top section 2810 overlaps bottom section 2820 at mechanical interface 2819 with a mechanical interference fit. Generally cylindrical sidewall 2814 is engaged with cylindrical sidewall 2822 in a locking relationship at the mechanical interface, as will be further described. Energetic material 2850 is positioned in bottom section 2820 and in plurality of recesses 2830. In one preferred embodiment, directly adjacent energetic material 2850 is concealed amalgamated neutralizer 2860. An undetectable interface 2861 exists between the energetic material and the concealed amalgamated neutralizer, as has been previously described. In another preferred embodiment, the concealed amalgamated neutralizer is not present. Air gap 2870 is positioned between the neutralizer and/or the energetic material and the bottom side of top section 2810. The diameter "d" of the target in a preferred embodiment, is approximately 52.2 mm. Height "h" of the target in a preferred embodiment, is approximately 6.5 mm. Other dimensions will suffice. However, it is preferable that the target appear relatively flat to the shooter.

Figure 29B:
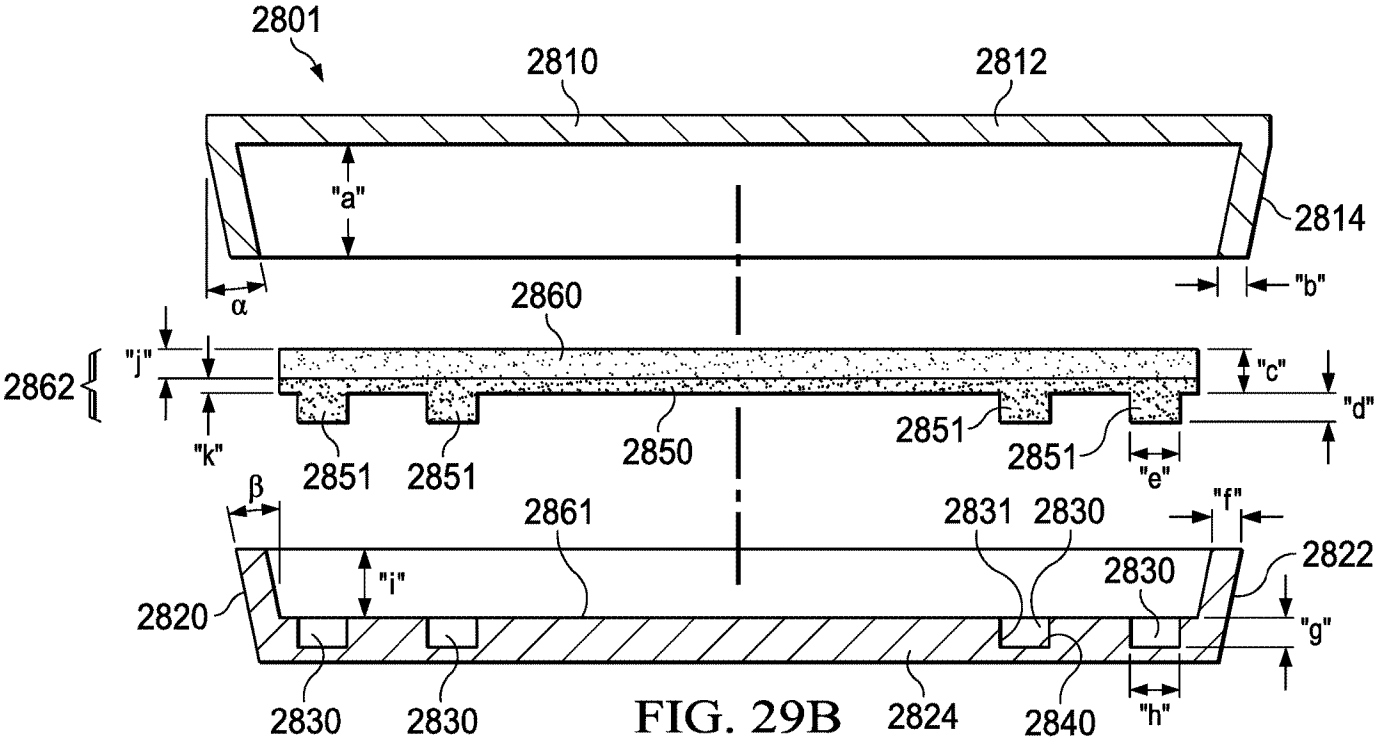
FIG. 29B is an exploded cutaway view of the preferred embodiment of a target.

Referring to FIG. 29B, an exploded view of target 2801 is shown. Top section 2810 includes cylindrical sidewall 2814 and closed top 2812. Cylindrical sidewall 2814 includes a concave truncated frustocone with a wall angle $\alpha$ of approximately 5° from vertical. Cylindrical sidewall 2814 includes a height "a" of 5.3 mm and a nominal thickness "b" of 1.5 mm. Tolerances on all dimensions are ±5%.

Bottom section 2820, includes cylindrical sidewall 2822 and closed bottom 2824. Cylindrical sidewall 2822, in a preferred embodiment, is formed as a convex truncated frustocone sized to fit within cylindrical sidewall 2814. The height "i" of cylindrical sidewall 2822 is approximately 3.5 mm. The nominal thickness "f" of cylindrical sidewall 2822 is approximately 1.5 mm. The cylindrical sidewall forms an angle $\beta$ of approximately 5° from vertical. Each of plurality of recesses 2830 comprises a cylindrical shape having vertical sidewall 2831 and flat bottom 2840. In this embodiment, the depth "g" of each of plurality of recesses 2830 is approximately 1.6 mm. However, the depth of the recesses can range between about 1 mm and about 2 mm, as will be further described. The diameter "h" of each of plurality of recesses 2830 is approximately 2.2 mm. Tolerances on all dimensions are ±5%.

In another preferred embodiment, the top section may include a convex truncated frustoconical sidewall and the bottom section may include a concave truncated frustoconical sidewall. In this embodiment, when the target is assembled the bottom section sidewall overlaps the top section sidewall in an interference fit, as previously described.

Charge 2862 comprises concealed amalgamated neutralizer 2860 joined with energetic material 2850. Energetic material 2850 further comprises plurality of cylindrical projections 2851. In a preferred embodiment, each of plurality of cylindrical projections 2851 are adapted to fit in a corresponding recess in bottom section 2820. Each of plurality of cylindrical projections 2851 has a height "d" of approximately 1.6 mm. Each of the cylindrical projections has a width "e" of approximately 2.2 mm. Concealed amalgamated neutralizer 2860 is typically approximately 2.5 mm in height "j". Energetic material 2850 typically includes a height "k" of approximately 1.0 mm above planar surface 2832. Height "j" of concealed amalgamated neutralizer 2860 and height "k" together equal height "c" above planar surface 2832, which is approximately 3.5 mm. In a preferred embodiment, the volume of energetic material is approximately equal to the volume of concealed amalgamated neutralizer. However, in other embodiments the ratio of these volumes may be different.

When assembled, cylindrical sidewall 2814 of top section 2810 forms a mechanical interference fit with cylindrical sidewall 2822 of bottom section 2820. A suitable adhesive can also be used along the mechanical interface to create an airtight seal.

Figure 30:
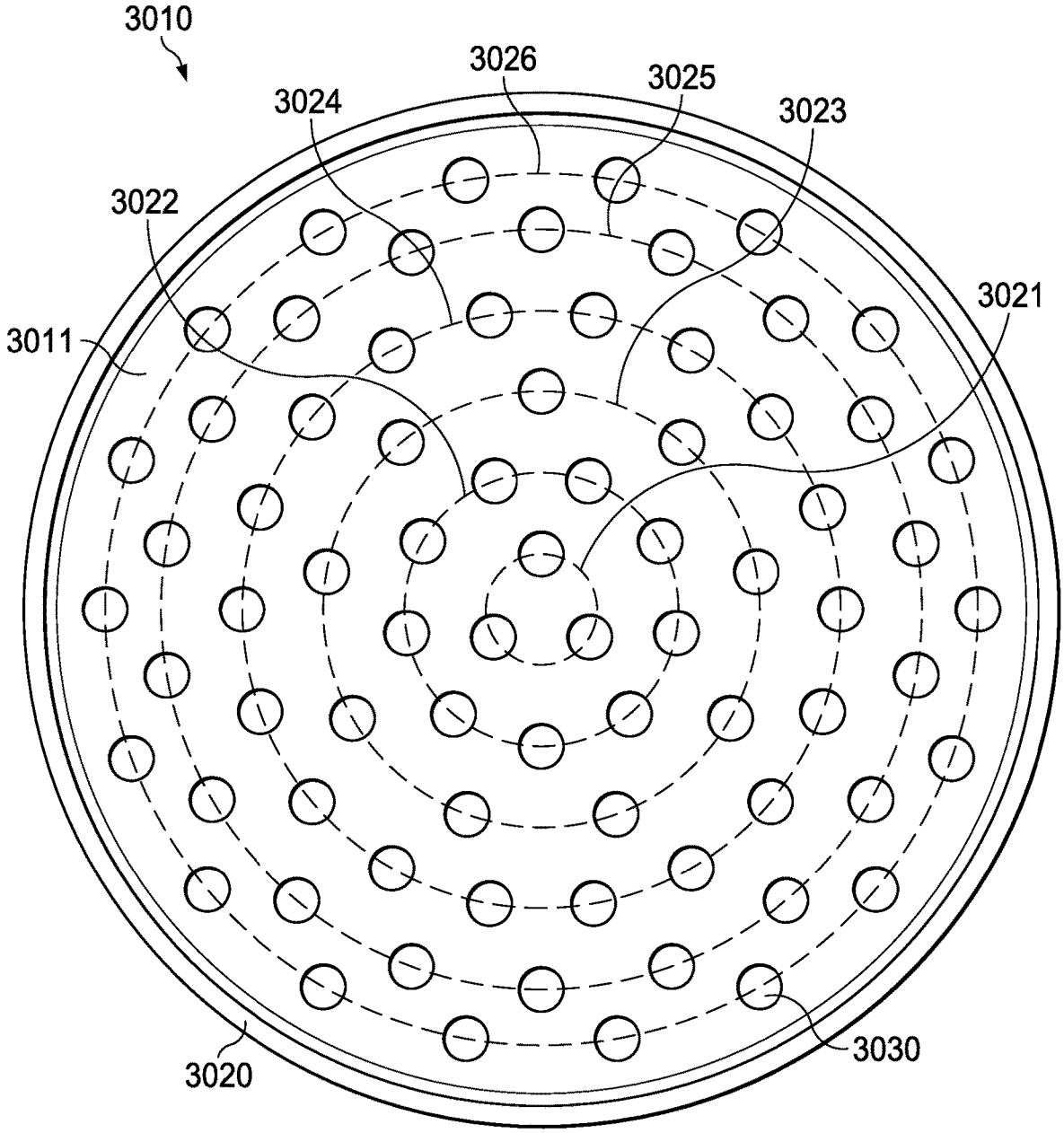
FIG. 30 is a view of a preferred embodiment of a bottom section.

Referring to FIG. 30, a preferred embodiment of bottom section 3010 is shown. Bottom section 3010 includes cylindrical sidewall 3020 and planar surface 3011. The cylindrical sidewall includes an outwardly flared frustoconical shape, as previously described. A plurality of recesses 3030 reside in planar surface 3011. In this embodiment, the recesses are cylindrical and are arranged in six (6) equally spaced concentric rings, ring 3021, 3022, 3023, 3024, 3025, and 3026. Ring 3021 comprises three (3) recesses arranged in a 5.5 mm diameter circle. Ring 3022 comprises nine (9) recesses arranged in a 13.5 mm diameter circle. Ring 3023 comprises nine (9) recesses arranged in a 21.5 mm diameter circle. Ring 3024 comprises 18 recesses arranged in a 29.5 mm diameter circle. Ring 3025 comprises 18 recesses arranged in a 37.5 mm diameter circle. Ring 3026 comprises 18 recesses arranged in a 43.0 mm diameter circle. Plurality of recesses 3030 are vertical-sidewall flat-bottom recesses. In a preferred embodiment, bottom section 3010 has 75 recesses, and each recess is 1.6 mm deep. The recesses define high velocity points during detonation of the energetic material. The high velocity points organize the detonation flash into a linearized pattern which is generally perpendicular to the planar surface and which is directed axially down range away from the target. This linearized pattern provides the surprising result of extending the visibility of the target down range by an estimated 40%.

Figure 31A:
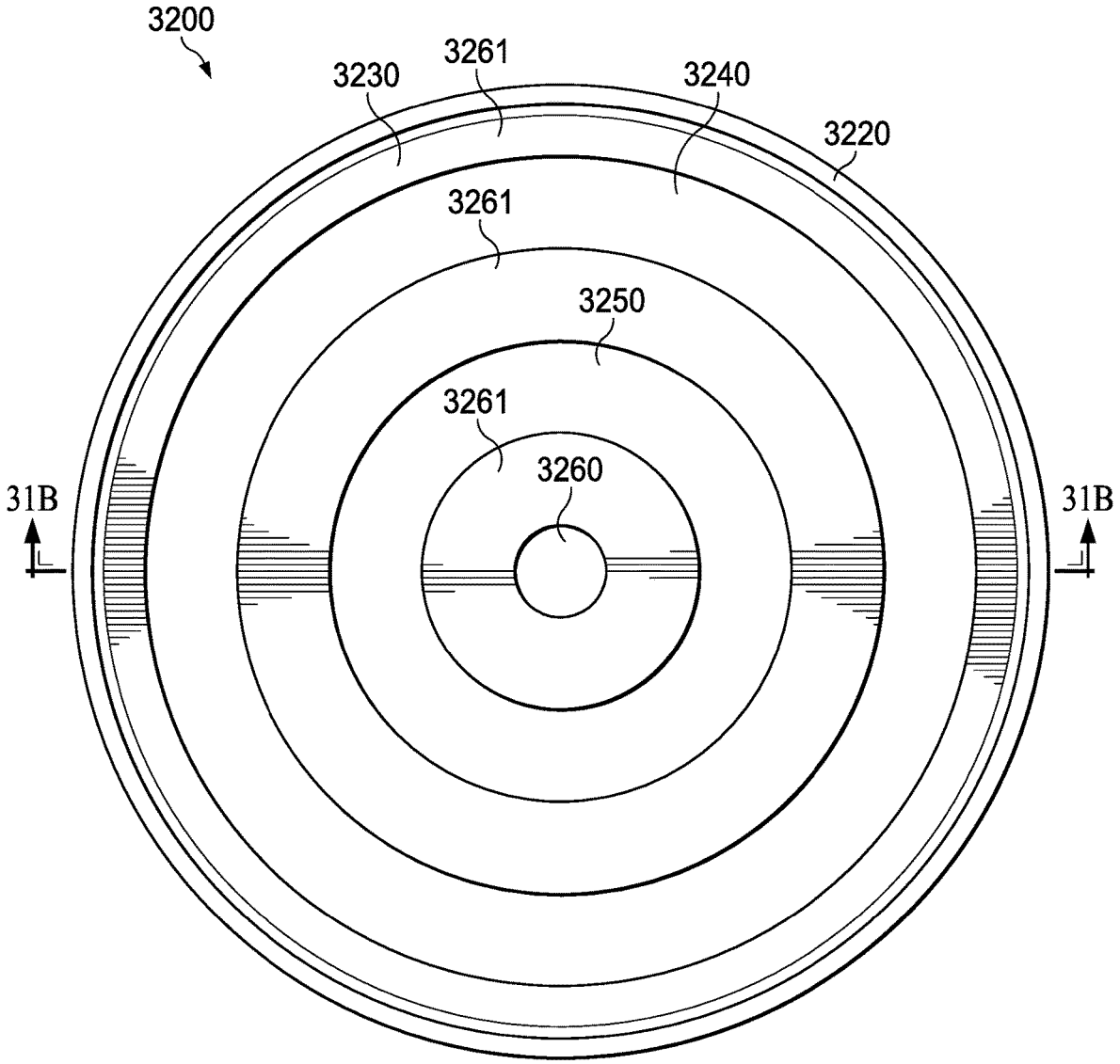
FIG. 31A is a plan view of a preferred embodiment of a bottom section.
Figure 31B:
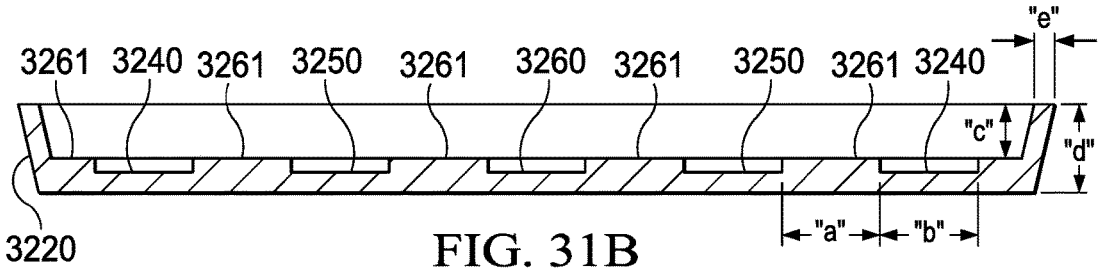
FIG. 31B is a section view of a preferred embodiment a bottom section.

Referring to FIGS. 31A and 31B, a preferred embodiment of bottom section 3200 is shown. Bottom section 3200 includes cylindrical sidewall 3220 and base 3230. The cylindrical sidewall includes an outwardly flared frustoconical shape, as previously described. Base 3230 comprises outer groove recess 3240, middle groove recess 3250, inner groove recess 3260 and planar surface 3261. The width "a" of each planar surface is approximately 5 mm. The width "b" of each of the grooves is approximately 5 mm. The interior height "c" of cylindrical sidewall 3220 is approximately 2.9 mm. The exterior height "d" of cylindrical sidewall 3220 is approximately 6.0 mm. The normal thickness "e" of cylindrical sidewall 3220 is approximately 1 mm. Upon detonation, the reactants from the energetic material in the circular grooves define a cylindrically polarized velocity pattern. Cylindrical polarization is useful to project light and sound resulting from detonation further along an axial path than would otherwise occur.

Figure 32A:
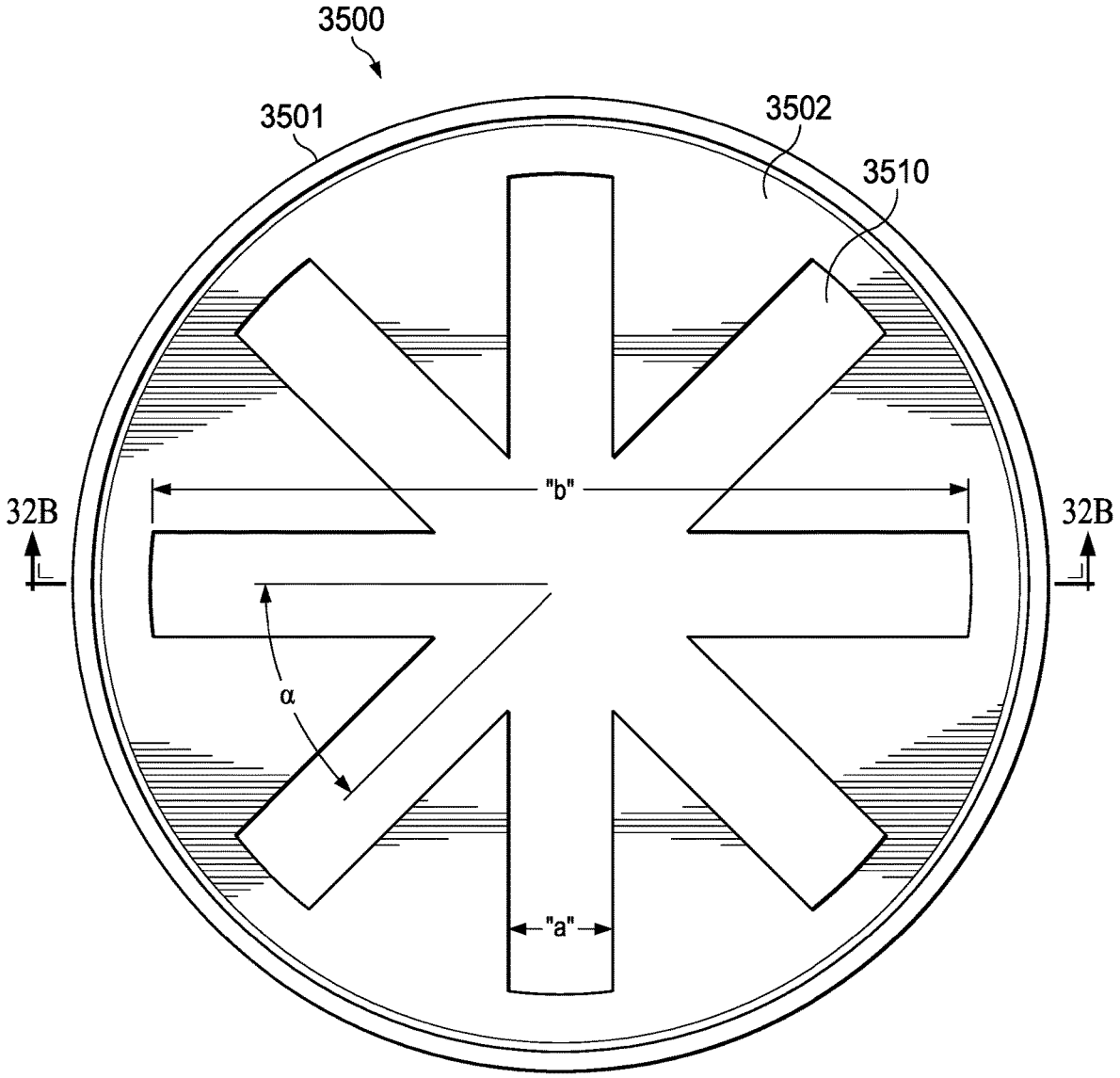
FIG. 32A is a plan view of a preferred embodiment of a bottom section.
Figure 32B:
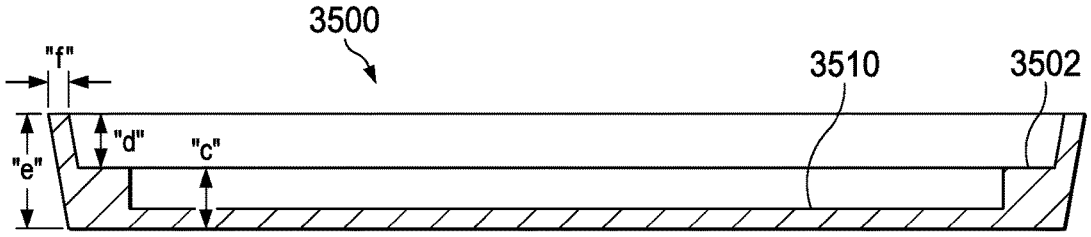
FIG. 32B is a section view of a preferred embodiment of a bottom section.

Referring to FIGS. 32A and 32B, a preferred embodiment of bottom section 3500 is shown. Bottom section 3500 includes cylindrical sidewall 3501, planar surface 3502 and radial indention 3510. The cylindrical sidewall includes an outwardly flared frustoconical shape, as previously described. Radial indention 3510 comprises four linear indentions that intersect at their midpoints to form a central octagon. The width "a" of each linear indention is approximately 5 mm. The length "b" of each of the linear indentions is approximately 45 mm. The angle "α" alpha between the linear indentions is approximately 45°. The height "c" of the planar surface is approximately 2.8 mm. The interior height "d" of the cylindrical sidewall above the planar surface is approximately 2.5 mm. The exterior height "e" of the cylindrical sidewall is approximately 6.0 mm. The nominal width "f" of cylindrical sidewall 3501 is approximately 1.5 mm. Other numbers of radial indentions are possible and useful. Other widths of radial indentions are also possible and useful.

In this embodiment, the recesses define a centrally converging average detonation wave guiding pattern. The velocity of the detonation wave will be amplified in those areas above the radial indentions. The amplification increases toward the center radial pattern while the average detonation wave will be relatively attenuated in those areas more distant from the center of the radial pattern. As a result, the energetic material in the radial pattern of the radial indentions gives rise to a centrally converging flash upon detonation which is "star shaped" visible at vastly improved distances down range.

Figure 33A:
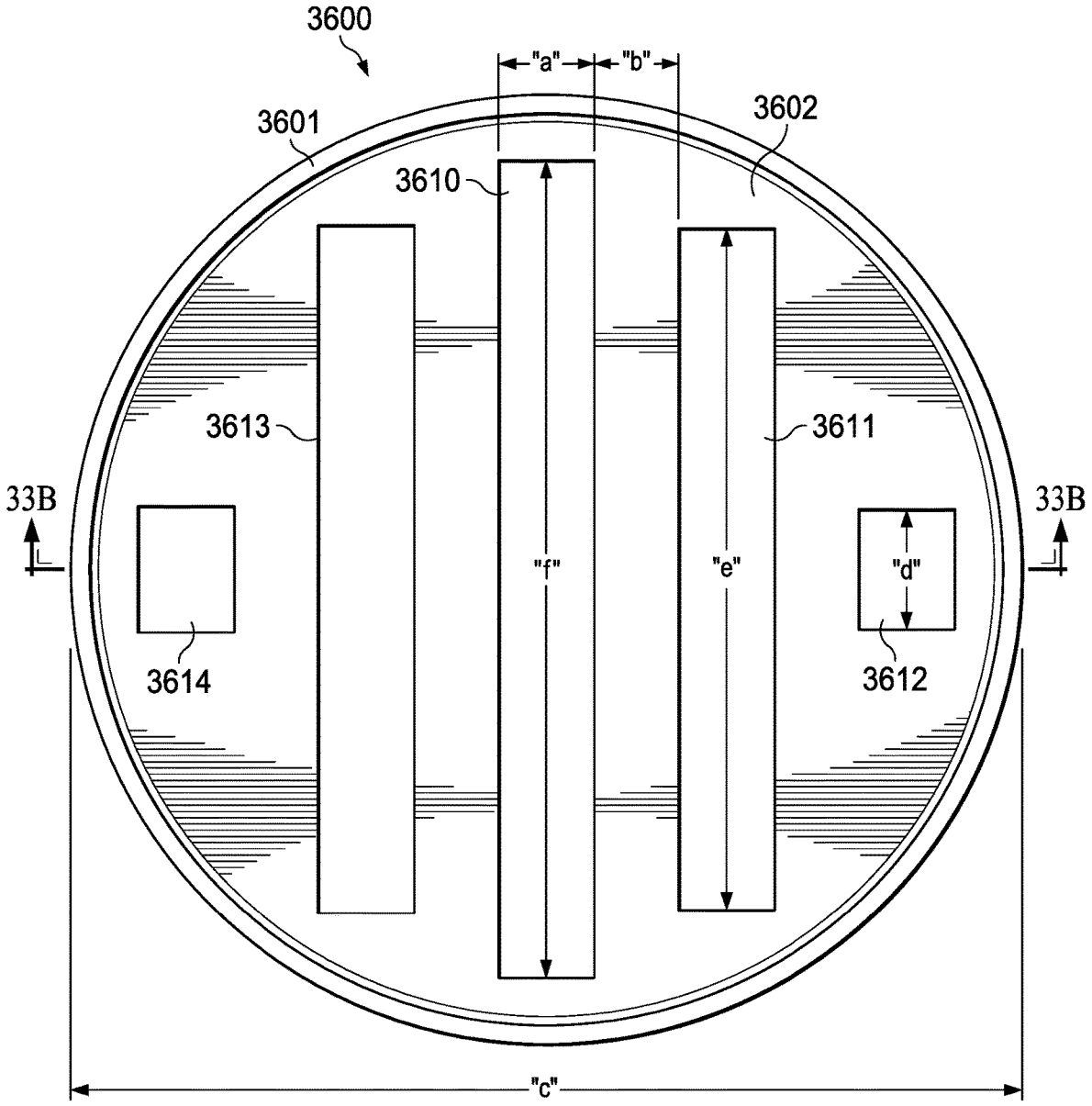
FIG. 33A is a plan view of a preferred embodiment of a bottom section.
Figure 33B:
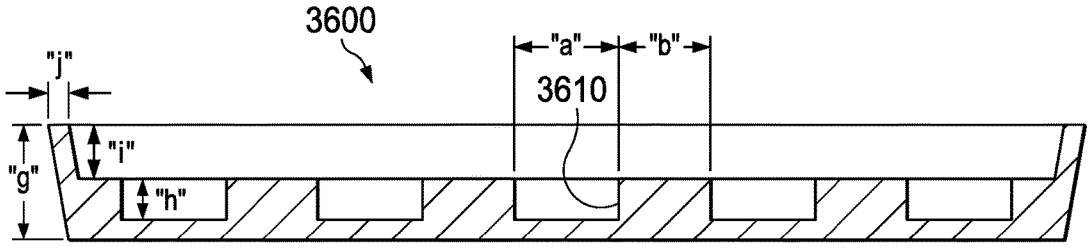
FIG. 33B is a section view of a preferred embodiment of a bottom section.

Referring to FIGS. 33A and 33B, a preferred embodiment of bottom section 3600 is shown. Bottom section 3600 includes cylindrical sidewall 3601 and planar surface 3602. The cylindrical sidewall includes an outwardly flared frustoconical shape, as previously described. Bottom section 3600 further comprises a plurality of grooves arranged in a parallel pattern. The plurality of grooves comprise five (5) grooves, groove 3610, 3611, 3612, 3613 and 3614 that are generally parallel. The width "a" of each of the grooves is approximately 5 mm. The width "b" between each of the grooves is approximately 5 mm. The width "c" of bottom section 3600 is approximately 53 mm. The length "d" grooves 3612 and 3614 is approximately 5 mm. The length "e" of grooves 3611 and 3613 is approximately 30 mm. The length "f" of groove 3610 is approximately 40 mm. The depth "h" to each of the grooves is approximately 2.8 mm. Other numbers and dimensions of parallel groves are possible. The interior height "i" of the cylindrical sidewall above the planar surface is approximately 2.5 mm. The exterior height "g" of the cylindrical sidewall is approximately 6.0 mm. The nominal width "j" of cylindrical sidewall 3601 is approximately 1 mm.

In this embodiment, the average detonation wave will be amplified in those areas that are above the parallel grooves and relatively attenuated in those areas that are not above the parallel grooves. Hence, the energetic material in the parallel groves, when detonated, defines an average detonation wave pattern that is polarized.

In use, this target embodiment can be oriented with the grooves perpendicular to the horizontal, such that the resulting planar polarized flash is perpendicular, or 90°, to the horizon. The planar polarized flash lessens the effect of polarizing lenses of field shooting glasses and polarizing filters on camera lenses. As a result, the polarized flash increases visibility of the detonation to shooters wearing polarized shooting glasses. Also, the polarization of the flash increases contrast in the resulting photographic or video images when taken with camera lenses fitted with polarizing filters. The target can be oriented at angles other than 90° to the horizon to attenuate the flash to polarized lenses to varying degrees. For example, an orientation angle of 45° to the horizontal will attenuate approximately half of the flash intensity to a typical horizontally polarized filter.

Figure 34B:
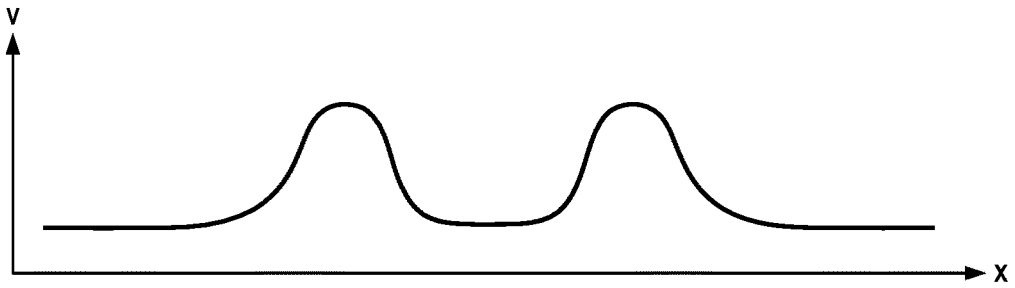
FIG. 34B is a graph of the relative velocities of reactants from energetic material that is detonated in the recesses.
Figure 34A:
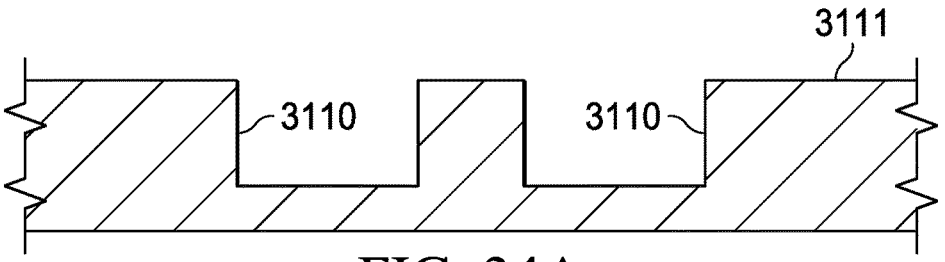
FIG. 34A is a schematic cross sectional view of a preferred embodiment of recesses.

Referring to FIGS. 34A and 34B, relative velocities of the deflagration wave for various alternative cross-sectional shapes of recesses are shown. The varying shapes and distributions of the recesses serve to vary the optical effect of the target detonation down range.

Referring to FIG. 34A, a set of two (2) vertical sidewall cylindrical flat bottom recesses 3110 are shown adjacent planar surface 3111. Referring to FIG. 34B, the relative increase in velocity of the reactants upon detonation is shown on the "y" axis. The distance along the cross-section axis of the recess is shown on the "x" axis. In this example, it can be seen that there is a relatively large increase in velocity in areas corresponding to the recesses where there is only a moderate increase in velocity in areas corresponding to the planar surface. The velocity distribution demonstrates an average aspect ratio "bell-shaped" curve above each recess. "Aspect ratio" here means the height versus the width of the velocity curve.

Figure 35B:
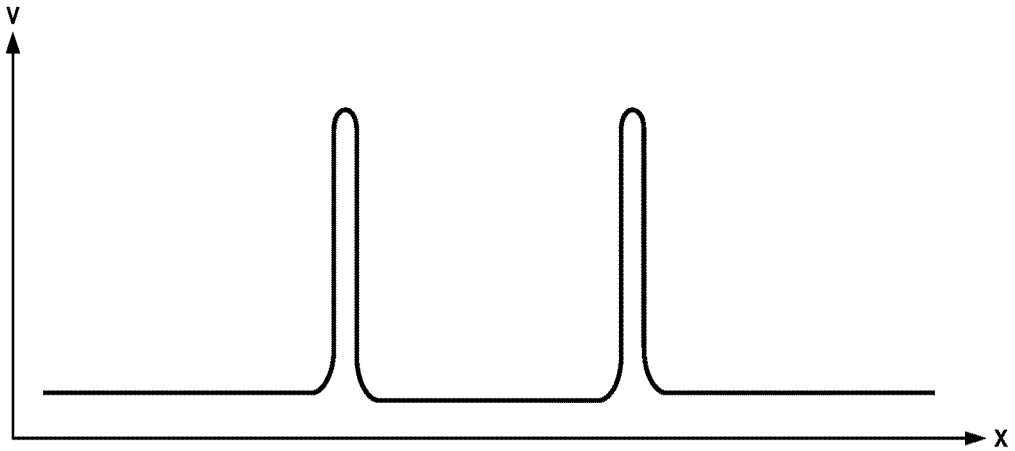
FIG. 35B is a graph of the relative velocities of reactants from energetic material that is detonated in the recesses.
Figure 35A:
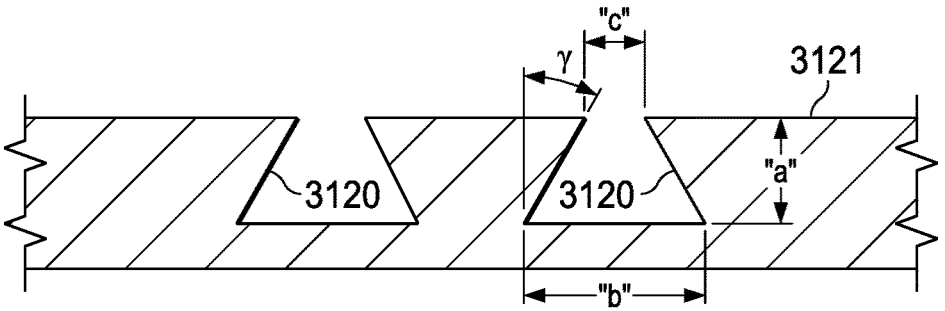
FIG. 35A is a schematic cross sectional view of a preferred embodiment of recesses.

Referring to FIG. 35A, a set of two (2) converging frustoconical recesses 3120 are shown in cross-section adjacent planar surface 3121. The depth "a" of converging frustoconical recesses 3120 is approximately 2 mm. The base diameter "b" of converging frustoconical recesses 3120 is approximately 2 mm. The upper diameter "c" of converging frustoconical recesses 3120 is approximately 1 mm. Angle γ is approximately 30°. Assuming a uniform distribution of energetic material in each of the recesses and on the planar surface, a graph of relative reactant velocities upon detonation is shown in FIG. 34B. The velocity of the reactant in areas corresponding to the frustoconical recess shows a heightened increase as compared to only a moderate increase in velocity with respect to the planar surface. The velocity distribution demonstrates an extreme aspect ratio. The result is a highly linearized flash which is capable of being seen at great distance but that has a relatively narrow viewing angle.

Figure 36B:
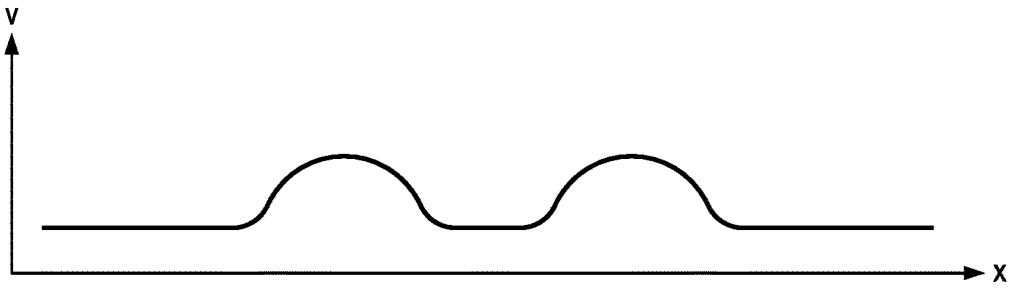
FIG. 36B is a graph of the relative velocities of reactants from energetic material that is detonated in the recesses.
Figure 36A:
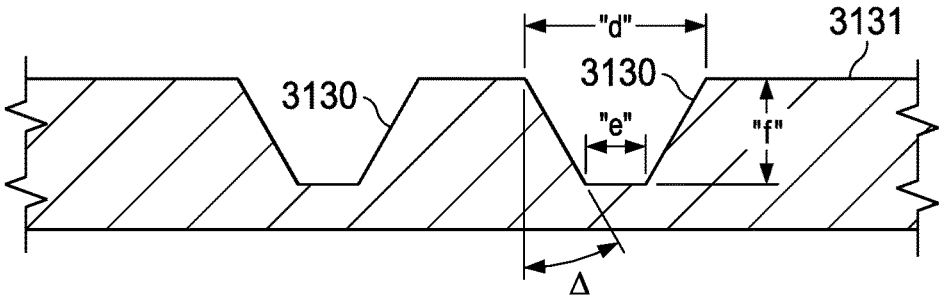
FIG. 36A is a schematic cross sectional view of a preferred embodiment of recesses.

Referring to FIGS. 36A and 36B, two diverging frustoconical recesses 3130 are shown adjacent planar surface 3131. The depth "f" of diverging frustoconical recesses 3130 is approximately 2 mm. The base diameter "e" of diverging frustoconical recesses 3130 is approximately 1 mm. The upper diameter "d" of diverging frustoconical recesses 3130 is approximately 2 mm. Angle A is approximately 30°. Assuming a uniform distribution of energetic material in each of the recesses and on the planar surface, a graph of relative reactant velocities upon detonation is shown in FIG. 36B. FIG. 36B shows a relatively low increase in velocity corresponding to each of the recesses as compared to a moderate increase in velocity with respect to the planar surface. The velocity distribution exhibits a low aspect ratio. This embodiment provides a less focused detonation visible over a wider viewing angle but not as far downrange.

Figure 37B:
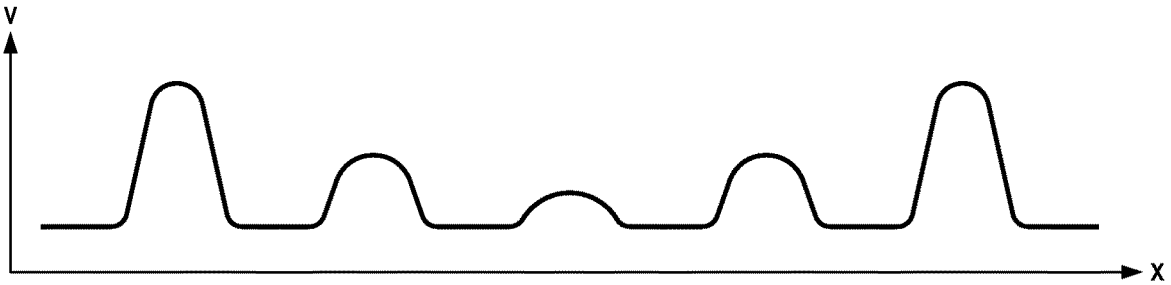
FIG. 37B is a graph of the relative velocities of reactants from energetic material that is detonated in the recesses.
Figure 37A:
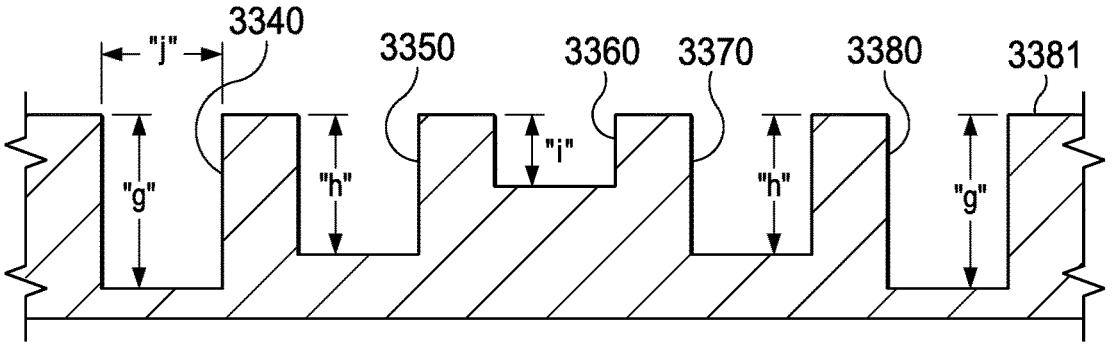
FIG. 37A is a schematic cross sectional view of a preferred embodiment of recesses.

Referring to FIGS. 37A and 37B, a set of five (5) cylindrical recesses 3340, 3350, 3360, 3370 and 3380 are shown, adjacent planar surface 3381. In this embodiment, each of the recesses has a generally uniform width but varies in depth from a lower depth at a central position to a higher depth at peripheral positions. Various depth profiles are possible. In a preferred embodiment, width "j" is about 3 mm. Widths between 1 mm and 5 mm can be used in this embodiment. In this embodiment, the depth of "g" recesses 3340 and 3380, is approximately 9 mm. However, this depth in other embodiments can be up to about 20 mm. The depth "h" of recesses 3350 and 3370 is approximately 6 mm. This depth in other embodiments can range up to about 10 mm. The depth "i" of recess 3360 is approximately 3 mm. This depth can be as low as 1 mm. The relative increase in velocity "v" of reactants in areas corresponding to the recesses shows a generally bell-shaped distribution above each recess. However, as can be seen, the velocity profile is higher for recesses 3340 and 3380 toward the peripheral of the target, relatively moderate for recesses 3350 and 3370, and lower for recess 3360 toward the center of the target. The resulting optical effect is tailored to be brighter around the outer edge of the target and more attenuated in the center.

Figure 38B:
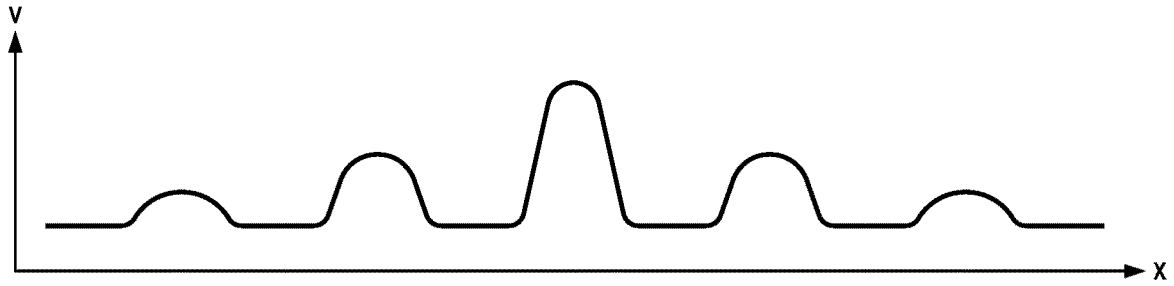
FIG. 38B is a graph of the relative velocities of reactants from energetic material that is detonated in the recesses.
Figure 38A:
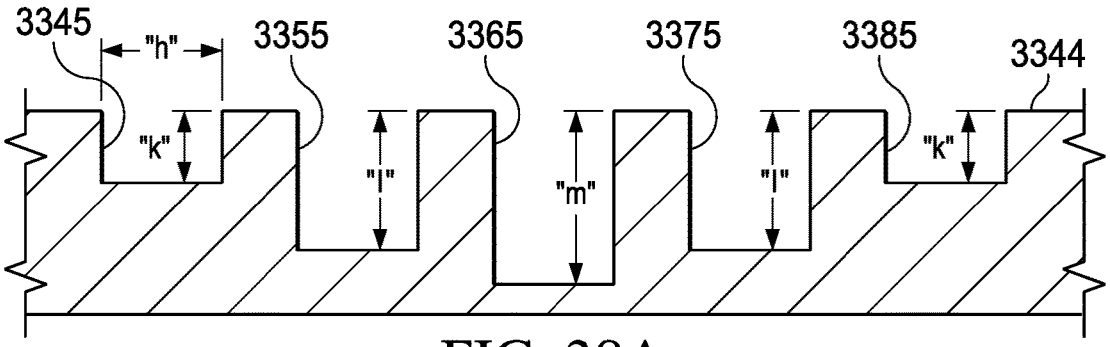
FIG. 38A is a schematic cross sectional view of a preferred embodiment of recesses.

Referring to FIGS. 38A and 38B, a set of five cylindrical recesses 3345, 3355, 3365, 3375 and 3385 are shown, adjacent planar surface 3344. In this embodiment, each of the recesses has a generally uniform width but varies in depth from a higher depth in a central position to lower depths at peripheral positions. In a preferred embodiment, width "h" is about 3 mm. The width can vary. In this embodiment, the depth of "k" recesses 3345 and 3385, is approximately 3 mm. This depth can be as low as 1 mm. The depth "l" of recesses 3355 and 3375 is approximately 6 mm, but can range up to about 10 mm. The depth "m" of recess 3365 is approximately 9 mm, but can range up to about 20 mm. The relative increase in velocity "v" of reactants in areas corresponding to the recesses shows a generally bell-shaped distribution above each recess. However, as can be seen the velocity profile is higher for recess 3365 toward the center of the target, relatively moderate for recesses 3355 and 3375, and lower for recesses 3345 and 3385 toward the periphery of the target. The resulting optical effect upon detonation is tailored to be brighter in the center of the target and more attenuated around the outer edge of the target.

Figure 39B:
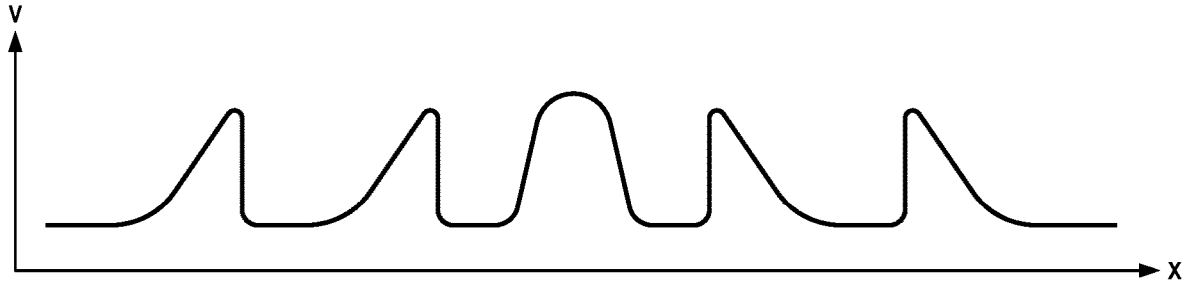
FIG. 39B is a graph of the relative velocities of reactants from energetic material that is detonated in the recesses.
Figure 39A:
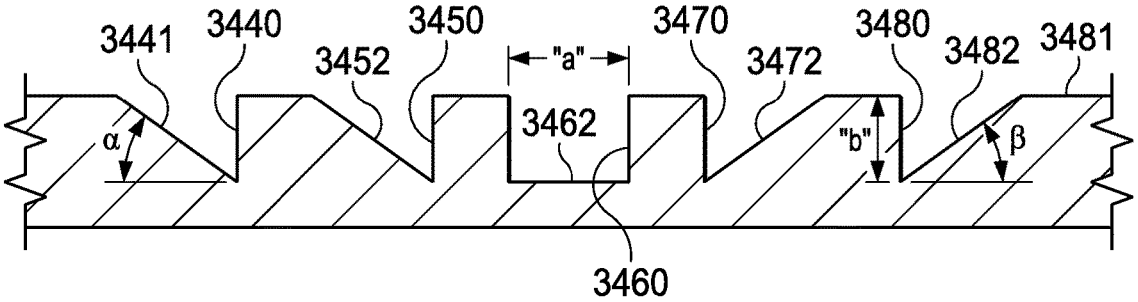
FIG. 39A is a schematic cross sectional view of a preferred embodiment of recesses.

Referring to FIG. 39A, an alternate embodiment of various recesses is shown. The average detonation wave can be controlled by the shape of the individual recesses. One or more surfaces of the individual recesses can have topological features that affect the shape of the average detonation wave. For example, the bottom of each recess may be planar or may assume a complex curved or sloped surface. Likewise, the sidewalls of each recess may be curved or sloped surfaces.

Examples include recesses 3440, 3450, 3460, 3470 and 3480 adjacent planar surface 3481. Recesses 3440 and 3450 comprise "right facing" inclined planes 3441 and 3452, respectively. Each of the inclined planes forms an angle α with respect to the planar surface. Angle α is approximately 45°. Other angles from about 0° to about 90° can be employed.

Recess 3460 comprises a rectangular cross section having a bottom 3462 generally parallel with planar surface 3481, and sidewalls generally perpendicular to planar surface 3481.

Recesses 3470 and 3480 comprise "left facing" inclined planes 3472 and 3482, respectively. Each of the inclined planes is positioned at angle β with respect to planar surface 3481. Angle β is approximately 45°. Other angles from about 0° to about 90° can be employed.

Each of the recesses in this embodiment are preferably of width "a" of about 2 mm and a height "b" of about 2 mm. All dimensions are ±5%.

Referring to FIG. 39B, a relative velocity profile is shown on the y axis corresponding to a relative position x with respect to the recesses. The velocity profile corresponding to recesses 3440 and 3450 are characteristically shifted to the right to correspond with the increased amount of energetic material in the right portion of each of the recesses. The right shift in this embodiment extends from the peripheral toward the center of the target. The velocity curve corresponding to recess 3460 is, as expected, a characteristic bell curve because the amount of energetic material in the recesses uniform across its base. The velocity curve corresponding to recesses 3470 and 3480 demonstrates a decided shift in velocity to the left, corresponding to the additional amount of energetic material in the left side of each of the recesses. The left shift in this embodiment extends from the peripheral toward the center of the target.

Figure 40B:
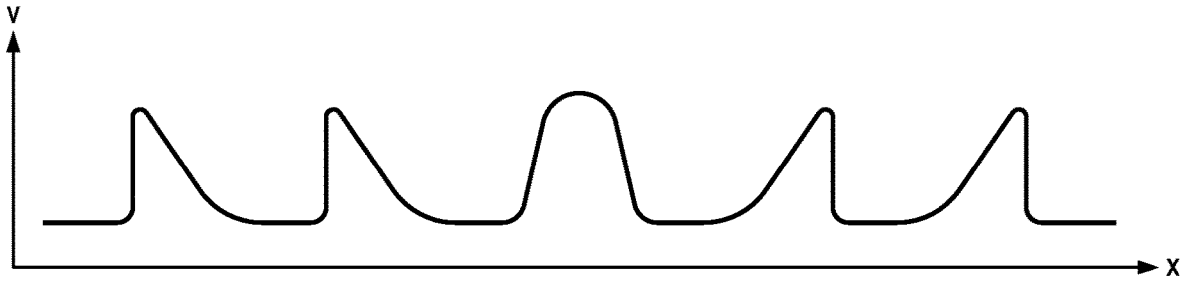
FIG. 40B is a graph of the relative velocities of reactants from energetic material that is detonated in the recesses.
Figure 40A:
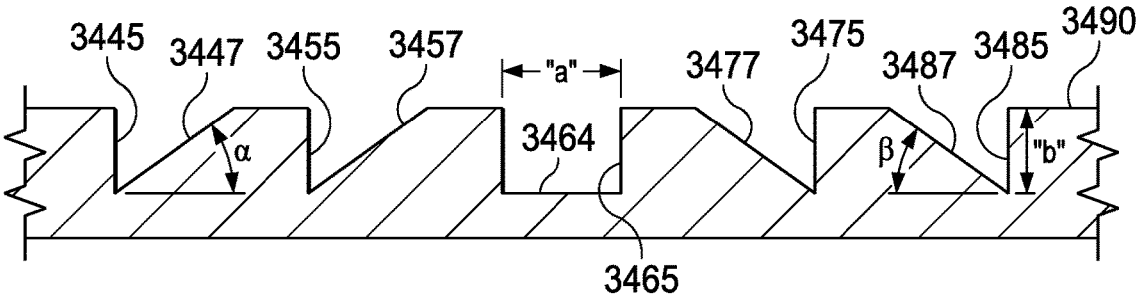
FIG. 40A is a schematic cross sectional view of a preferred embodiment of recesses.

Referring to FIG. 40A, recesses 3445, 3455, 3465, 3475 and 3485 adjacent planar surface 3490 will be described. Recesses 3445 and 3455 comprise "left facing" inclined planes 3447 and 3457, respectively. Each of the inclined planes forms an angle $\alpha$ with respect to the planar surface. Angle $\alpha$ is approximately 45°. All dimensions are ±5%.

Recess 3465 comprises a rectangular cross section having a bottom 3464 parallel with planar surface 3490.

Recesses 3475 and 3485 comprise "right facing" inclined planes 3477 and 3487. Each of the inclined planes is positioned at angle $\beta$ with respect to planar surface 3490. Angle $\beta$ is approximately 45°. All dimensions are ±5%.

Each of the recesses in this embodiment are preferably of width "a" of 2 mm and a height "b" of 2 mm. All dimensions are ±5%.

Referring to FIG. 40B, a relative velocity profile is shown on the y axis corresponding to a relative position x with respect to the recesses. The velocity profile corresponding to recesses 3445 and 3455 are characteristically shifted to the left to correspond with the increased amount of energetic material in the right portion of each of the recesses. The left shift in this embodiment extends from the center toward the periphery of the target. The velocity curve corresponding to recess 3465 is, as expected, a characteristic bell curve because the amount of energetic material in the recesses uniform across its base. The velocity curve corresponding to recesses 3475 and 3485 demonstrates a decided shift in velocity to the right, corresponding to the additional amount of energetic material in the right side of each of the recesses. The right shift in this embodiment extends from the center toward the periphery of the target.

Figure 41:
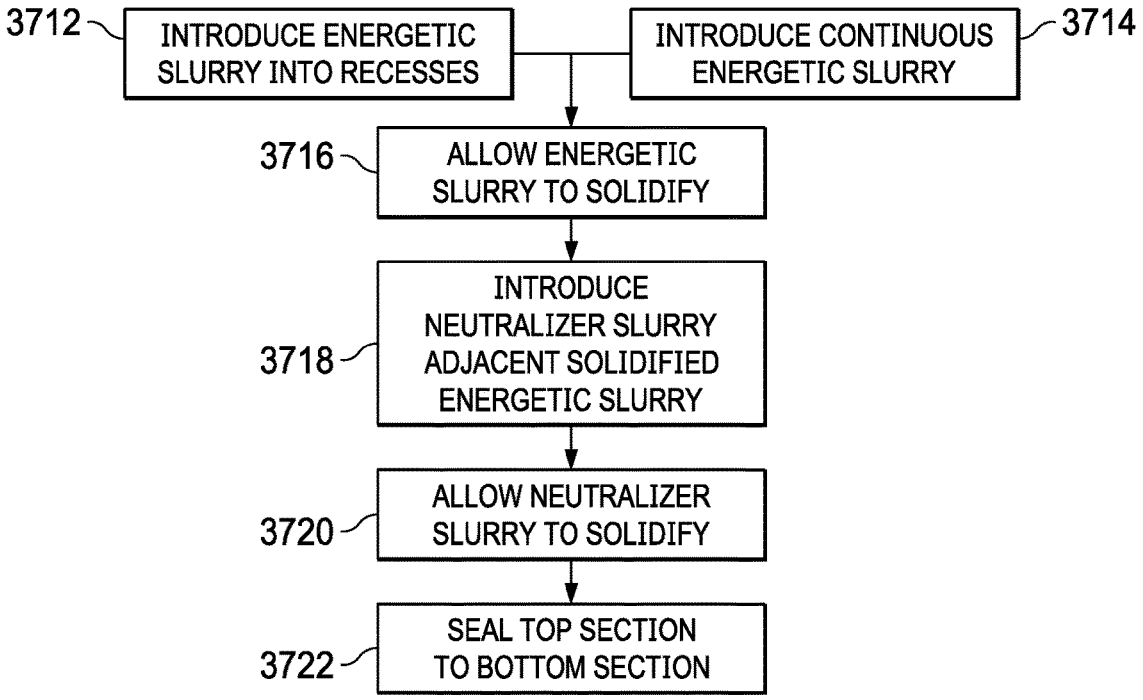
FIG. 41 is a flowchart of a preferred method of manufacture of a preferred embodiment.

Referring to FIG. 41, a method of manufacturing a preferred embodiment of a target will be described. Preparatory steps can be the same as or similar to steps 2201 to 2212 in FIG. 22. At step 3712, the energetic slurry is introduced into the recesses of the bottom section of the container. In this embodiment, the recesses are each filled individually so as to prevent covering the planar surface of the bottom section. Preferably, a micronozzle is positioned above each recess which disperses sufficient slurry to fill the recess. Alternatively, at step 3714, excess energetic slurry is introduced into the recesses and also over the planar surface. In this embodiment, enough energetic slurry is introduced to form a continuous layer across the planar surface of the bottom section, as previously described. At step 3716, a time delay is observed in order to allow the energetic slurry to solidify. At step 3718, a neutralizer slurry is introduced into the bottom section adjacent the solidified energetic slurry. At step 3720, the neutralizer slurry is allowed to solidify. At step 3722, the container is sealed by mechanically impressing the top section upon the bottom section. In a preferred embodiment, this step is accomplished by bending the sidewalls of the top section radially outward until they overlap the sidewalls of the bottom section and then impressing the top section onto the bottom section and releasing the sidewalls thereby forming a sealed container.

It will be appreciated by those skilled in the art that modifications can be made to the embodiments disclosed and remain within the inventive concept. Therefore, this invention is not limited to the specific embodiments disclosed, but is intended to cover changes within the scope and spirit of the claims.

The invention claimed is:

1. A reactive target comprising:

a container having a planar interior surface;

a plurality of recesses in the planar interior surface;

an energetic material located in the plurality of recesses;

wherein the energetic material has a first set of properties consisting of one or more of color and grain size of the energetic material in dry form;

a neutralizer material, in the container, adjacent the energetic material, having a second set of properties consisting of one or more of color and grain size of the neutralizer material in dry form which approximate the one or more of color and grain size of the first set of properties;

an indiscernible boundary interface between the energetic material and the neutralizer material; and wherein the indiscernible boundary interface is visually indiscernible with unassisted vision.

2. The reactive target of claim 1 wherein the energetic material covers the planar interior surface.

3. The reactive target of claim 1 wherein the container further comprises:

a top section connected to a bottom section to form a cavity.

4. The reactive target of claim 3 further comprising:

a first sidewall integrally formed in the top section;

a second sidewall integrally formed in the bottom section; and the first sidewall joined by a mechanical interference fit with the second sidewall.

5. The reactive target of claim 4 wherein the first sidewall forms a first frustoconical shape and the second sidewall forms a second frustoconical shape.

6. The reactive target of claim 3 wherein a concentration of the energetic material located in the plurality of recesses exhibits an increasing velocity profile upon detonation from a periphery to a center interior of the bottom section.

7. The reactive target of claim 3 wherein a concentration of the energetic material located in the plurality of recesses exhibits a decreasing velocity profile upon detonation from a periphery to a center of the bottom section.

8. The reactive target of claim 3 wherein a concentration of the energetic material located in a recess of the plurality of recesses exhibits a velocity profile upon detonation that increases from a periphery to a center of the bottom section.

9. The reactive target of claim 3 wherein a concentration of the energetic material located in a recess of the plurality of recesses exhibits a velocity profile upon detonation that decreases from a periphery to a center of the bottom section.

10. The reactive target of claim 1 wherein the plurality of recesses forms a polarizing means for aligning a flash from a detonation of the energetic material.

11. The reactive target of claim 1 wherein the container is a generally flat cylinder.

12. The reactive target of claim 1 wherein each recess of the plurality of recesses forms a cylinder.

13. The reactive target of claim 12 wherein the plurality of recesses is distributed randomly across the planar interior surface.

14. The reactive target of claim 1 wherein the plurality of recesses forms a plurality of concentric rings.

15. The reactive target of claim 1 wherein the plurality of recesses forms a plurality of generally radial grooves.

16. The reactive target of claim 1 wherein the plurality of recesses forms a plurality of generally parallel grooves.

17. The reactive target of claim 1 wherein each recess of the plurality of recesses has a converging sidewall and a flat bottom.

18. The reactive target of claim 1 wherein each recess of the plurality of recesses has a diverging sidewall and a flat bottom.

19. The reactive target of claim 1 wherein the plurality of recesses has a trend of decreasing depth toward a center of the planar interior surface.

20. The reactive target of claim 1 wherein the plurality of recesses has a trend of increasing depth toward a center of the planar interior surface.

21. The reactive target of claim 1 wherein a recess of the plurality of recesses has a contoured bottom surface.

22. The reactive target of claim 1 wherein a recess of the plurality of recesses has an angled bottom surface relative to the planar interior surface.

23. The reactive target of claim 1 wherein a concentration of the energetic material located in a recess of the plurality of recesses exhibits a velocity profile upon detonation having a predetermined aspect ratio.

24. A method of producing a reactive target comprising:

providing a container, having an interior surface with a plurality of recesses;

depositing an energetic slurry in the plurality of recesses;

allowing the energetic slurry to solidify;

wherein the step of depositing an energetic slurry further comprises providing an energetic slurry that, when solidified, has a first set of properties consisting of one or more of color and grain size;

further comprising the steps of:

providing a neutralizer slurry that, when solidified, has a second set of properties consisting of one or more of color and grain size which approximate the one or more of color and grain size of the first set of properties;

depositing the neutralizer slurry adjacent the energetic slurry; and allowing the neutralizer slurry to solidify;

wherein an indiscernible boundary interface exists between the energetic slurry, when solidified, and the neutralizer slurry, when solidified, which is visually indiscernible with unassisted vision.

25. The method of claim 24 further comprising depositing the energetic slurry on the interior surface.

26. The method of claim 24 further comprising sealing a top section of the container to a bottom section of the container after allowing the energetic slurry to solidify.

* * * * *